US009546648B2

(12) United States Patent
Marica

(10) Patent No.: US 9,546,648 B2
(45) Date of Patent: Jan. 17, 2017

(54) DAMPENERS FOR PUMPING SYSTEMS

(71) Applicant: National Oilwell Varco, L.P., Houston, TX (US)

(72) Inventor: Adrian Marica, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 665 days.

(21) Appl. No.: 13/787,316

(22) Filed: Mar. 6, 2013

(65) Prior Publication Data

US 2013/0189141 A1 Jul. 25, 2013

Related U.S. Application Data

(63) Continuation of application No. 13/123,575, filed as application No. PCT/US2009/059612 on Oct. 6, 2009, which is a continuation-in-part of application No. 12/288,167, filed on Oct. 16, 2008, now abandoned.

(51) Int. Cl.

| | |
|---|---|
| ***F04B 39/00*** | (2006.01) |
| ***F04B 37/14*** | (2006.01) |
| ***F04B 53/00*** | (2006.01) |
| ***F04B 23/10*** | (2006.01) |

(52) U.S. Cl.

CPC ..... *F04B 37/14* (2013.01); *F04B 23/10* (2013.01); *F04B 39/0027* (2013.01); *F04B 39/0061* (2013.01); *F04B 53/001* (2013.01); *F04B 53/002* (2013.01)

(58) Field of Classification Search

CPC . F04B 39/0027; F04B 39/0061; F04B 53/001; F04B 53/002

USPC ..... 138/26, 30; 92/143; 417/540

See application file for complete search history.

(56) References Cited

U.S. PATENT DOCUMENTS

| | | | | |
|---|---|---|---|---|
| 1,990,557 | A | 2/1935 | Melott | 251/127 |
| 2,380,866 | A | 7/1945 | Overbek | 138/30 |
| 2,605,080 | A | 7/1952 | Rea | 251/128 |
| 2,632,631 | A | 3/1953 | Griffin et al. | |
| 2,928,646 | A | 3/1960 | Ashbrook | |
| 2,934,025 | A | 4/1960 | Wilson | |
| 3,000,320 | A | 9/1961 | Ring | |

(Continued)

FOREIGN PATENT DOCUMENTS

| | | |
|---|---|---|
| CN | 201731120 U | 2/2011 |
| DE | 19602796 A1 | 8/1996 |
| WO | 2010045064 A1 | 4/2010 |

OTHER PUBLICATIONS

Drilling Equipment, Hydraulic Mud Pump: Maritime Hydraulics General Catalogue; 3 pp, 1993-94.

(Continued)

*Primary Examiner* — Charles Freay
*Assistant Examiner* — Christopher Bobish
(74) *Attorney, Agent, or Firm* — Amerson Law Firm, PLLC

(57) ABSTRACT

A drilling fluid pumping system including a pump apparatus with a pumping chamber having an inlet valve and an outlet valve and a dampener system in fluid communication with the pumping chamber for damping the flow of fluid, e.g. drilling fluid, This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

23 Claims, 45 Drawing Sheets

(56) References Cited

U.S. PATENT DOCUMENTS

| | | | | |
|---|---|---|---|---|
| 3,050,943 | A | 8/1962 | Thorel et al. | 60/52 |
| 3,053,500 | A | 9/1962 | Atkinson | 251/332 |
| 3,061,039 | A * | 10/1962 | Peters | 181/233 |
| 3,066,700 | A | 12/1962 | Mercier | 138/30 |
| 3,409,038 | A | 11/1968 | Blackford | 137/516.15 |
| 3,420,553 | A * | 1/1969 | Poxon | 285/49 |
| 3,447,777 | A | 6/1969 | Carlson | |
| 3,537,679 | A | 11/1970 | Bulnes | |
| 3,658,138 | A | 4/1972 | Gosselin | 173/1 |
| 3,664,371 | A | 5/1972 | Schneider | |
| 3,857,542 | A | 12/1974 | Heymann | |
| 3,934,608 | A | 1/1976 | Guyton | 137/527.8 |
| 3,967,809 | A | 7/1976 | Skantar | |
| 4,088,154 | A | 5/1978 | Patton | 138/30 |
| 4,174,725 | A | 11/1979 | LaPere | |
| 4,180,097 | A | 12/1979 | Sjoberg | 137/516.29 |
| 4,195,668 | A | 4/1980 | Lewis | 138/30 |
| 4,201,241 | A | 5/1980 | Schertler | 137/527 |
| 4,203,468 | A | 5/1980 | Dietz | |
| 4,242,057 | A | 12/1980 | Bender | 417/404 |
| 4,269,227 | A | 5/1981 | Araki et al. | |
| 4,295,366 | A | 10/1981 | Gibson et al. | 73/155 |
| 4,296,770 | A | 10/1981 | Rice | |
| 4,338,689 | A | 7/1982 | Zieg | |
| 4,477,237 | A | 10/1984 | Grable | 417/539 |
| 4,487,222 | A | 12/1984 | Crawford | 137/516.29 |
| 4,518,329 | A | 5/1985 | Weaver | 417/566 |
| 4,523,612 | A * | 6/1985 | Kuklo | 138/30 |
| 4,527,959 | A | 7/1985 | Whiteman | 417/342 |
| 4,573,886 | A | 3/1986 | Maasberg et al. | 417/454 |
| 4,607,822 | A | 8/1986 | Schabert et al. | |
| 4,618,316 | A | 10/1986 | Elliott | 417/454 |
| 4,676,724 | A | 6/1987 | Birdwell | 417/342 |
| 4,688,755 | A | 8/1987 | Pluviose | |
| 4,770,206 | A | 9/1988 | Sjoberg | 137/516.29 |
| 4,815,698 | A | 3/1989 | Palmer | |
| 4,854,397 | A | 8/1989 | Warren et al. | 175/26 |
| 4,860,995 | A | 8/1989 | Rogers | 251/356 |
| 4,995,465 | A | 2/1991 | Beck et al. | 175/27 |
| 5,059,101 | A | 10/1991 | Valavaara | 417/569 |
| 5,063,776 | A | 11/1991 | Zanker et al. | 73/155 |
| 5,088,521 | A | 2/1992 | Johnson | 137/516.29 |
| 5,175,455 | A | 12/1992 | Penicaut | 310/12 |
| 5,193,577 | A | 3/1993 | de Koning | 137/516.29 |
| 5,201,887 | A * | 4/1993 | Bruchez, Jr. | F02K 1/82 60/725 |
| 5,226,445 | A | 7/1993 | Surjaatmadja | 137/516.29 |
| 5,253,987 | A | 10/1993 | Harrison | 417/566 |
| 5,320,136 | A | 6/1994 | Morris et al. | 137/528 |
| 5,421,358 | A | 6/1995 | Jaeger | |
| 5,462,254 | A | 10/1995 | Muller | |
| 5,465,799 | A | 11/1995 | Ho | 175/61 |
| 5,522,423 | A | 6/1996 | Elliott | 137/515.7 |
| 5,616,009 | A | 4/1997 | Birdwell | 417/342 |
| 5,678,802 | A | 10/1997 | Lunder | |
| 5,823,093 | A | 10/1998 | Kugelev et al. | 92/128 |
| 5,910,691 | A | 6/1999 | Wavre | 310/12 |
| 5,960,700 | A | 10/1999 | Staggs et al. | 92/240 |
| 6,000,417 | A | 12/1999 | Jacobs | 137/2 |
| 6,050,348 | A | 4/2000 | Richarson et al. | 175/26 |
| 6,056,013 | A | 5/2000 | Sasaki | |
| 6,076,557 | A * | 6/2000 | Carney | 138/30 |
| 6,102,673 | A | 8/2000 | Mott et al. | 417/392 |
| 6,244,295 | B1 | 6/2001 | Bartussek et al. | 137/540 |
| 6,257,354 | B1 | 7/2001 | Schrader et al. | 175/38 |
| 6,264,436 | B1 | 7/2001 | Edwards et al. | |
| 6,293,517 | B1 | 9/2001 | Cunningham | 251/315.02 |
| 6,361,288 | B1 | 3/2002 | Sperry | |
| 6,491,065 | B1 | 12/2002 | Rogers | |
| 6,536,467 | B2 | 3/2003 | Wu et al. | |
| 6,539,975 | B2 | 4/2003 | Hedenberg | |
| 6,581,632 | B2 | 6/2003 | Walpole et al. | 137/512.1 |
| 6,802,378 | B2 | 10/2004 | Haci et al. | 175/26 |
| 6,843,465 | B1 | 1/2005 | Scott | |
| 6,864,647 | B2 | 3/2005 | Duncan et al. | 318/114 |
| 6,874,540 | B2 | 4/2005 | Lee | 138/31 |
| 6,918,453 | B2 | 7/2005 | Haci et al. | 175/26 |
| 6,923,422 | B2 | 8/2005 | Schmaltz | |
| 6,944,547 | B2 | 9/2005 | Womer et al. | 702/7 |
| 6,955,339 | B1 | 10/2005 | Blume | 251/318 |
| 6,960,858 | B2 | 11/2005 | Kawai | 310/181 |
| 7,108,244 | B2 | 9/2006 | Hardin | |
| 7,121,304 | B2 | 10/2006 | Gray, Jr. | |
| 7,168,440 | B1 | 1/2007 | Blume | 137/15.18 |
| 7,264,280 | B2 * | 9/2007 | Kim | 285/226 |
| 7,374,147 | B2 | 5/2008 | Nohl et al. | |
| 7,533,692 | B2 | 5/2009 | Walpole et al. | 137/533.27 |
| 7,798,532 | B2 * | 9/2010 | Huber | 285/49 |
| 2002/0012595 | A1 | 1/2002 | Kouno et al. | |
| 2004/0219040 | A1 | 11/2004 | Kugelev et al. | 417/415 |
| 2005/0139266 | A1 | 6/2005 | Partridge | 137/527.8 |
| 2009/0032764 | A1 | 2/2009 | Morreale | 251/366 |
| 2010/0098568 | A1 | 4/2010 | Marica | 417/559 |
| 2011/0180740 | A1 | 7/2011 | Marica | |
| 2011/0250084 | A1 | 10/2011 | Marica | |
| 2012/0222760 | A1 | 9/2012 | Marica | |
| 2012/0223267 | A1 | 9/2012 | Marica | |

OTHER PUBLICATIONS

Hex Pump The Next Generation in Mud Pump Technology; National Oilwell Varco; 6 pp, 2005.

Offshore Triplex Pumps, Premium "P" Series; National Oilwell Varco; 4 pp, 2006.

How to Treat Your Type "P" Triple Mud Pump; National Oilwell; Cover and pp. 1-49, 2002.

Explosion Relief Valves: Efficient Protection for Man and Machine; Hoerbiger; 7pp, 2004.

International PCT Search Report PCT/US09/59612 dated Dec. 4, 2009.

Written Opinion of the ISA dated Dec. 4, 2009.

Office Action dated Dec. 2, 2014, from the State Intellectual Property Office of China for CN Application No. 201280020012.X.

Canadian Office Action Dated May 5, 2016 for Canadian Patent Application No. 2,883,475, filed Feb. 27, 2015.

* cited by examiner

FIG. 1
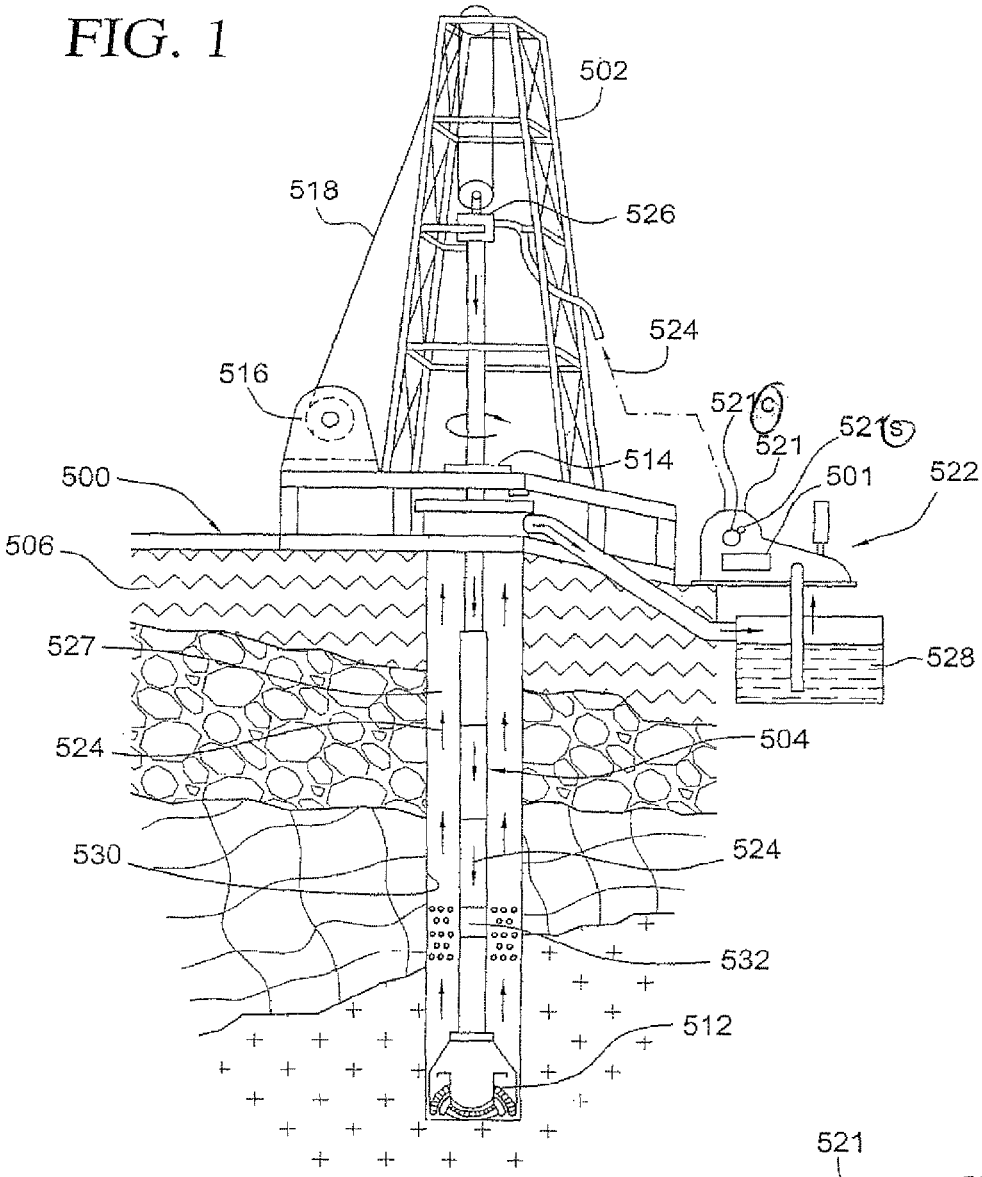
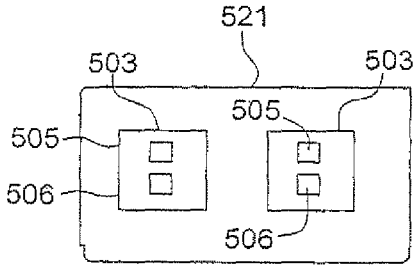
FIG. 1A

DAMPENERS FOR PUMPING SYSTEMS

CROSS-REFERENCE TO RELATED APPLICATION

This is a continuation of U.S. patent application Ser. No. 13/123,575, filed May 12, 2011, which was a 371 filing of PCT/US09/59612, filed Oct. 6, 2009, which was a continuation-in-part of U.S. patent application Ser. No. 12/288,167, filed Oct. 16, 2008.

BACKGROUND OF THE INVENTION

This present invention is directed to drilling wellbores in the earth, to systems for pumping drilling fluid ("mud") for such operations, to mud pumping system modules with surge suppressing dampeners, and to methods of their use.

DESCRIPTION OF THE RELATED

Known references disclose a wide variety of drilling systems, apparatuses, and methods including, but not limited to, the disclosures in U.S. Pat. Nos. 6,944,547; 6,918,453; 6,802,378; 6,050,348; 5,465,799; 4,995,465; 4,854,397; and 3,658,138, all incorporated fully herein for all purposes. Prior references disclose a wide variety of drilling fluid pumps ("mud pumps") used in drilling operations and pump systems, for example, and not by way of limitation, those pumps and systems disclosed in U.S. Pat. Nos. 6,257,354; 4,295,366; 4,527,959; 5,616,009; 4,242,057; 4,676,724; 5,823,093; 5,960,700; 5,059,101; 5,253,987; in U.S. application Ser. No. 10/833,921 filed Apr. 28, 2004 (all said U.S. references incorporated fully herein for all purposes). Known references disclose a variety of dampeners, accumulators, and surge suppressors; including, but not limited to, those disclosed in U.S. Pat. Nos. 4,299,253; 4,195,668; 2,757,689; 2,804,884; 3,674,053; 3,169,551; 3,674,053; 3,162,213; 2,380,866; 2,378,467; 2,397,248; 2,397,796; and 2,773,455—all incorporated fully herein for all purposes.

A drill bit carried at an end of a drillstring is rotated to form wellbores in the earth. Certain drillstrings include tubulars which may be drill pipe made of jointed sections or a continuous coiled tubing and a drilling assembly that has a drill bit at its bottom end. The drilling assembly is attached to the bottom end of the tubing or drillstring. In certain systems, to drill a wellbore, the drill bit is rotated (e.g., by a top drive, a power swivel, a rotary table system, or by a downhole mud motor carried by the drilling assembly). Drilling fluid, also referred to as "mud," is pumped through the wellbore under pressure from a pit or container at the surface by a pumping system at the surface.

In certain known mud pump systems, suction and discharge modules have valves therein that selectively control fluid flow through the module in an intake (suction) mode in which piston apparatus creates a vacuum drawing drilling fluid into the module and in an output mode (Discharge) in which the piston apparatus creates pressure forcing drilling fluid out of the module. In the suction mode, a suction valve opens allowing drilling fluid into the module while a discharge valve remains closed. In the discharge mode, the pressure of the drilling fluid closes the suction valve and opens the discharge valve.

Both valves, the suction valve and the discharge valve, are subjected to the erosive and damaging effects of the flow of drilling fluid. The drilling fluid contains drilled cuttings and debris which can erode valve parts (e.g. seats, stems, valve members, seals, guide bushings, insert, liners, wear plates etc.). Also, mud pumps which can pump relatively hot drilling fluid at, e.g., 500 to 2000 gallons per minute, force the erosive drilling fluid against the valve parts at high velocities which add to the fluid's damaging effects.

In many valves used in mud pump systems, a guide in the valve which is disposed across a flow path or guide fingers extending from a valve member into a valve seat guide a valve member so that valve member seats correctly and effectively against the valve seat. In many valves, the valve seat surface against which the valve member (or poppet) seats is, ideally, flat; and the surface of the valve member which sealingly abuts the flat seat surface of the valve seat is, correspondingly, and ideally, flat. A guide or guide fingers facilitates correct seating of the valve member's flat seating surface against the valve seat's flat seat surface. If either surface is not flat, or if one surface does not contact the other in a substantially parallel (flat surface to flat surface) manner, ineffective or inefficient valve operation may result.

The erosive and/or damaging effects of drilling fluid flow through a valve can damage the seating surfaces so that the ideal flat-surface-to-flat surface seating is not achieved. Also, the drilling fluid can damage a guide (e.g. ribs and a channel for receiving a stem or rod projecting from a valve member) or guide fingers so that the ideal surface seating is not achieved. In some instances, damage to a guide or to guide fingers results in a flat valve member surface contacting a flat seating surface at an angle so that effective valve closure is not possible or so that the valve is insufficiently closed for efficient operation. In some aspects, erosive drilling fluid flow renders initially-flat seating surfaces non-flat with resulting ineffective sealing and valve closure.

For these reasons in many mud pump systems, suction and discharge valves are repaired or replaced on a regular basis.

In many known mud pump valves, the valves are opened and closed by mechanically creating a vacuum or fluid pressure increase in the valve that overcomes a spring to allow a valve member to move. The movement of the valve member is not controlled, i.e., it is subject to a surge of fluid under pressure. As fluid pressure builds up to move a valve member, a corresponding amount of fluid builds up adjacent the valve, when the pressure is high enough, a relatively large charge of fluid goes through the valve at high velocity. This surge of fluid can have deleterious effects on valve parts.

BRIEF SUMMARY OF THE INVENTION

The present invention, in at least certain embodiments, discloses systems for pumping a drilling fluid mixture, the drilling fluid mixture containing drilling fluid and solids, the systems having: a pump apparatus; the pumping apparatus having a body with a pumping chamber, an inlet and an outlet; a suction valve in the body for selectively controlling flow of the drilling fluid mixture in through the inlet; a discharge valve in the body for selectively controlling flow of the drilling fluid mixture out through the outlet; and a dampener system according to the present invention in fluid communication with the pumping chamber.

Such a pump system according to the present invention, in one aspect, includes: a base; a housing connected to the base, the housing having an interior; a liner within the housing, the liner expandable in response to fluid pressure; a piston/cylinder apparatus in fluid communication with the housing; the piston/cylinder apparatus having a movable piston movable in response to fluid flowing from the housing to the piston/cylinder apparatus; a torsion apparatus movably connected to the base, the piston movable to contact and to move the torsion apparatus in response to fluid flowing from the housing to the piston/cylinder apparatus; and the torsion apparatus movable by the piston from a first static position to a second position to dampen pulsations of fluid into the pumping chamber.

In one aspect, a pumping system according to the present invention has a dampener system according to the present invention which includes: a housing, the housing having an interior; a deformable bladder within the housing, the deformable bladder in fluid communication with the pumping chamber; and the deformable bladder deformable in response to pressure variation in the pumping chamber.

The present invention discloses, in certain aspects, dampeners for drilling fluid pumping systems which suppress and/or eliminate the damaging effects of undesirable pulsations or surges of drilling fluid passing through the systems. In certain aspects, the dampener has a liner with liquid therein which expands and contracts in response to the pressure of drilling fluid passing through a pumping system.

The present invention discloses, in certain aspects, dampeners for drilling fluid pumping systems in which the dampener has a liner with liquid therein which expands and contracts in response to the pressure of drilling fluid passing through a pumping system. In certain aspects, a dampener according to the present invention has a torsion apparatus that absorbs and then releases energy to facilitate the dampening of drilling fluid surges. In other aspects, a dampener system according to the present invention has an inflatable bladder surrounded by an expandable spring member, both the bladder and the spring member responsive to drilling fluid surges to suppress deleterious effects of such surges.

The present invention discloses, in certain aspects, modules for a drilling fluid pumping system which include a dampener for suppressing and/or eliminating the damaging effects of undesirable pulsations or surges of drilling fluid passing through the modules. In certain aspects, the dampener is within a block of the module that also contains suction and discharge valve assemblies within a module block.

The present invention discloses, in certain aspects, a drilling fluid pumping system, also known as a mud pump system, for pumping drilling fluid or mud used in wellbore operations which has pumping modules with valves that have non-flat seating surfaces. In certain aspects, such valves have a valve member or poppet that is movable with multiple degrees of freedom in any of which effective seating of the valve member against a valve seat is achieved. In particular aspects of such a valve, dual scaling is achieved by sealing of a valve member against both a valve seat and against a seal disposed in a valve seat.

In certain particular aspects of a mud pump system according to the present invention, a mud pump valve has a tapered spring biased against a valve member which enhances the free seating movement of a valve member.

The present invention discloses, in certain aspects, valves for a system for pumping a drilling fluid mixture, the drilling fluid mixture containing drilling fluid and solids, the valves having: a seat with a valve seat surface; a valve member with a member surface, part of the valve member movable to seat the member surface against the valve seat surface to prevent the flow of the drilling fluid mixture past the valve seat; a cartridge stem positioned with respect to the valve member, and a valve actuator within the cartridge stem for selectively moving the valve member. In certain aspects, the present invention discloses a system for pumping a drilling fluid mixture, the drilling fluid mixture containing drilling fluid and solids, the system having: a pump apparatus; the pumping apparatus having a body with an inlet and an outlet; a suction valve in the body for selectively controlling flow of the drilling fluid mixture in through the inlet; a discharge valve in the body for selectively controlling flow of the drilling fluid mixture out through the outlet; and a dampener within the body for inhibiting pulsations of fluid pumped from the pump apparatus In certain valves according to the present invention a valve actuator is used which is pneumatically powered without certain mechanically moving parts used in prior valves.

Accordingly, the present invention includes features and advantages which are believed to enable it to advance pumping system technology. Characteristics and advantages of the present invention described above and additional features and benefits will be readily apparent to those skilled in the art upon consideration of the following description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions of embodiments preferred at the time of filing for this patent that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, other objects and purposes will be readily apparent to one of skill in this art who has the benefit of this invention's teachings and disclosures. It is, therefore, an object of at least certain preferred embodiments of the present invention to provide new, useful, unique, efficient, nonobvious dampener systems for drilling fluid pumping systems and methods of their use;

Such dampener systems with a torsion apparatus for damping undesirable fluid pulsations; and Such dampener systems with a deformable bladder for damping undesirable fluid pulsations.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly, from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE DRAWINGS

A more particular description of embodiments of the invention briefly summarized above may be had by references to the embodiments which are shown in the drawings which form a part of this specification. These drawings illustrate embodiments preferred at the time of filing for this patent and are not to be used to improperly limit the scope of the invention which may have other equally effective or legally equivalent embodiments.

FIG. 1 is a schematic view, partially cutaway, of a system according to the present invention.

FIG. 1A is a schematic view of a mud pump system according to the present invention.

Figure 2A:
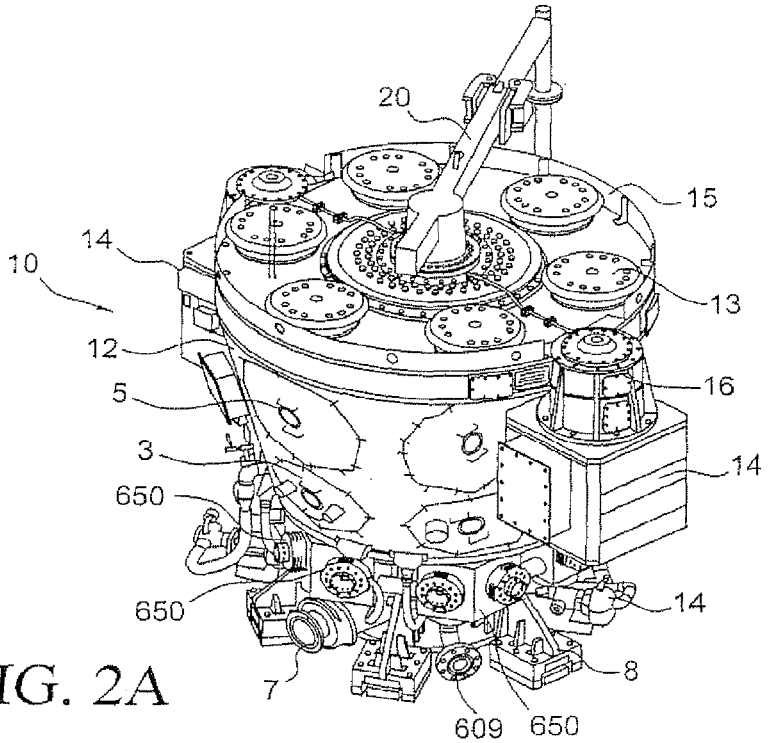
FIG. 2A is a perspective view of a pump apparatus according to the present invention.

Certain embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of certain embodiments and are not intended to limit the invention or the appended claims. On the contrary, the intention is to cover all modifications, equivalents and alternatives falling within the spirit and scope of the invention as defined by the appended claims. In showing and describing these embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

The system 500 shown in FIG. 1 includes a derrick 502 from which extends a drillstring 504 into the earth 506. The drillstring 504, as is well known, can include drill pipes and drill collars. A drill bit 512 is at the end of the drillstring. A rotary system 514, top drive system 526, and/or a downhole motor 532 ("fluid motor", "mud motor") may be used to rotate the drillstring 504 and the drill bit 512. A typical drawworks 516 has a cable or rope apparatus 518 for supporting items in the derrick 502. A mud pump system 522 according to the present invention with one, two, three-to-ten, or more mud pumps 521 according to the present invention each with pumping modules with one or two valves according to the present invention supplies drilling fluid 524 to the drillstring 504. Drilling forms a wellbore 530 extending down into the earth 506. Each mud pump 521 has at least one valve 501 according to the present invention or (as shown in FIG. 1A schematically) multiple pumping modules 503 each with a suction valve 505 according to the present invention and a discharge valve 506 according to the present invention. Each mud pump 521 has a main crank shaft 521*c*.

During drilling, the drilling fluid 524 is pumped by pump(s) 521 of the mud pump system 522 into the drillstring 504 (thereby operating a downhole motor 532 if such an optional motor is used). Drilling fluid 524 flows to the drill bit 512, and then flows into the wellbore 530 through passages in the drill bit 512. Circulation of the drilling fluid 524 transports earth and/or rock cuttings, debris, etc. from the bottom of the wellbore 530 to the surface through an annulus 527 between a well wall of the wellbore 530 and the drillstring 504. Cuttings and debris are removed from the drilling fluid 524 with equipment and apparatuses not shown, and it is re-circulated from a mud pit or container 528 by the pump(s) of the mud pump system 522 back to the drillstring 506. Also, some desirable solids may be added to the drilling fluid.

Figure 2B:
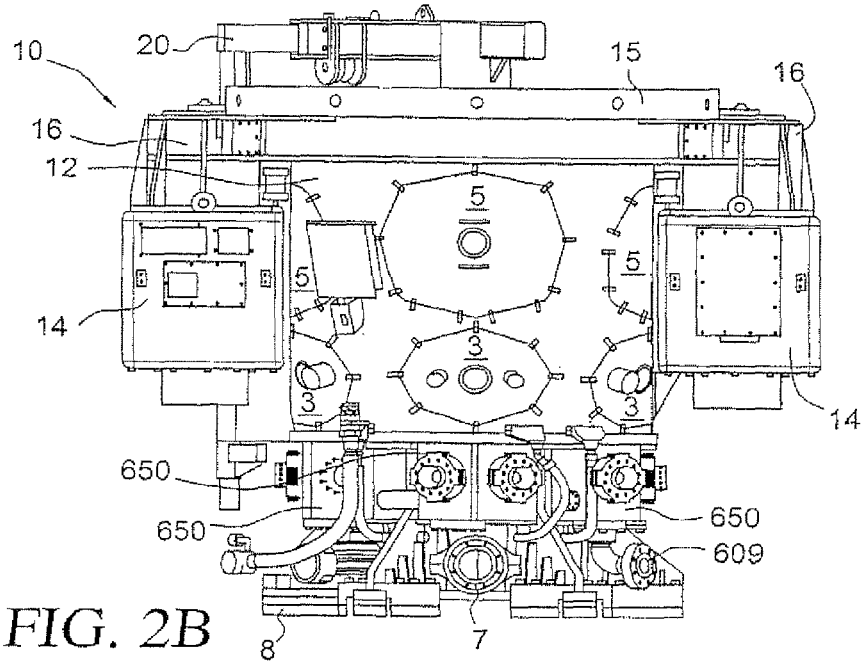
FIG. 2B is a side view of a pump apparatus of FIG. 2A.
Figure 2C:
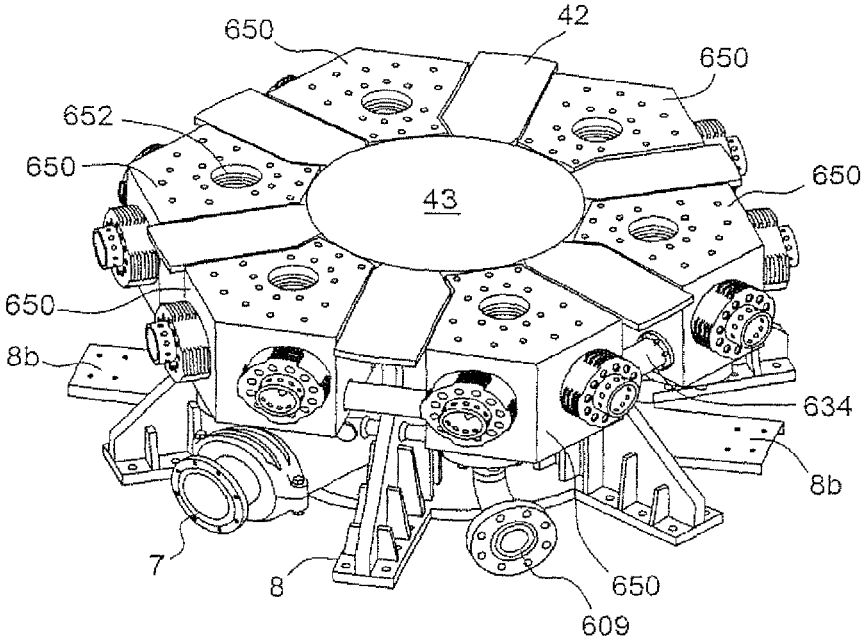
FIG. 2C is a perspective view of part of the apparatus of FIG. 2A.
Figure 2D:
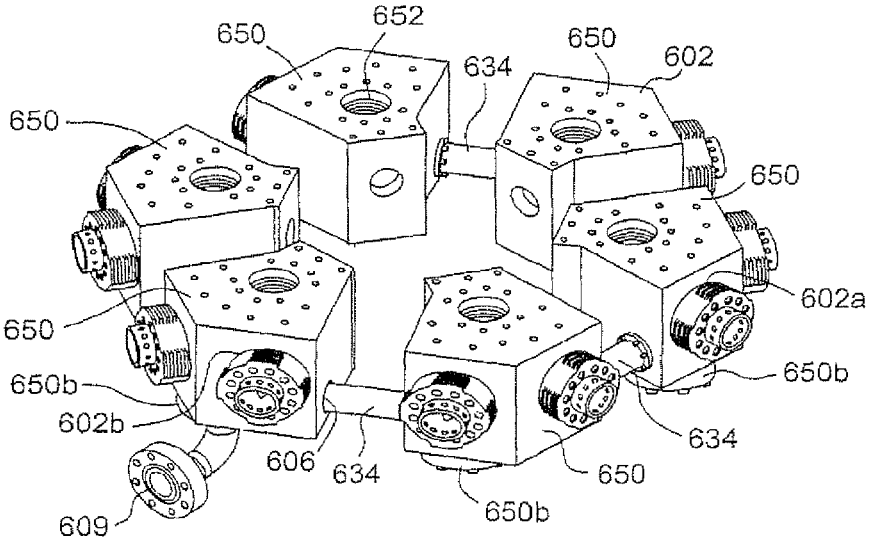
FIG. 2D is a perspective view of part of the apparatus of FIG. 2C.
Figure 2E:
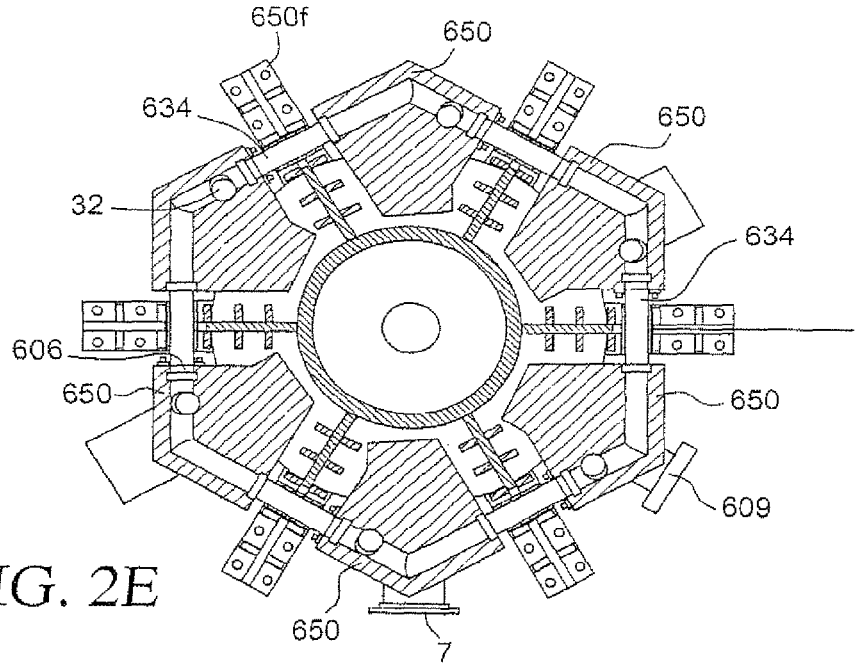
FIG. 2E is a top cross-section view of the part of the apparatus of FIG. 2C.

A system 10 according to the present invention as shown in FIGS. 2A and 2B has a main housing 12 mounted on a base 8 with an optional crane system 20 for lifting and moving system parts. A pedestal 21 of the crane system 20 is rotatably mounted on a bearing assembly 22 on the housing 12. A lift apparatus 23 is movably mounted on a beam 24 and a support 25 extends down from the lift apparatus 23. A chain hoist lift may be used with the structure shown which is attached to the support 25. Motors 14 each drive pinions 16 which in turn drive a drive gear 18 (see FIG. 3C) to move pistons 19 for six removable pump modules 650 (as described below; may be any module disclosed herein and/or may have any valve assembly or valve assemblies disclosed herein). A pressure relief apparatus (e.g. one or more relief valves) is provided for the modules 650 and, as shown, in one aspect, for each of the six modules 650 there is a pressure relief valve 13. Optional rails 15 project up from the housing 12.

An oil pump 2 pumps lubricating oil to various parts of the system. A water pump 4 pumps water to a filtration system (not shown) and a cooler (not shown). The pumps are mounted on pump mounts 8*b* connected to the base 8. Doors 3 and 5 (one each for each pump system 30) provide access to various internal parts of the system 10. Drilling fluid enters the system 10 through an inlet 7 and is pumped out via the modules 650 to a main outlet 9.

The modules 650 have a body 602 with a first bore 602*a* and a second bore 602*b*. A discharge valve assembly according to the present invention is in the first bore and a suction valve assembly according to the present invention is in the second bore. With a piston fluid is pumped into a chamber 652 of the module 650 via an inlet port 604 and is discharged from the module 650 into a discharge conduit 634 via an outlet port 606.

Figure 2F:
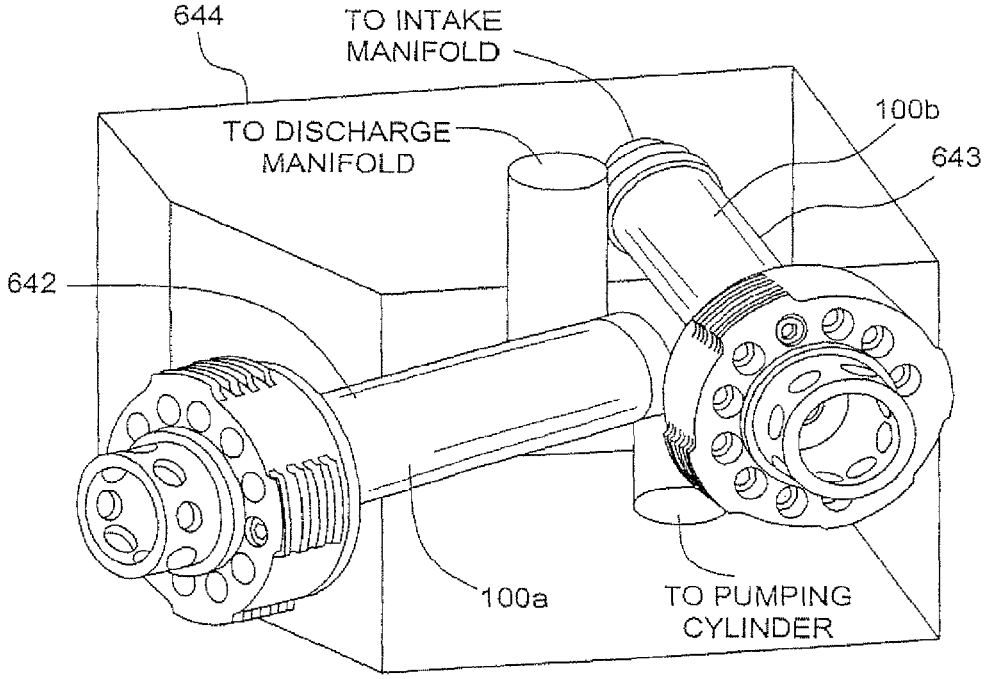
FIG. 2F is a perspective view, partially cutaway, of a pump module according to the present invention with valve assemblies according to the present invention.

FIG. 2F shows the relative positions of two valve assemblies 100*a*, 100*b* (like the valve assembly 100) according to the present invention as they are present in a block of a mud pump module. The valve assemblies 100*a*, 100*b* (which may be any valve assemblies disclosed herein) are in bores 642, 643, respectively, in a block 644. The block 644 can be used in a system like that of FIG. 2A.

Figure 2G:
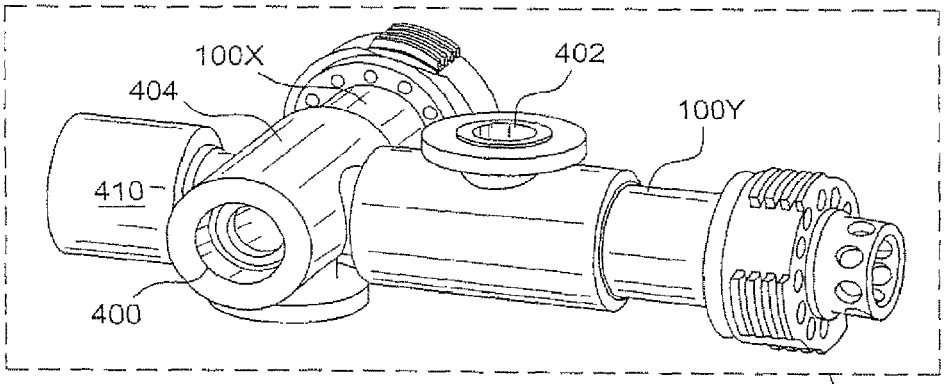
FIG. 2G is a perspective view of two valve assemblies according to the present invention.
Figure 2H:
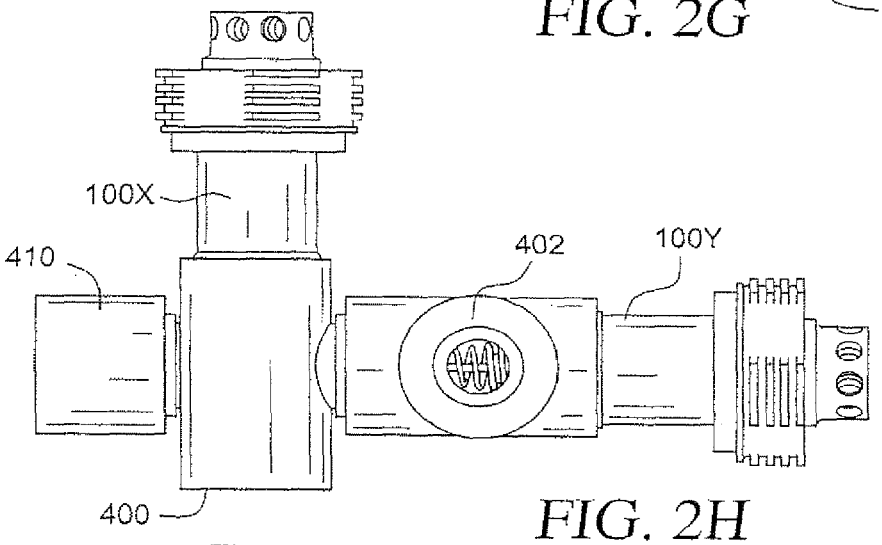
FIG. 2H is a side view of the valve assemblies of FIG. 2G.
Figure 2I:
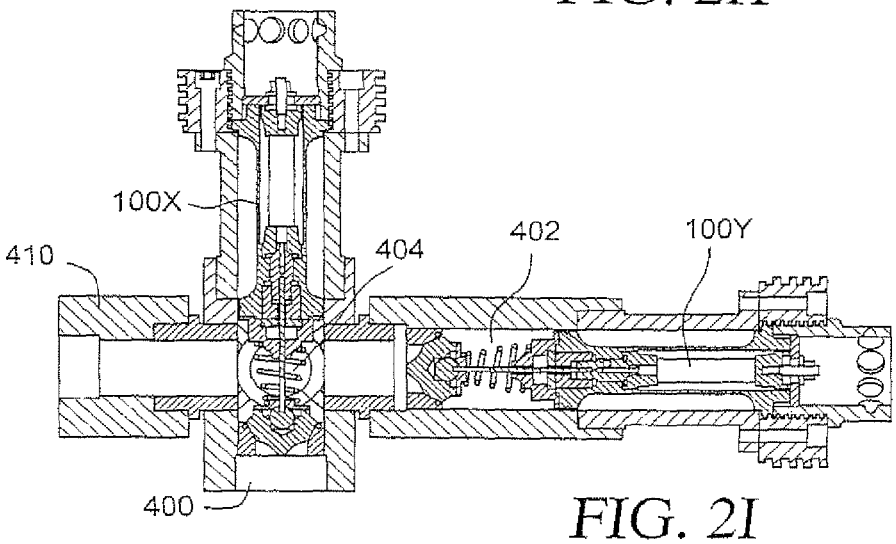
FIG. 2I is a cross-section view of the valve assemblies of FIG. 2G.

FIGS. 2G-2I show two valve assemblies 100*x*, 100*y* (like the valve assembly 100*a*, FIG. 9A; may be any valve assembly according to the present invention) as they are disposed in a block B (shown in dotted line; may be any suitable block or body; including, but not limited to, the body 602 or block 644 referred to above) of a mud pump system. Fluid is sucked in by action of the suction valve assemblies 100*x* through a suction inlet 400 and discharged by action of the discharge valve assembly 100*y* through a discharge outlet 402. The fluid is received in a pumping chamber 404.

Fluid pumped from the chamber 404 can impact parts of the discharge valve 100*x*. Optionally, an accumulator/dampener 410, positioned within the block B, is in fluid communication with the pumping chamber 404. The accumulator/dampener 410 reduces undesirable pulsations of fluid under pressure from the pumping chamber 404. Any suitable known accumulator/dampener may be used.

Figure 3A:
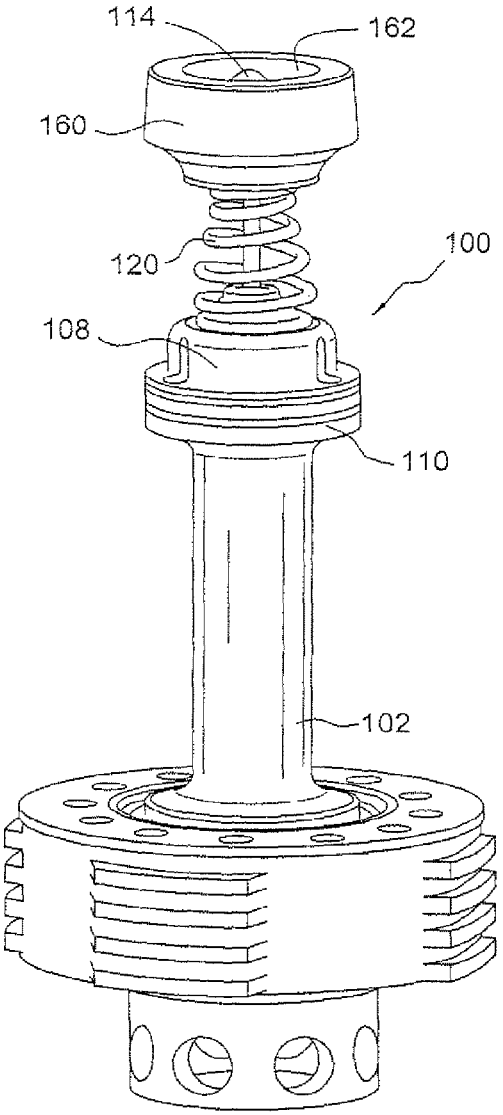
FIG. 3A is a perspective view of a valve assembly according to the present invention.
Figure 3B:
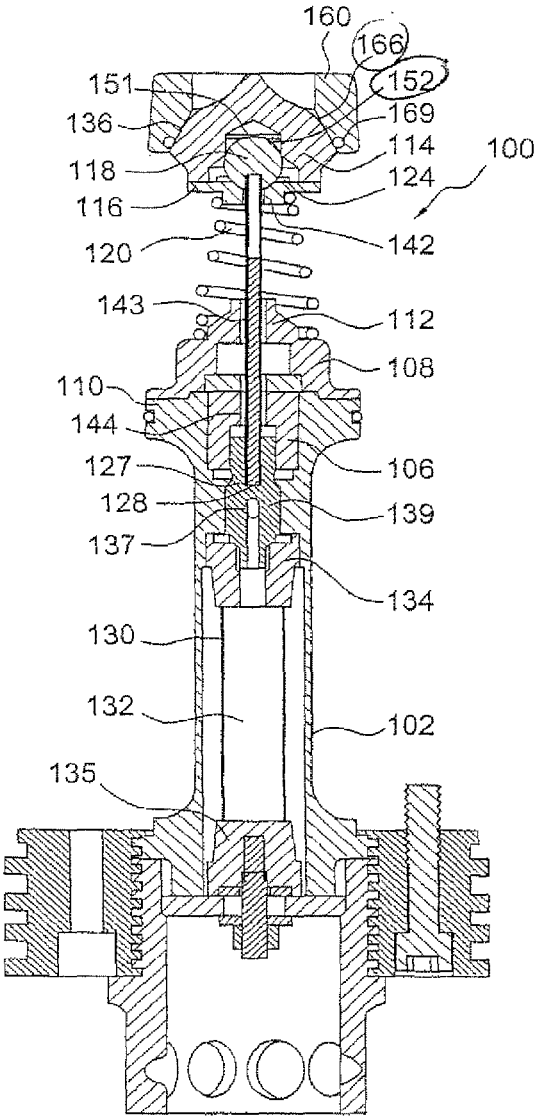
FIG. 3B is a cross-section view of the valve assembly of FIG. 3A.
Figure 4:
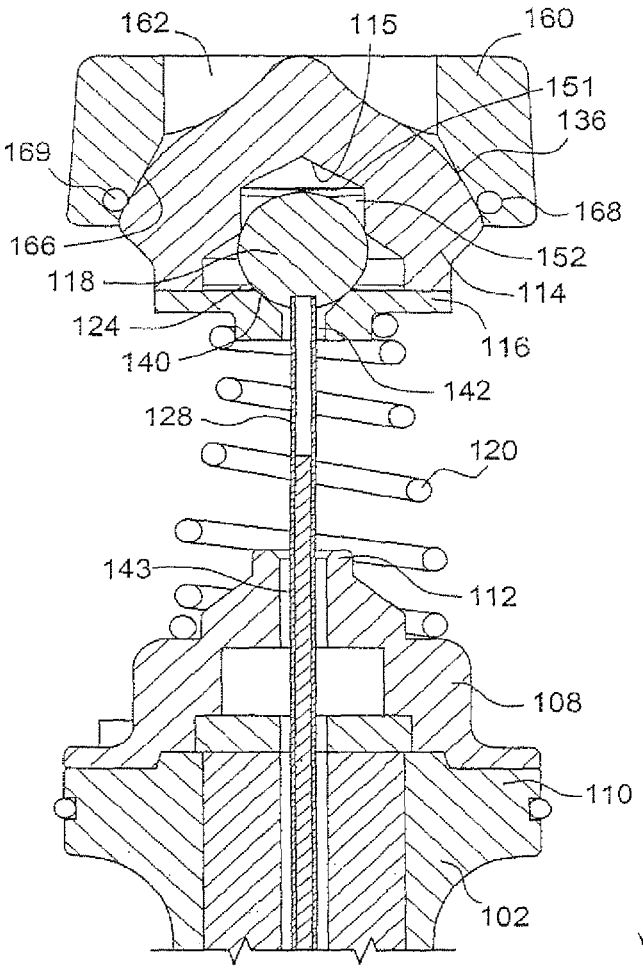
FIG. 4 is a side perspective view, partially cutaway, of part of the valve assembly of FIG. 3A.

FIGS. 3A and 3B show a valve assembly 100 according to the present invention which can serve as a suction valve or a discharge valve for a mud pump system (e.g., but not limited to, the suction valve assembly 680 and the discharge valve assembly 630 described above; or the suction valve 100*x* and the discharge valve 100*y* described above). FIG. 4 shows top portions of the valve assembly 100.

The valve assembly 100 has a hollow cartridge stem 102 with an interior channel 104 within which are located a valve actuator 130 and an adapter 106. A spring support 108, connected to a flange 110 of the cartridge stem 102, has an end 112 which is encompassed by part of an expansion spring 120 an end of which abuts the spring support 108.

A poppet (or curved valve member) 114 rests on a support 116. An end 122 of the spring 120 abuts and is biased against a bottom of the support 116. A ball 118 rests on a ball support 124 which rests on the support 116. A cable 128 (i.e. a non-rigid connector) (made of any known cable material) connected to the ball 118 passes through a hole 140 in and through the support 124, through a hole 142 in the support 116, through the spring 120, through a hole 143 in the spring support 108, through a hole 144 in the adapter 106 which is and is connected to the adapter 106 connected to an actuator 130.

A washer 151 above the ball 118 abuts an underside 115 of the poppet 114. A recess 152 within the poppet 114 houses the ball 118, the washer 151 and the support 124. The poppet 114 has a tapered surface 136 for sealingly abutting a valve seat and a seal of a valve seat as described below.

The poppet 114 is movable toward and away from a valve seat 160. The valve seat 160 has a channel 162 for fluid flow therethrough. The poppet 114 selectively closes off and opens up the channel 162 to fluid flow. Part of the channel 162 is sized and configured for the poppet 114. A surface 166 of the valve seat 160 is positioned to seal against the tapered of the surface 136 of the poppet 114. Optionally, there are no guide fingers projecting from the poppet 114 (although it is within the scope of the present invention to use them); and there are no arms or ribs across the valve seat (it is unobstructed) for receiving and stabilizing a rod, stem or neck projecting from a poppet; and there is no rod, neck or stem projecting from the poppet. Thus, flow through the channel 162 is unobstructed by such parts which are present in many prior valves.

A recess 168 around the valve seat 160 holds a seal 169. Part of the surface 136 of the poppet 114 sealingly abuts the seal 169 when the valve assembly is closed, preventing fluid flow. Thus dual sealing is achieved.

The poppet 114 has a range of freedom of movement within the channel 162 of the valve seat 160. However the poppet 114 is located within and with respect to the valve seat 160, part of the outer tapered surface 136 of the poppet 114 will sealingly abut the seal 169 and the surface 136 will sealingly abut the surface 166. The poppet 114 can be aligned (or not) with the valve seat 160, but either way an effective seal is maintained with part of the surface 136 sealed against the seal 169. Movement of the poppet 114 on the ball 118 and the sizing and configuration of the various parts contribute to permissible freedom of movement of the poppet 114 without sacrificing the sealing necessary to close the valve assembly.

Figure 5:
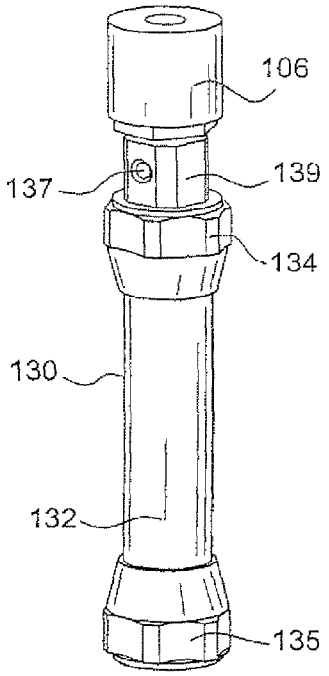
FIG. 5 is a perspective view of an actuator of a valve assembly as in FIG. 3A.

FIG. 5 shows the valve actuator 130 which can be, in certain aspects, any suitable known controllable, valve actuator, e.g., but not limited to "muscle" apparatuses, pneumatic cylinder actuators, hydraulic cylinder actuators, and electromagnetic actuators.

In one aspect, as shown in FIG. 5, the valve actuator 130 is a controlled, pneumatically powered actuator known as a FESTO (TRADEMARK) "muscle" actuator. The actuator 130 has an expandable hose 132 mounted between two bases 134, 135. Air under pressure is introducible into the interior of the hose 132 through a channel 137 in a pneumatic coupling 139. The upper base 134 is connected to an adapter support 127 to which the adapter 106 is secured.

As shown in FIG. 5, air under pressure has not yet been applied within the hose 132. Once air is applied the hose moves outwardly, effectively moving the top base 134 toward the lower base 135 and thereby pulling the adapter 106 to pull the cable 128 and move the poppet 114 out of scaling contact with the valve seat 160 against the force of the spring 120.

Figure 6:
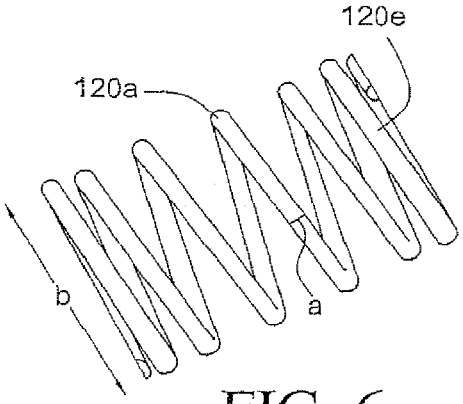
FIG. 6 is a side view of a spring according to the present invention.

FIG. 6 shows one embodiment, a spring 120*a*, of a spring 120. As compared to prior known spring designs, the spring 120*a* has a spring body with a smaller spring diameter, and with a higher spring force; but the wire diameter is relatively large, e.g. 0.22 inches, which results in the higher spring force. Use of an actuator like the actuator 130, FIG. 5, makes it possible to use a spring with the increased spring force (with the increased wire diameter). The overall diameter, b, of the spring 120*a* is relatively smaller than prior springs because the spring 120*a* does not have to accommodate the relatively large necks of certain prior valve members. Certain prior mud pump valve springs reached a known resonant frequency (e.g. about 40 Hz to 43 Hz) creating poppet oscillations that resulted in an improperly seated poppet and in fluid pulsations transmitted downstream of a valve assembly. Due to its size and weight, the spring 120*a* has a higher natural frequency than those prior springs which resonate around 40 Hz and, thus, more force is required to resonate the spring 120*a*. In certain aspects the spring 120 (or 120*a*; or the spring 120*b*, FIG. 7A) is sized and configured so its natural resonant frequency is about 25% higher than that of certain known springs (e.g., in one aspect 50 Hz vs 43 Hz). This reduces the chance of flow-induced resonance in the valve assembly with such a spring; provides better, more stable control of the valve assembly's poppet; and provides more positive seating of the poppet against the valve seat.

Figure 7A:
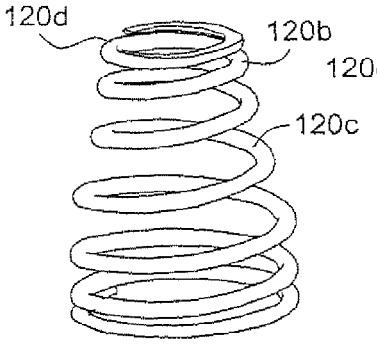
FIG. 7A is a perspective view of a spring according to the present invention.
Figure 7B:
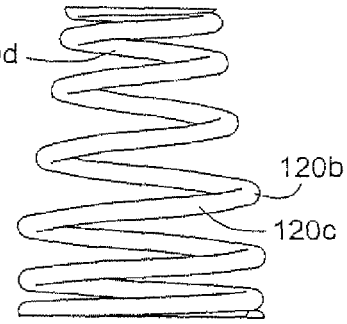
FIG. 7B is another perspective view of the spring of FIG. 7A.

FIGS. 7A and 7B show a spring 120*b* according to the present invention which has a spring body 120*c* and an end tapered portion 120*d* which abuts a support (e.g. like the support 116, FIG. 3A). The tapered portion 120*d*, since it is narrower than a base 120*e* of the spring 120*b*, contributes to the freedom of movement of the poppet 114 (e.g. as in FIG. 8A).

Figure 8A:
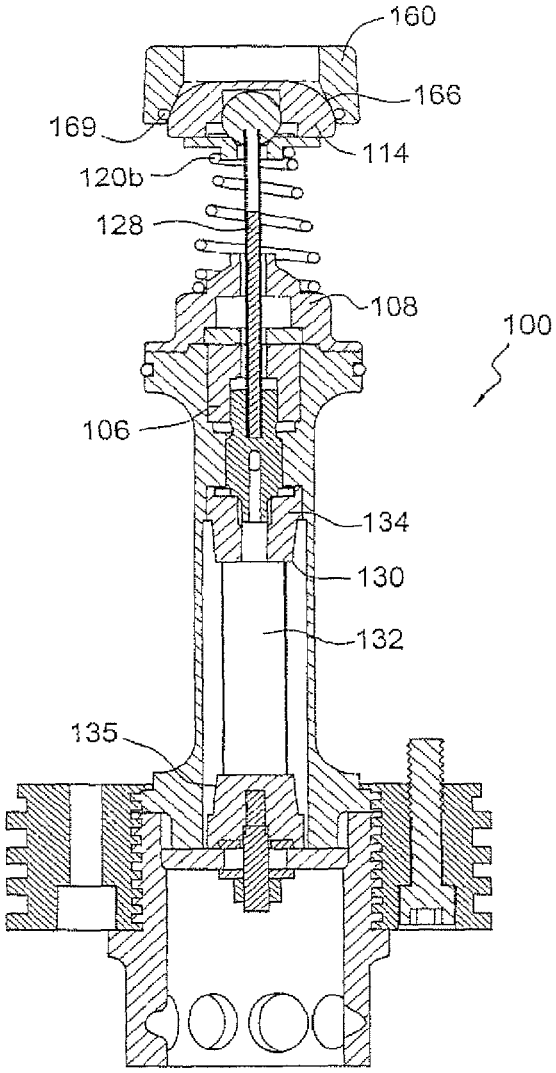
FIG. 8A is a side view, partially cutaway, showing a step in the operation of a valve according to the present invention of the system of FIG. 7A.
Figure 8B:
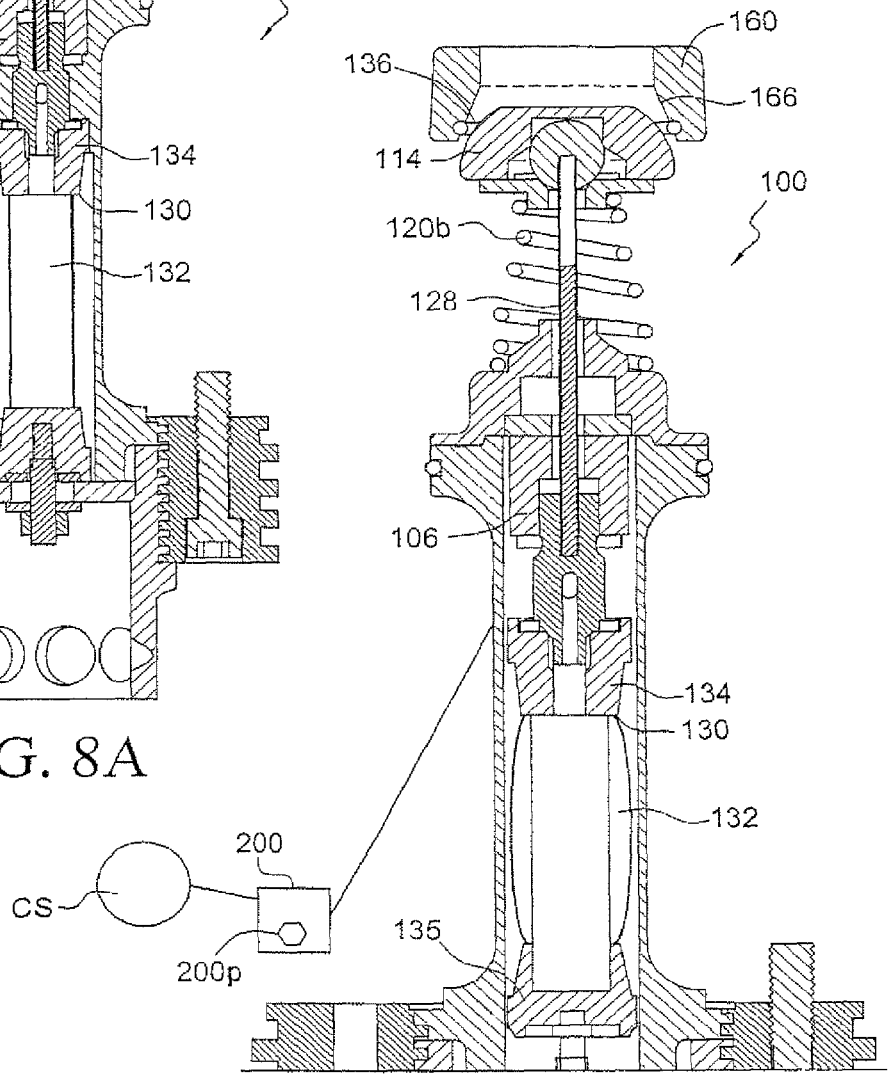
FIG. 8B is a side view, partially cutaway, showing a step in the operation of the valve of FIG. 8A showing a step following the step of FIG. 8A.

FIGS. 8A and 8B illustrate steps in the operation of a valve assembly 100 (which has a spring 120*b*, although any suitable spring may be used). As shown in FIG. 8A, air under pressure has not yet been applied within the hose 132 and the and the spring 120*b* urges the poppet 114 into scaling contact with the seal 169 and with the valve seat 160. The valve assembly 100 is closed to fluid flow therethrough. Fluid pressure also forces the poppet against the valve seat. On the discharge side of the valve seat at the beginning of the pumping/compression part of a cycle, the spring 120*b* and the fluid within a discharge manifold pushes the poppet 114 against the seat. This continues until the pressure within the discharge manifold drops below the pressure within the pumping cylinder and/or until the actuator 130 is commanded to open. On the suction side, the fluid within the pumping cylinder pushes the poppet 114 against the seat 160 again during the compression part and until the actuator 130 is commended to open the valve. When the "muscle" of the actuator 130 is not expanded, there is residual air trapped between the commanding valve and the actuator 130. The pressure of this trapped air is close to the pressure that existed in this line at the moment of exhausting the air and closing off the valve's exhaust port. When the actuator is flexed, there is air at a pressure that is sufficient to open the valve, e.g. 110 psi. The actuator and air lines are filled in order to decrease the actuator's response time—the time to respond to a commanding pressure. If the actuator is completely empty or, with, e.g. air at atmospheric pressure, it will take slightly longer for the actuator to respond, because when such a high pressure is applied the cavity would have to be filled with air first, then compress the air just introduced to a high enough pressure to barely stretch the hose 132 and only after that will the hose 132 change its length or respond to a commanding pressure.

As shown in FIG. 8B, air under pressure from an air supply 200 (with a proportional control valve 200*p*) has been applied within the hose 132 causing it to expand and pulling the cable 128 away from the valve seat 160. In so doing, the poppet 114 is moved out of sealing contact with the seat 160 and the seal 169 of the valve seat 160 and the valve assembly is opened to fluid flow permitting fluid to flow into and out from a mud pump module housing the valve assembly.

It is advantageous that the poppet is part of the valve cartridge. During assembly, when the pump is assembled for the first time, it is much easier to have a preassembled valve cartridge and, without adjustments, to insert and bolt it in and have it immediately become functional. Moreover, in servicing the valve, it is much easier to extract the entire cartridge, versus bits, individual parts, and/or pieces. In certain current designs, a poppet/valve has a pseudo cartridge design in the sense that the valve has no restricting elements to keep it attached to the cartridge. In other words, the cartridge can be loosely put together prior to assembly and it can be inserted as a cartridge being secured to the body by bolts. However, if during this assembly process, or later on during servicing the valve, this cartridge is turned upside down, the valve itself can become loose and fall to the ground.

Often in such prior systems there is no element like a snap ring to secure the valve to the cartridge. It is also advantageous that the seal is part of the valve housing. It is easier to have the seat part of a block that can be preassembled to the pump and, later on, during a later step in manufacturing, to bolt on to it a subassembly like the valve cartridge.

In designs according to the present invention, seals, e.g. the seal 169, do not resonate. According to the present invention, such seals are surrounded by a support and have no extraneous or "banging" features which could be excited by a surrounding flow stream.

In certain aspects according to the present invention, poppets and seats are made of ceramics which do not rust. In certain particular aspects, an alumina based ceramic offers very high strength and good wear resistance. In other aspects, a boron carbide ceramic can be used which has excellent erosion wear resistance. Both of these two ceramics have a higher erosion resistance then steel. In certain aspects the poppets of assemblies according to the present invention are made with a steel core surrounded by a ceramic. The steel core supports the Belleville washers and can have cut threads into it. A ceramic outer skin provides erosion resistance. In certain aspects, the special profiles facilitate the flow opening and closing the valve gradually.

In certain current designs, valves have two parallel surfaces. Often these surfaces form a seal that is part of conical bodies; i.e. the seal has a conical machined surface against which is pushed a poppet. The poppet's sealing surface is also conical so that, at every instance, the seat's and poppet's sealing surfaces are parallel. During discharge, when the two bodies are separating and, thus, allowing the fluid to flow from the pumping chamber into the discharge manifold, the fluid is squeezed in between these flat surfaces. During this phase the fluid's velocity can be greatly increased as it passes from a large cross section of the pumping chamber into a small one with parallel surfaces of the valve's passage way. Moreover, because there is no controlling actuator, such a valve can open suddenly when the fluid's pressure exerts onto the valve's face a force slightly higher than that developed by the spring acting on the opposite face. As the fluid leaves at high velocity, it enters into a larger cross section that is the discharge manifold The high velocity and energy fluid acts almost like a piston in this case and pushes an adjacent block of fluid along the discharge line. This sudden move of a significant block of fluid can create a "bang" or a specifically loud noise almost like a pounding. This repeated banging/pounding can have detrimental effects on the drill line or other equipment.

In certain valve assemblies according to the present invention, the flat parallel surfaces are replaced by curved ones. Additionally, there is a controlling actuator that can open the valve before pressure in the pumping chamber reaches a value high enough to counteract the spring and, thus, to open the vale. Pressure at which the fluid leaves the pumping chamber is greatly reduced. Being formed in between two curved surfaces, the valve's passage way flow characteristics do not impart a high velocity/energy to the fluid stream. Consequently, the fluid enters and leaves the discharge manifold and line respectively in a more dispersed manner. There is no "bang" as in certain previous valves because the fluid does not flow in discrete "blocks".

The control system CS controls the air supply 200 and, thus, controls the valve assembly 100. This is in contrast to prior valves in which fluid flow opens and closes the valve. In one aspect, the control system controls the speed with which the parts move and thereby controls the speed of opening and of closing off the valve. Using appropriate software programming of programmable media in the control system, the control system controls an electro proportional valve control (e.g. the valve 200*p*, FIG. 8B) that, in turn, controls the amount of air that enters or leaves the actuator 132. Consequently, the control system controls how fast, how long and how much the valve is opened. Gradual opening and closing is possible which reduces pressure pulsations. Each pump shaft (crankshaft) may have a speed sensor in communication with the control system (e.g. a sensor 521*s*, FIG. 1). In systems with electric motors that drive the crankshaft(s), the motors are commanded through software in the control system and the same speed control signal can be broadcast to the control system. A dedicated speed sensor or a linear displacement transducer installed in every cylinder provides information for a closed loop control system (usable, e.g., to diagnose a pump in case of failure). With valve assemblies according to the present invention, the valves are not connected to the crankshaft.

The control system has programmable media, e.g. in a computer, computers, and/or PLC(s). In one aspect, the control system is preloaded with a program that includes a defining equation and a curve fitter. The defining equation is a function of pump shaft speed. The curve fitter compares the curve generated by the defining equation with an "ideal" curve desired to drive the valve The ideal curve usually represents the valve's speed, or acceleration, or opening and/or, a different relevant parameter plotted versus time. The output from the control system drives a proportional valve, a valve that controls the actuator 130, e.g., in one aspect, supply air into a FESTO (TRADEMARK) "muscle". Thus, the valve being actuated closely follows the preprogrammed curve/equation and the valve opens or closes at a certain velocity or acceleration, or that it opens at a certain rate over the duration of a pumping cycle. The opening or closing rate can be constant or variable. That is, the valve can start opening at a certain low rate followed by a higher rate followed by a different rate, and so on.

In one aspect, during a cycle the valve tends to follow a certain bell-shaped curve. Thus, the valve starts opening at a low rate followed at the very next instance by a slightly higher rate and in the next instance by an even higher rate and so on. All this is followed on the descending side of the curve by a lower rate followed by a slightly lower rate and so on until the valve closes. By introducing or expelling fluid into or from the pumping chamber at certain times the pump's behavior is changed or the pump's flow is measurable.

The mechanical equivalent of controlling a valve's opening rate is a cam. The cam, through its profile, controls how fast and in what relationship relative to another element, e.g. a crankshaft, the valve will open or close. In other words, it controls the valve's rate (displacement versus time). However, a cam's profile can not be changed very easily because it is cut in metal. A practical method is to introduce a hydraulically actuated push rod or cam follower in between the cam and valve. Thus, the rate can change at will within a limited range. In the control strategy according to the present invention there is no piece of hardware/cam that limits the valve's rate. Consequently, in the proposed actuation and control strategy, the desired curve can be changed on the fly as long as the controller, e.g. a computer or PLC, can accept/support it. Programmability makes this equivalent to an infinitely variable profile cam shaft and the pump's output flow and vibration can be controlled. (An undesirable consequence of output flow in certain prior systems is component failure, e.g. due to cavitation.)

With the curved mating sealing surfaces of the valve seat and poppet, any contact results in an effective seal. Pressure fluctuations generated in or by prior art valves are reduced or eliminated and valve control reduces pressure fluctuation in the discharge line during pump operation.

Systems according to the present invention provide a fail safe mode. If a valve assembly according to the present invention that is inserted fails, then, for safety reasons, the pump continues working at either reduced or normal parameters until it is safe to stop it for service. In systems according to the present invention, if the actuator fails, e.g. if the muscle fails, it breaks or bursts, the valve will operate unrestricted (e.g. as a current known design valve). Thus, the pump can continue working at almost the same parameters until it is safe to stop it.

Figure 9A:
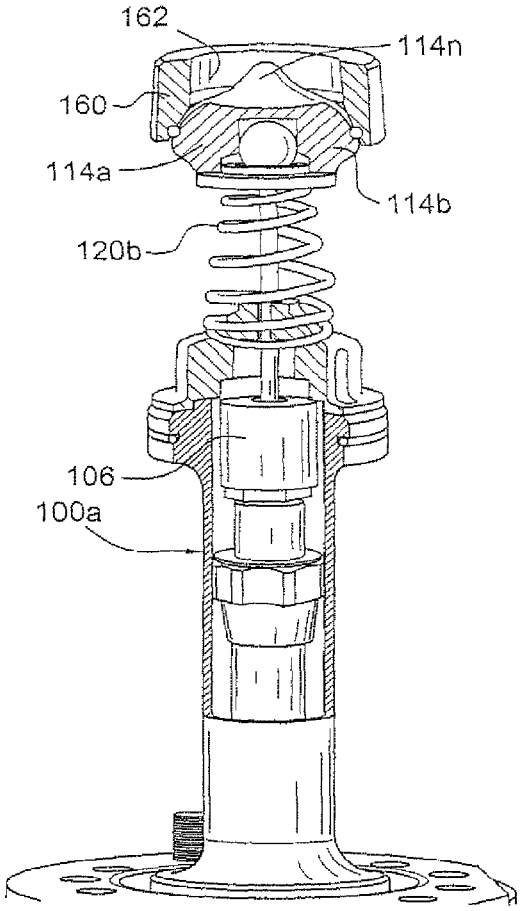
FIG. 9A is a side view, partially cutaway, of a system according to the present invention.
Figure 9B:
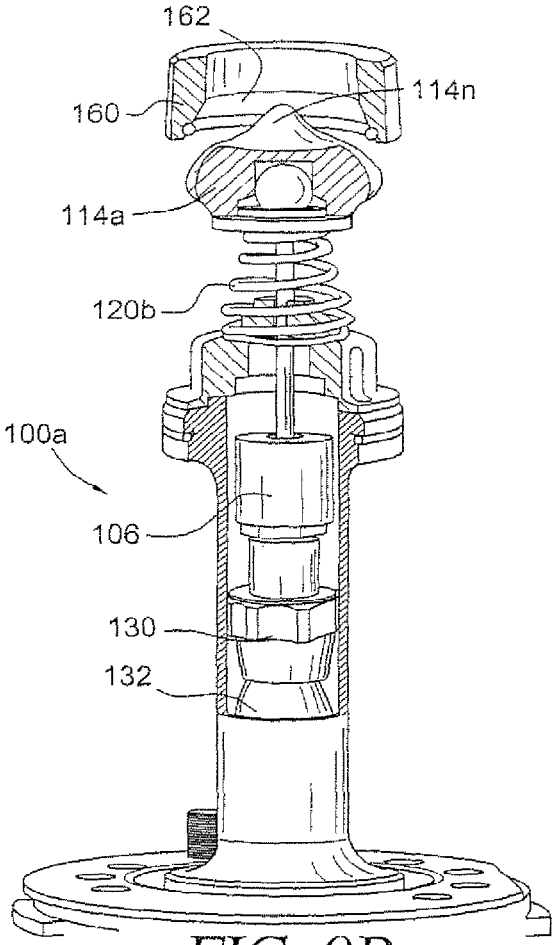
FIG. 9B is a side view, partially cutaway, of a system according to the present invention of FIG. 9A with an open valve.
Figure 9C:
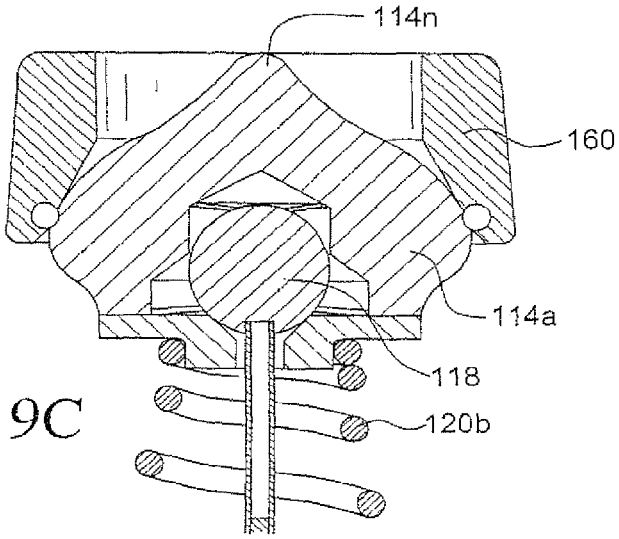
FIG. 9C is a side cross-section view of a poppet of the system of FIG. 9A.

FIGS. 9A and 9B show a valve assembly 100*a*, like the valve assembly 100 (like numerals indicate like parts) with a spring 120*b* and a poppet 114*a*. The poppet 114*a* has a nose 114*n* projecting from a poppet body 114*b*. The nose 114*n* projects into the flow channel 162 of the valve seat 160. In certain aspects, in systems according to the present invention the surface on the valve seat becomes, advantageously, more elastic. In a seal, two surfaces or edges are pushed against each other by a force. This acting force can be perpendicular to or at an arbitrary angle relative to the sealing surfaces. In systems according to the present invention the sealing bodies are the rubber seal and the poppet in one instance and, the seat itself and the poppet in a second instance. During a valve closing cycle, the first seal occurs in between a rubber O-ring and poppet. The acting force is axial relative to the poppet, but it is at an angle relative to the edge of contact between the two curved surfaces of the O-ring and poppet respectively. When the two bodies come into contact, at the point of contact, the vector components of this acting force are a normal to curved surfaces component and a tangential to curve components. This tangential component will stretch the rubber (the over hanging part of it) instead of purely compressing it. With the rubber O-ring being surrounded/supported by the seat's rigid body, the rubber will take a very high force in compression as the normal-to-curved surfaces vector component. The rubber becomes difficult to compress when it is surrounded by a rigid wall. Thus a mechanical maze is formed and, thus, the fluid encounters a high flow resistance. There is a sequence of high pressure (inside the pumping chamber), followed by a no flow area (where the rubber O-ring contacts the poppet), followed by a low pressure area (right after the rubber seal) and finally, followed by a no flow area at a contact between the poppet and the seat. Also, the shape of the deformed rubber O-ring at the leading edge toward the impinging fluid does not allow the fluid to enter in between the poppet and seal.

Valve "shivering" occurs when a valve is not actuated (pushed or pulled onto its seat) with a high enough force, and flow induced forces fully or partially unseat or seat the valve in a rapid sequence. Thus, the valve can not fulfill its primary function of separating two cavities. In systems according to the present invention, the actuator working against a spring reduces or eliminates valve "shivering" because two main forces are acting upon the valve's poppet—the force generated by a compressed spring and, in opposite direction, the force developed by the FESTO (TRADEMARK) "muscle" or an equivalent actuator 132. Secondary forces that are pulling and pushing the poppet are those flow induced because of the high mainly axial forces generated by the two components, spring and actuator, any minute force variation induced by flow is counteracted by either one of the two large forces. The spring will oppose the motion if a minute variation will try pushing the poppet or to unseat it. Conversely, the actuator will oppose any pulling or seating of the poppet; and thus the poppet has a very stable attitude in flow.

FIG. 9B shows the actuator 130 activated; air applied to the hose 132 has expanded the hose 132 making it contract down, thereby, unseating the poppet 114*a* from the valve seat 160.

Figure 9D:
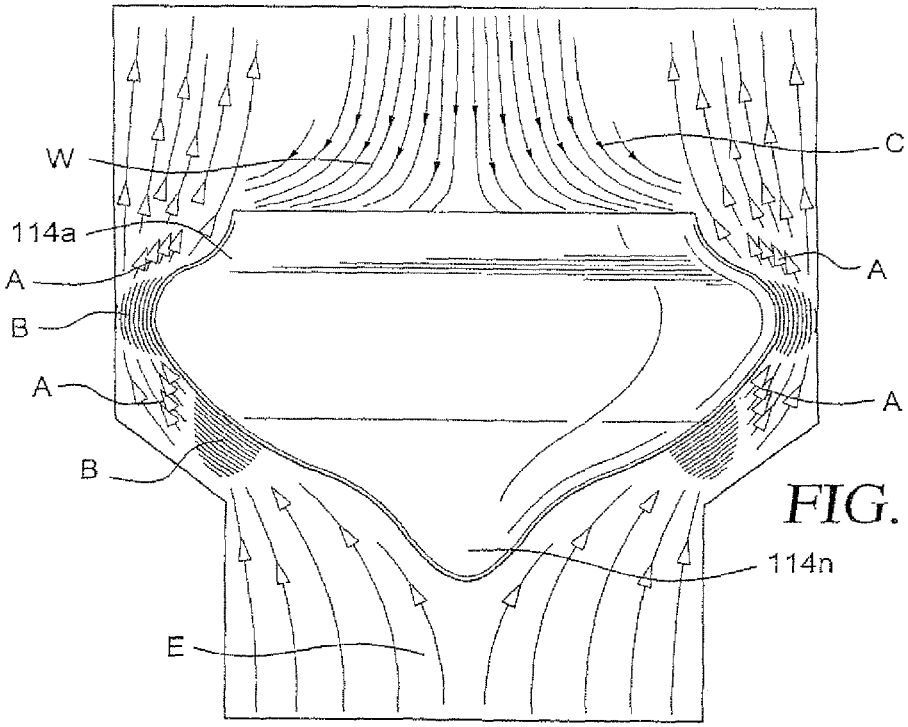
FIG. 9D is a side cross-section view of a poppet in a system according to the present invention.

A valve assembly according to the present invention with a poppet like the poppet 114*a* provides uniform and stable poppet positioning and movement. FIG. 9D illustrates a velocity profile of incoming fluid E flowing around a poppet 114*a*. Two rings A of high velocity fluid flow surround the poppet 114*a*. The rings A are continuously and uniformly distributed all around the poppet 114*a*, creating elastic cushions B that surround and stabilize the poppet 114*a*, e.g. in the event of a disturbing force acting in a direction other than in an axial direction. A reverse fluid flow C (part of the flow E which has changed direction) acting on a back side of the poppet 114*a* tends to push the poppet 114*a* into the closed position shown against the incoming flow E and against the two elastic cushions B. The uniformity and distribution of the flow C also facilitate the maintenance of the poppet 114*a* in a stable attitude.

Figure 9E:
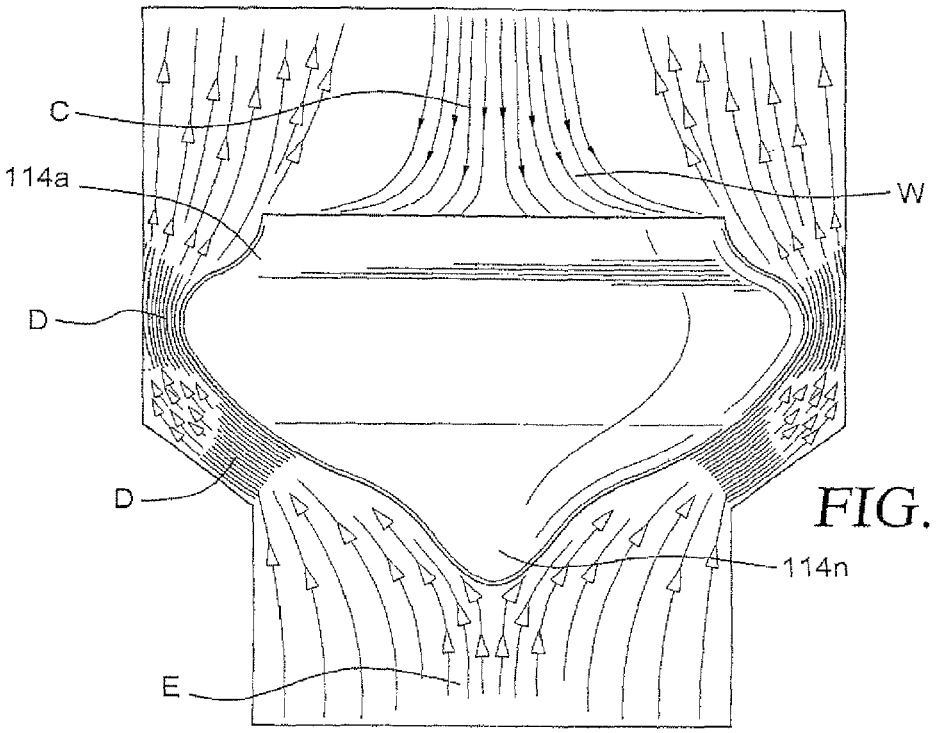
FIG. 9E is a side cross-section view of a poppet in a system according to the present invention.
Figure 10A:
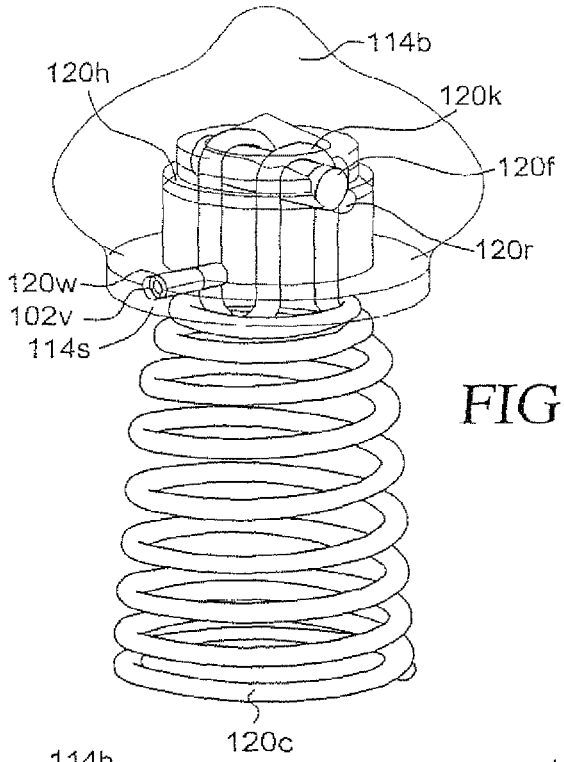
FIG. 10A is a side view of a poppet and spring for systems according to the present invention.
Figure 10B:
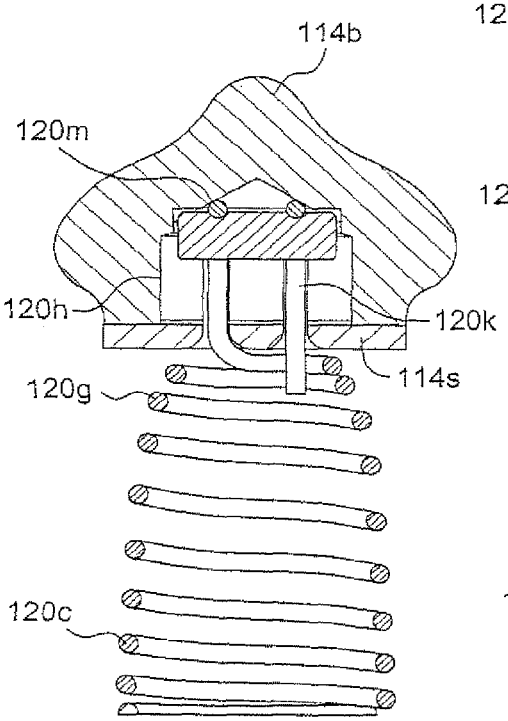
FIG. 10B is a cross-section view of the poppet and spring of FIG. 10A.
Figure 10C:
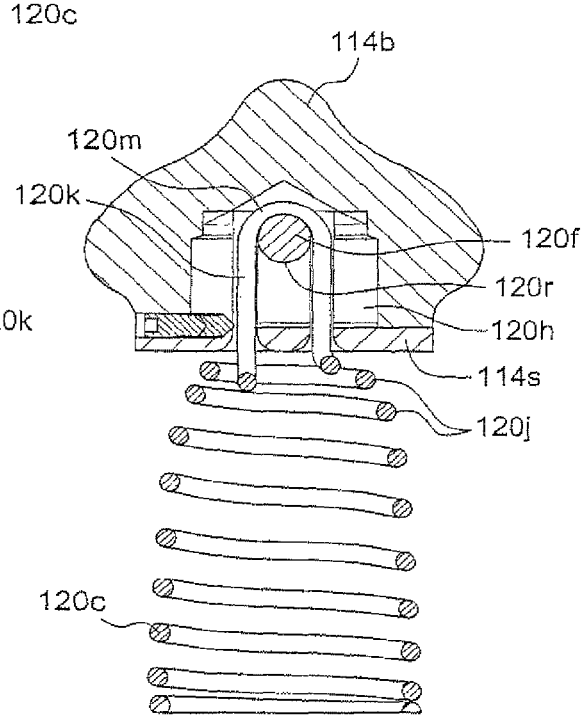
FIG. 10C is a cross-section view of the poppet and spring of FIG. 10A.
Figure 11A:
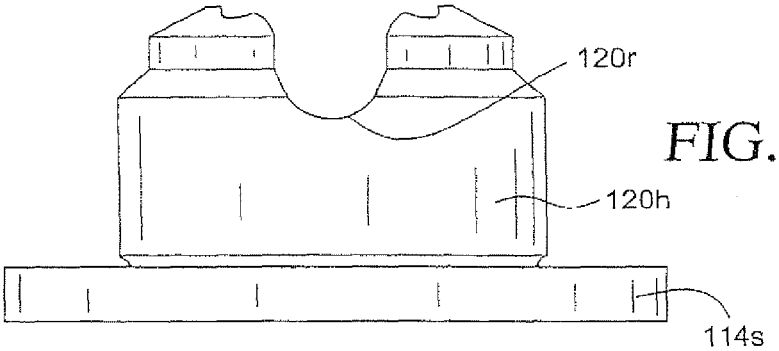
FIG. 11A is a side view of a support of the poppet of FIG. 10A.
Figure 11B:
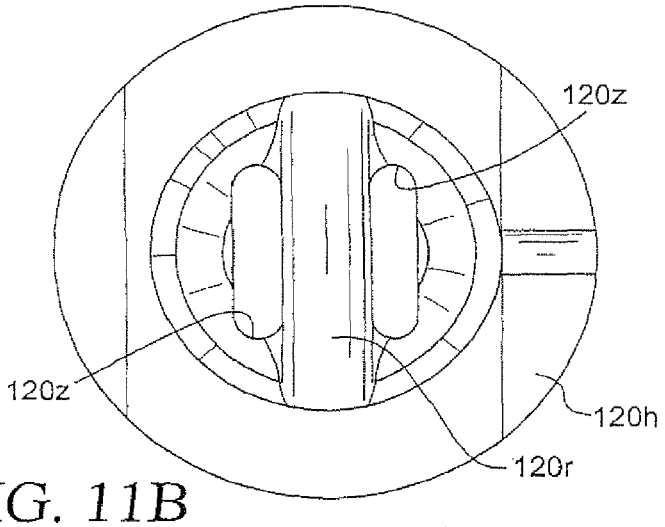
FIG. 11B is a top view of the support of FIG. 12A.
Figure 11C:
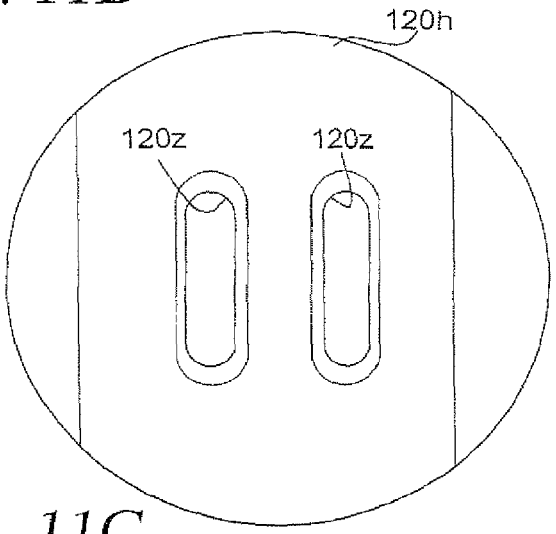
FIG. 11C is a bottom view of the support of FIG. 12A.

FIG. 9E illustrates pressure distribution of an incoming flow E around the poppet 114*a*. High pressure elastic fluid cushions D that surround and stabilize the poppet 114*a*. The incoming flow E has a smooth transition around the nose 114*m* of the poppet 114*a* and the ensuing flow sticks (binds to or tends to flow along adjacent a curved surface) to the curved poppet surfaces. A reverse flow C will not suffer a sudden change in direction, but a gradual one (e.g. as illustrated by the curved arrows W of the flow C at the back of the poppet). In certain prior valves such a flow hits a poppet's back surface and flows at or near a ninety degree angle to the back of the poppet. Wobbling of the poppet 114*a* is reduced or eliminated and it will maintain a stable position with its vertical axis concentric with that of the tubular within which it is positioned.

In contrast, in certain prior art valve assemblies with typical plain rounded-head poppets, there are sudden ninety degree changes of fluid flow direction on both faces of the poppets. Sudden changes in the direction of fluid flow, as well as turbulence behind the poppet, can generate some flow-induced destabilizing forces. Also, with such typical plain rounded-head poppets with relatively large flat end surfaces, two areas of low pressure (vacuum or close to vacuum) are developed around sharp edges of the poppets. These areas are within and surrounded by high pressure. This pressure distribution can lead to cavitation and unstable attitude in flow. Also, discrete veins of flow can occur where these low pressure areas take place. Consequently, because of a non-uniform distribution around the body, the poppets will have a precession motion. This effect is amplified by the geometrical dimensions of the poppets. Non-uniform flow distribution results on the poppets back sides.

FIGS. 10A-10D illustrate a poppet 114*b* on a base 114*s* on a spring 120*c* (see also FIG. 13) according to the present invention. The spring 120*c* has an end 120*g* with projections 120*k*. Optionally, there are one or three projections 120*e* The projections 120*k* have curved portions 120*m* which enhance freedom of movement of the poppet 114*b* so it can be self-centering. It is within the scope of the present invention to at least one, one, two, or more projections 120*k*.

A pin 120*f* rests in a recess 120*r* of a support 120*h*. The pin 120*f* projects through openings in the projections 120*k* to secure the spring 120*c* to the support 120*h*. A cable (not shown) is wrapped around (or connected to) the pin 120*f* and extends down through the spring 120*c*. A hole 120*u* houses a set screw 120*w* to secure the base 114*s* to support 120*h*.

In certain particular aspects, two first coils 120*j* of the spring 120*c*, optionally of high elasticity material allow the poppet 114*b* to center itself on a seat. After seating of the poppet 114*b* against a seat, the coils 120*j* are completely compressed and in contact. The remaining coils of the spring 120*c* take the load and thus elastically support the poppet 114*b*.

Figure 12:
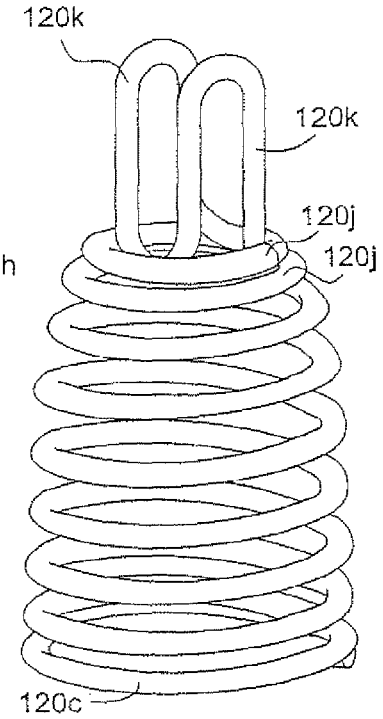
FIG. 12 is a perspective view of the spring of FIG. 10A.

The support 120*h* (see, e.g., FIGS. 12A-12C) has a base 120*m* with two holes 120*z* for the spring projections 120*k*.

The present invention, therefore, provides in at least some embodiments, a system for pumping a drilling fluid mixture, the drilling fluid mixture containing drilling fluid and solids, the system including: a pump apparatus; the pumping apparatus having a body with an inlet and an outlet; a suction valve in the body for selectively controlling flow of the drilling fluid mixture in through the inlet; a discharge valve in the body for selectively controlling flow of the drilling fluid mixture out through the outlet; each of the suction valve and the discharge valve having a seat with a curved valve seat surface and a valve member with a curved member surface, part of the valve member movable to seat the curved member surface against the curved valve seat surface to prevent the flow of the drilling fluid mixture past the valve seat. Such a system according to the present invention may have one or some (in any possible combination) of the following: a seal recess in the curved valve seat of each of the suction valve and the discharge valve, a seal positioned in each seal recess so that resonating of the seal is inhibited, each valve member movable to seat against a corresponding seal; wherein each valve member has a range of freedom of movement for effecting seating against an adjacent corresponding curved valve seat surface (and, in certain aspects, against a seal in the valve seat), the freedom of movement including the ability to move not just toward and away from the valve seat but at an angle thereto; wherein each valve member has a spring urging the valve member against the curved valve seat surface; wherein the spring has a spring body with a first end and a second end, the first end in contact with the valve member, the first end tapering from the spring body; each valve having a cartridge stem positioned with respect to the valve member, and a valve actuator within the cartridge stem for selectively moving the valve member; wherein the valve actuator is interconnected with the valve member via a cable; the valve actuator includes a selectively expandable hose for moving the valve member; an air supply for supplying air to the valve actuator, and a control system for controlling the air supply to selectively open and close the valve; a ball movably mounted within each valve member, the cable connected to the ball and to the valve actuator, the valve member movable with respect to the ball; each valve member has a rounded nose and a curved tapered outer surface so that fluid flow contacting the nose and curved tapered outer surface forms stabilizing fluid cushions around the valve member; each valve member has a back surface, a portion of the fluid flow onto the nose and curved outer surface gradually changes direction on the back surface; wherein the seat has a flow channel adjacent the curved valve seat and the valve member is movable to close off flow through the flow channel and wherein the flow channel is unobstructed; and/or wherein each valve member has a spring urging the valve member against the curved valve seat surface, each spring having a top end with at least one curved spring projection, a spring mount within the valve member, the at least one spring projection movably connected to the spring mount to facilitate freedom of movement of the valve member with respect to the curved valve seat surface and/or a dampener within the body for inhibiting pulsations of fluid pumped from the pump apparatus.

The present invention provides systems for pumping a drilling fluid mixture, the drilling fluid mixture containing drilling fluid and solids, the systems having: a pump apparatus, the pumping apparatus having a body with an inlet and an outlet, a suction valve in the body for selectively controlling flow of the drilling fluid mixture in through the inlet, a discharge valve in the body for selectively controlling flow of the drilling fluid mixture out through the outlet, each of the suction valve and the discharge valve having a seat with a curved valve seat surface and a valve member with a curved member surface, part of the valve member movable to seat the curved member surface against the curved valve seat surface to prevent the flow of the drilling fluid mixture past the valve seat, a seal recess in the curved valve seat surface of each of the suction valve and the discharge valve, a seal positioned in each seal recess so that resonating of the seal is inhibited, each valve member movable to seat against a corresponding seal, each valve having a cartridge stem positioned with respect to the valve member, and a valve actuator within the cartridge stem for selectively moving the valve member.

The present invention provides a method for pumping fluid, the method including: sucking fluid into an inlet of a pumping apparatus of a system, the system comprising a pump apparatus, the pumping apparatus having a body with an inlet and an outlet, a suction valve in the body for selectively controlling flow of the drilling fluid mixture in through the inlet, a discharge valve in the body for selectively controlling flow of the drilling fluid mixture out through the outlet, each of the suction valve and the discharge valve having a curved valve seat surface and a valve member with a curved member surface, part of the valve member movable to seat the curved member surface against the curved valve seat surface to prevent the flow of the drilling fluid mixture past the valve seat; and with the pump apparatus, pumping fluid into the inlet and then out the outlet. The present invention provides wherein such a system, in certain aspects, that has a seal recess in the curved valve seat of each of the suction valve and the discharge valve, a seal positioned in each seal recess so that resonating of the seal is inhibited, each valve member movable to seat against a corresponding seal, the method further including seating each valve member surface against a corresponding seal; and/or wherein each valve has a cartridge stem positioned with respect to the valve member, and each valve has a valve actuator within the cartridge stem for selectively moving the valve member, the method further including actuating each of the suction valve and the discharge valve with the valve actuator.

The present invention provides a method for pumping fluid, the method including: sucking fluid into an inlet of a pumping apparatus of a system, the system having a pump apparatus, the pumping apparatus having a body with an inlet and an outlet, a suction valve in the body for selectively controlling flow of the drilling fluid mixture in through the inlet, a discharge valve in the body for selectively controlling flow of the drilling fluid mixture out through the outlet, each of the suction valve and the discharge valve having a curved valve seat surface and a valve member with a curved member surface, part of the valve member movable to seat the curved member surface against the curved valve seat surface to prevent the flow of the drilling fluid mixture past the valve seat, wherein each valve member has a range of freedom of movement for effecting seating against an adjacent corresponding curved valve seat surface; with the pump apparatus, pumping fluid into the inlet and then out the outlet; controlling fluid flow in through the inlet with the suction valve; and controlling fluid flow out the outlet with the discharge valve.

The present invention provides a method for pumping fluid, the method including: sucking fluid into an inlet of a pumping apparatus of a system, the system including a pump apparatus, the pumping apparatus having a body with an inlet and an outlet, a suction valve in the body for selectively controlling flow of the drilling fluid mixture in through the inlet, a discharge valve in the body for selectively controlling flow of the drilling fluid mixture out through the outlet, each of the suction valve and the discharge valve having a curved valve seat surface and a valve member with a curved member surface, part of the valve member movable to seat the curved member surface against the curved valve seat surface to prevent the flow of the drilling fluid mixture past the valve seat, each valve having a cartridge stem positioned with respect to the valve member, and a valve actuator within the cartridge stem for selectively moving the valve member; with the pump apparatus, pumping fluid into the inlet and then out the outlet; and with the valve actuator selectively operating the suction valve and the discharge valve.

The present invention provides a valve for a valve assembly for a pump apparatus of a system for pumping a drilling fluid mixture, the drilling fluid mixture containing drilling fluid and solids, the pumping apparatus having a body with an inlet and an outlet, the valve for disposition in one of the inlet and outlet for selectively controlling flow of the drilling fluid mixture, the valve including: a seat with a curved valve seat surface, a valve member with a curved member surface, part of the valve member movable to seat the curved member surface against the curved valve seat surface to prevent the flow of the drilling fluid mixture past the valve seat. Such a valve may have a seal recess in the curved valve seat surface, a seal positioned in the seal recess, the valve member movable to seat against the seal.

The present invention provides a valve for a system for pumping a drilling fluid mixture, the drilling fluid mixture containing drilling fluid and solids, the valve having: a seat with a valve seat surface, a valve member with a member surface, part of the valve member movable to seat the member surface against the valve seat surface to prevent the flow of the drilling fluid mixture past the valve seat, a cartridge stem positioned with respect to the valve member, and a valve actuator within the cartridge stem for selectively moving the valve member.

The present invention provides system for pumping a drilling fluid mixture, the drilling fluid mixture containing drilling fluid and solids, the system having: a pump apparatus, the pumping apparatus having a body with an inlet and an outlet, a suction valve in the body for selectively controlling flow of the drilling fluid mixture in through the inlet, a discharge valve in the body for selectively controlling flow of the drilling fluid mixture out through the outlet, and a dampener within the body for inhibiting pulsations of fluid pumped from the pump apparatus.

Figure 13A:
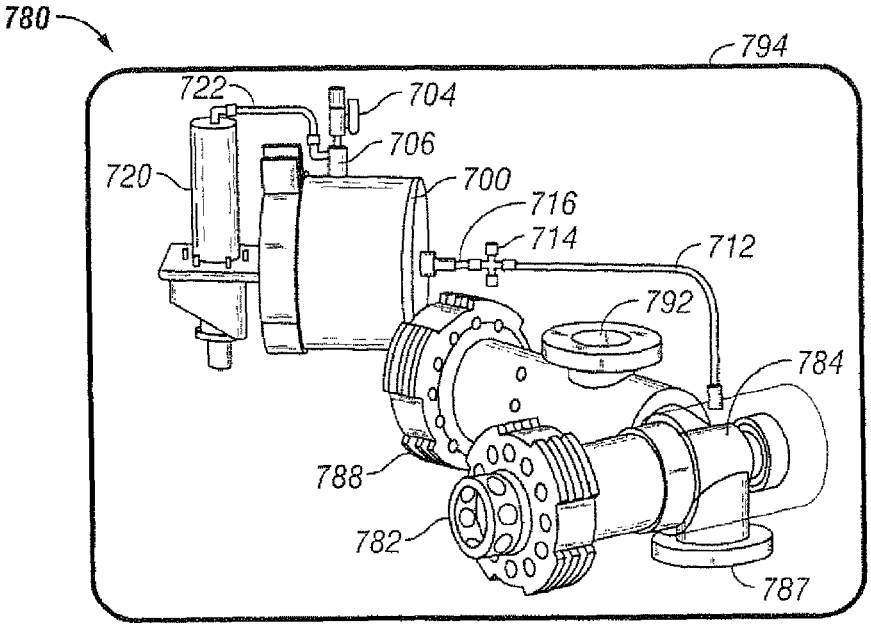
FIG. 13A is a perspective view of a mud pump module with a dampener system according to the present invention.
Figure 13B:
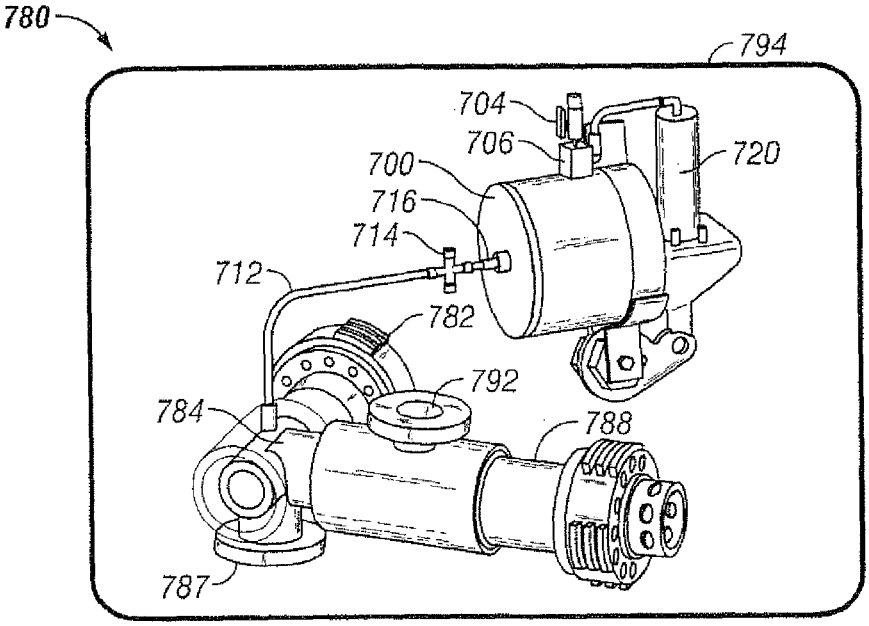
FIG. 13B is another perspective view of the module of FIG. 13A.
Figure 13C:
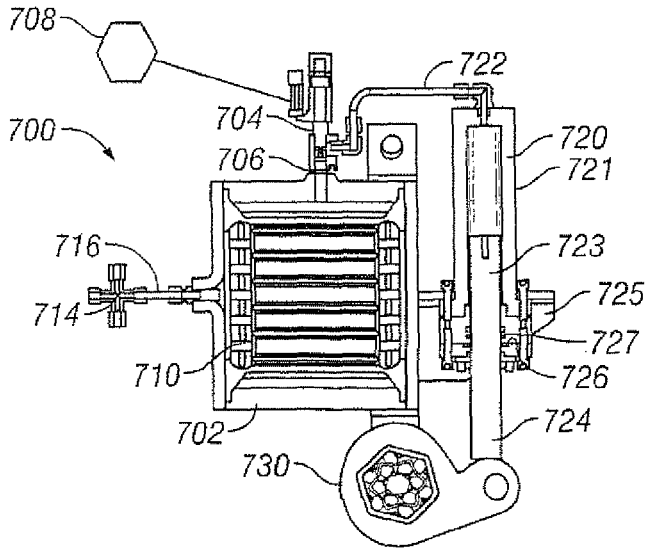
FIG. 13C is a cross-section view of the dampener of the module of FIG. 13A.
Figure 13D:
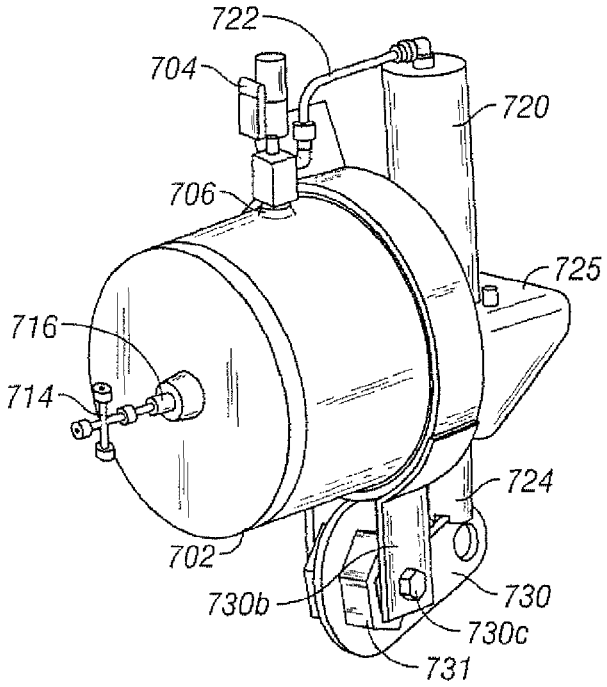
FIG. 13D is a perspective view of part of the dampener of FIG. 13C.
Figure 13E:
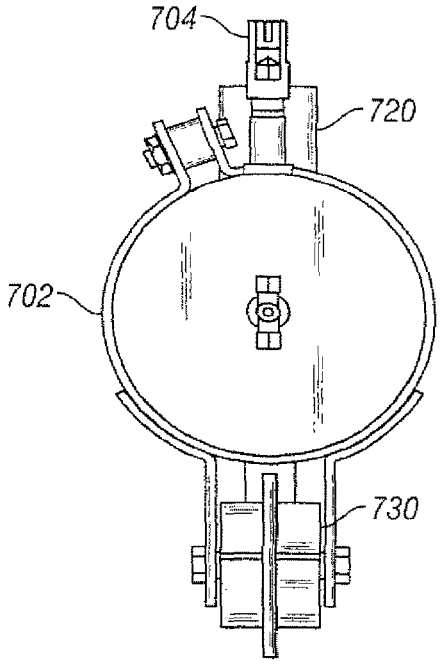
FIG. 13E is an end view of the part of FIG. 13D.
Figure 13F:
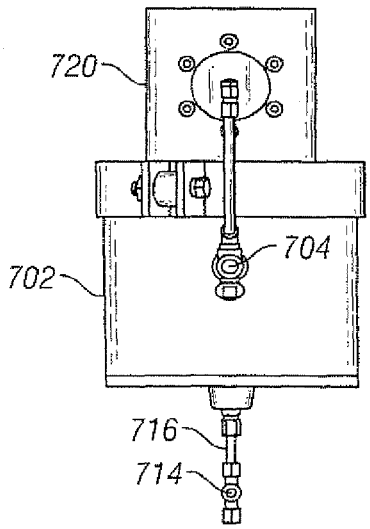
FIG. 13F is a top view of the part of FIG. 13D.
Figure 13G:
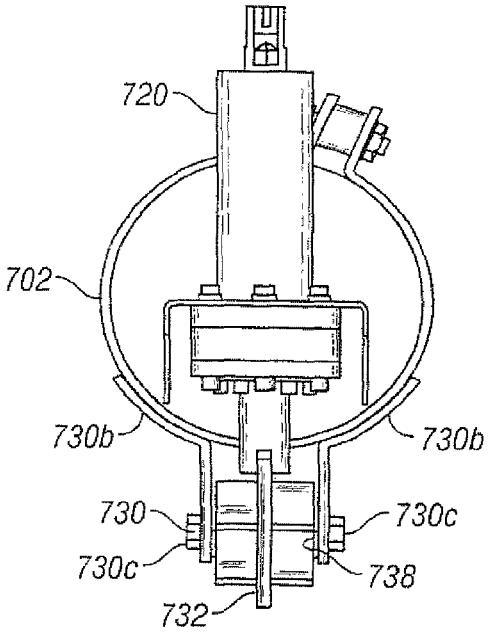
FIG. 13G is an end view of the part opposite the end of FIG. 13E.
Figure 13H:
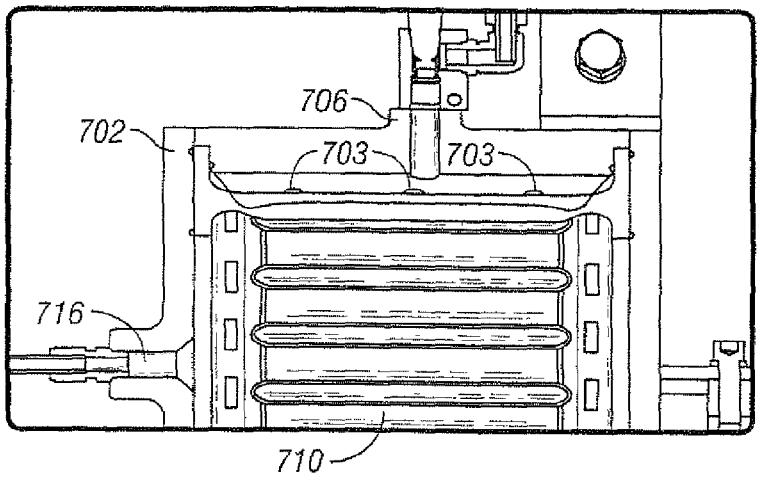
FIG. 13H is an enlarged cross-section view of part of the dampener of FIG. 13C.

FIGS. 13A, 13B, 13C show a mud pump module 780 according to the present invention with a suction valve assembly 782, a pumping chamber 784, a suction inlet 786, a discharge valve assembly 788 and a discharge outlet 792. A connection 787 connects the module 780 to a pumping cylinder. The valve assemblies are in a module block 794 shown schematically in FIGS. 13A and 13B as the outer boundary line around the valve assemblies and a dampener system 700.

Dampener systems inhibit or prevent ("dampen") undesirable fluid pulsations. Discharge valve assemblies, surrounding parts, downstream pipe lines, line supports, mud motors, pressure signals, and other parts can be subjected to damaging fluid pulsations. The pumping mechanism typically has a crank and one or more pistons and corresponding push rods. Regardless of the actual number of pistons, the mechanism's motion obeys the dynamics law of a single piston and crank mechanism in which the piston's velocity and acceleration have a sinusoidal variation over the length of a stroke. These two parameters will vary in opposite phase relative to each other, but they have a gradual variation over time. The fluid that enters or leaves the pumping chamber will try to follow these gradual variations. However, friction, inertia and turbulence or resistances to flow oppose to this gradual movement. As the operating speed or the rotating speed of the crank is increased, the opposing forces will increase too. As a critical speed is reached, the opposing/resisting forces are high enough to slow down the fluid so that it can not maintain contact with the piston's surface. Thus, a void is formed in the column of fluid. Cavitation or fluid boiling takes place if the pressure in the fluid column is not higher than the vapor pressure. The piston's velocity is zero at either end of the stroke with a maximum at midstroke. Acceleration on the other hand, is maximum at the ends with a minimum at piston's midstroke. Thus, during a stroke, the piston will accelerate and decelerate a block or volume of fluid. Simultaneously, inertia and fluid flow resistances will increase and decrease in a slight asynchronism with velocity. Thus, the fluid is still accelerating as the piston slows down past its midstroke. Consequently, the fluid continues rushing into the pumping cylinder because of inertia as the piston slows down past its midstroke. Suddenly, the column of fluid comes to an abrupt stop as it hits the piston and its movement slows down even further because it approaches its stroke end. This process results into a sudden pressure rise or spike. The rate at which the pressure spike rises or decreases is generated by factors like pipe sizing, number and shape of fittings along the pipe, the mud's nature, weight and temperature, as well as the valve's flow capacity and the friction between the fluid and surrounding walls and bodies.

The suction valve assembly 782 sucks fluid (drilling mud) through the suction inlet 786 into the pumping chamber 784. Upon discharging of this fluid from the pumping chamber 784 by the action of the discharge valve assembly 788, the discharge valve assembly and parts thereof can be subjected to damaging fluid pulsations. The dampener system 700 reduces or eliminates the damaging effects of these pulsations. In effect, a dampener system provides an expansion volume where fluid can rush in during a pressure spike, or an extra source of fluid in addition to the main source. This makes possible a more uniform volume flow through the block with mud surges suppressed or eliminated. The dampener system also stores energy that is returned into the system during a depression or negative pressure variation inside the valve block or downstream pipe string.

Figure 13I:
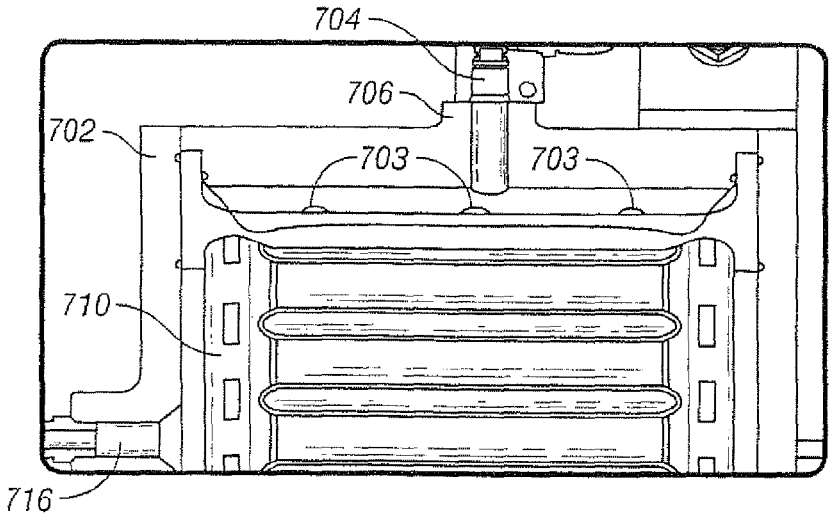
FIG. 13I is an enlarged cross-section view of part of the dampener of FIG. 13C.

FIG. 13C shows the dampener system 700 and FIGS. 13D-13M show various parts of the system 700. As described in detail below, as shown in FIG. 13C (and FIGS. 13D-13H) the dampener system 700 is under pressure; as shown in FIG. 13I the system is under no pressure; and as shown in FIGS. 13J-13M, the system is under partial pressure.

The dampener system 700 has a housing 702 (or "bottle") which houses a liner 710. A valve assembly 704 (proportional valve) is in fluid communication with the interior of the bottle 702 via a connection 706. In one aspect the valve assembly 704 is a proportional valve assembly selectively controllable by a control system 708 (exterior to the block 794). The valve assembly 704 selectively controls flow through a line 722 to a piston-cylinder apparatus 720 which includes a torsion apparatus 730.

The bottle 702 is in fluid communication with the pumping chamber 784 via a line 712, a connection 714, and a line 716.

Figure 13J:
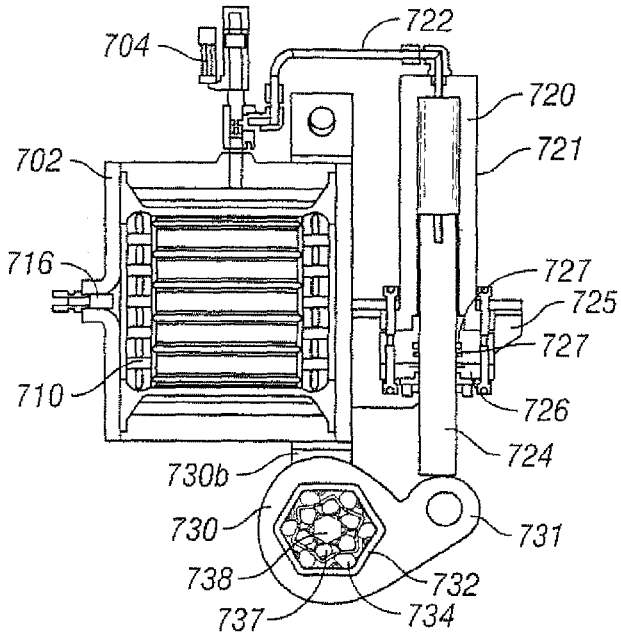
FIG. 13J is a cross-section view of the dampener of the module of FIG. 13A.
Figure 13K:
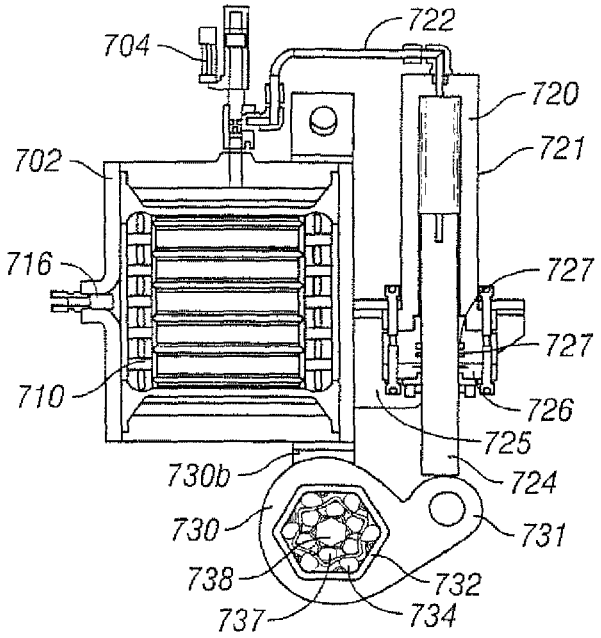
FIG. 13K is a cross-section view of the dampener of the module of FIG. 13A.
Figure 13L:
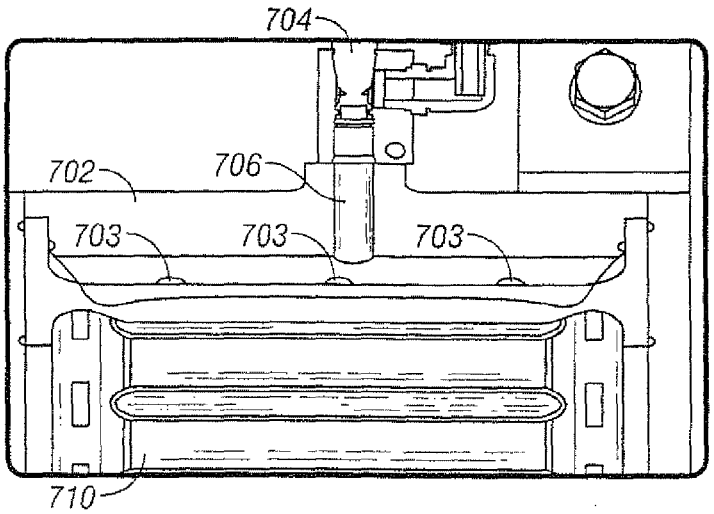
FIG. 13L is a cross-section view of part of the dampener as shown in FIG. 13K.

As shown, e.g., in FIGS. 13C, 13J and 13K, the piston-cylinder apparatus 720 has a housing 721 into which and from which fluid flows via the line 722 to move a piston 723. An end 724 of the piston 723 projects out from the housing 721 and is pivotably connected to the torsion apparatus 730. The housing 721 is connected to a support 725 and the piston 723 moves in a base 726 of the support 725. Seals 727 seal piston-base interfaces.

Figure 13M:
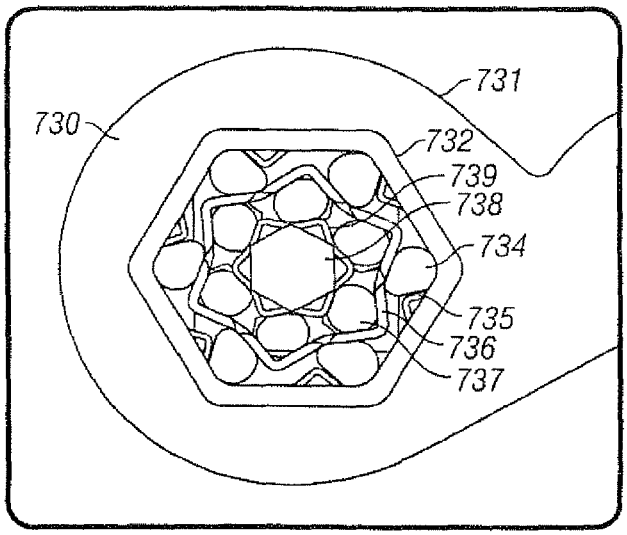
FIG. 13M is a cross-section view of part of the dampener as shown in FIG. 13J.

As shown, e.g., in FIG. 13M, the torsion apparatus 730 has an arm 731 rigidly connected to a metal ring 732. The metal ring 732 encloses outer rubber elements 734 (made, e.g. of rubber or any suitable flexible material); outer stops 735; inner metal stops 736; and inner rubber elements 737. A central shaft 738 with shaft stops 739 is fixed to a bracket 730*b*. When the piston 723 moves the body 731, the body 731 rotates on the shaft 738 and the various rubber elements deform against the various stops. The shaft 738 is secured to brackets 730*b* with nuts 730*c* and the brackets 730*b* are secured to the housing 702. As hydraulic fluid under pressure is expelled from the bottle 702, through the proportional valve 704 and the line 722 into the housing 720, it pushes down on the piston 723, and through an end 724 of the piston it acts on the arm 731. In turn, the arm 731 rotates the metal ring 732 about the axis of the fixed shaft 738. Since stops 735 are welded/rigidly attached to the metal ring 732, and as the metal ring 732 is rotating, the outer rubber elements 734 are compressed between the stops 735 and the inner metal stops 736. As a result, the inner metal stops 736 rotate in the same direction of rotation with the outer metal ring 732. Consequently, the inner rubber elements 737 are compressed between the ring of inner metal stops and the fixed shaft stops 739 that are welded/rigidly attached to the fixed shaft 738. The rubber elements 734 and 737 are compressed until, relative to the metal ring 732, they develop a moment equal with the one developed by the pressure acting on the end 724 that acts on the arm 731 respectively.

Figure 14A:
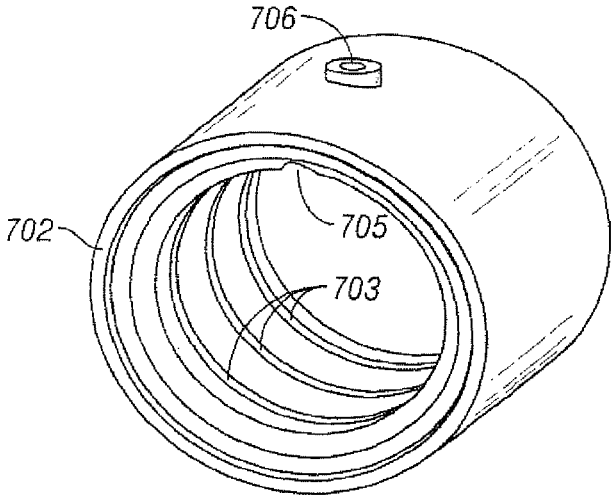
FIG. 14A is a perspective view of a housing or "bottle" of the dampener of FIG. 13C.
Figure 14B:
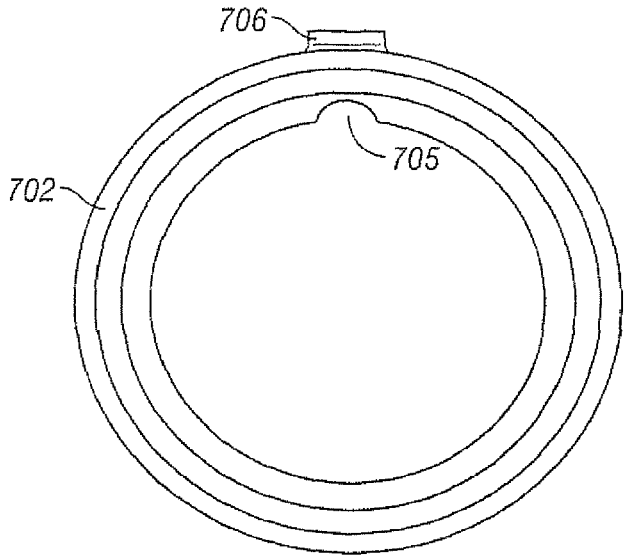
FIG. 14B is an end view of the bottle of FIG. 14A.
Figure 14C:
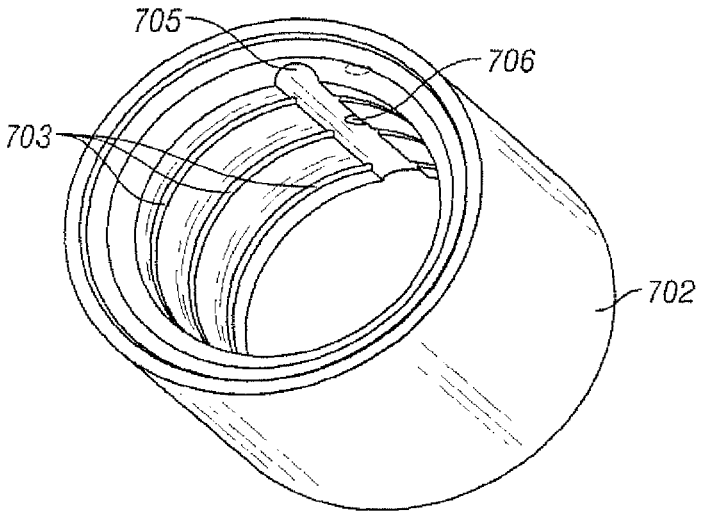
FIG. 14C is a perspective view of the bottle of FIG. 14A.
Figure 15A:
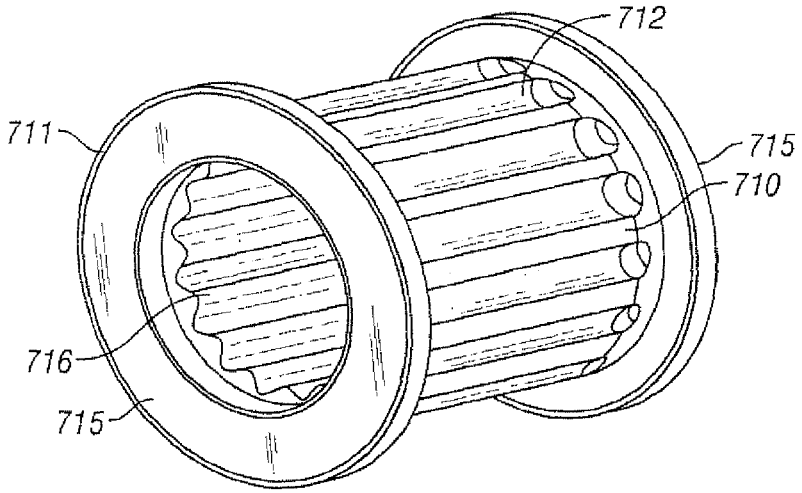
FIG. 15A is a perspective view of a liner of the dampener of FIG. 13C.
Figure 15B:
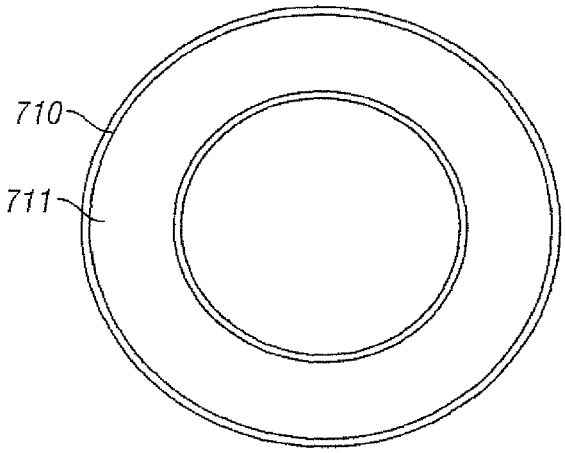
FIG. 15B is a front view of the liner of FIG. 15A.
Figure 15C:
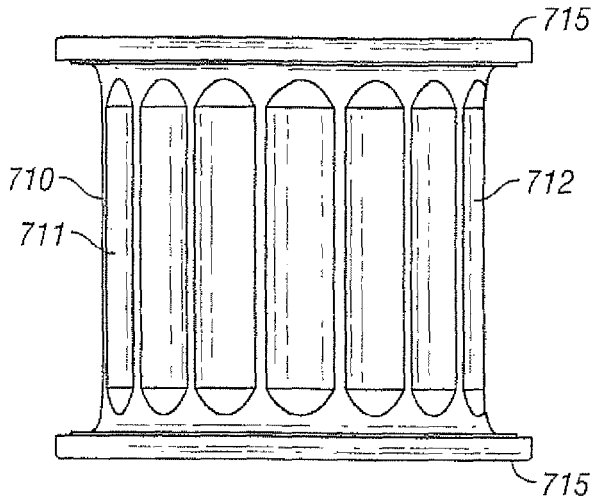
FIG. 15C is a side view of the liner of FIG. 15A.
Figure 15D:
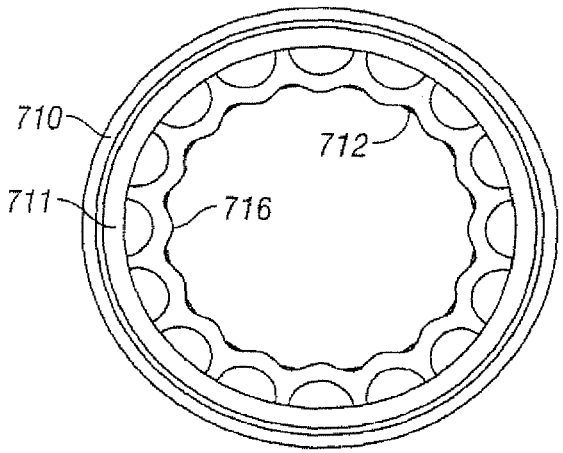
FIG. 15D is a cross-section view of the liner of FIG. 15A.
Figure 15E:
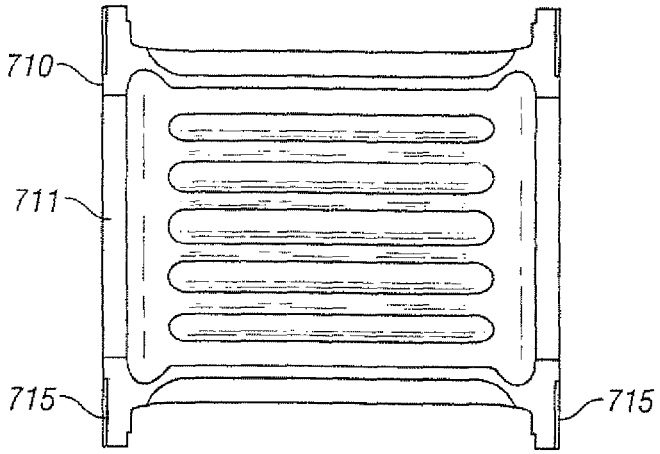
FIG. 15E is a cross-section view of the liner of FIG. 15A.

FIGS. 14A-14C show the bottle 702. Recesses 703 around the surface of the bottle 702 hold hydraulic fluid or oil which can flow via a recess 705 to and out from (and into) the connection 706. The circumferential recesses 703 enhance fluid flow from around the liner into the main connection 706 and finally into the housing 720. An expanded liner under pressure would block or restrict fluid flow if the interior surface would be smooth without these circumferential recesses. This would occur because under higher pressure the liner would expand until its ridges would come into full contact with the housing. Thus, the fluid between the liner's two adjacent lobes/recesses would not be expelled into the main recess 705 and further down into the proportional valve and finally into the housing 720. Consequently, the dampener's function would be negatively affected because it would not be able to expel the required amount of hydraulic fluid and at the required rate in order to accommodate the mud's instantaneous pressure variations. It is the hydraulic fluid or oil pushed from the bottle 702 that acts on the piston 723.

FIGS. 15A-15E show the liner 710 which has a body 711 with recesses 712. Outer flanges 715 are mounted in the housing 702 as shown, e.g., in FIG. 13C. The inner surface 716 of the liner 710 has, optionally, a lobed or corrugated shape which increases the elasticity of the liner 710 and, therefore, facilitates quick response to pressure pulsations and enhances the life of the liner 710 by limiting stretching of the liner 710.

FIGS. 16A-16D illustrate the dampener system 700 under pressure (i.e., subjected to the pressure of fluid in the pumping chamber 784). This pressure has expanded the liner 710, pushing fluid to the valve assembly 704, and through the valve assembly 704 to the piston-cylinder apparatus 720 moving the piston 723 which, in turn, has rotated the arm 731 of the torsion apparatus 730 on the shaft 738 deforming some of the rubber elements of the torsion apparatus 730.

Figure 16A:
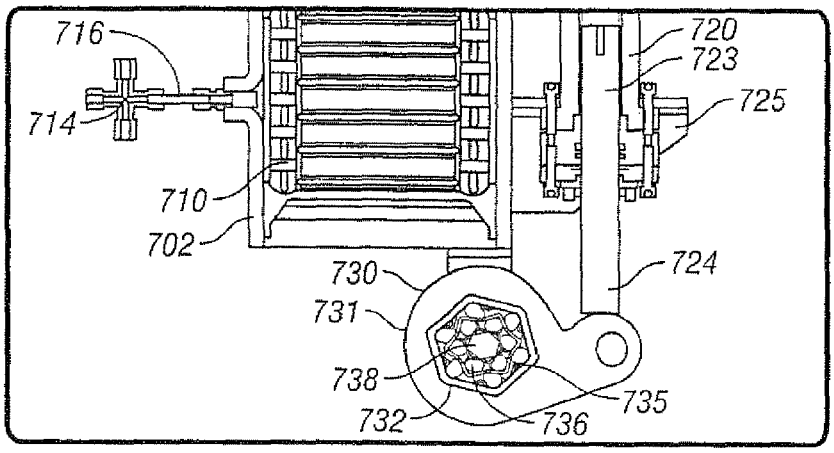
FIG. 16A is a cross-section view of part of the dampener of FIG. 13C.
Figure 16B:
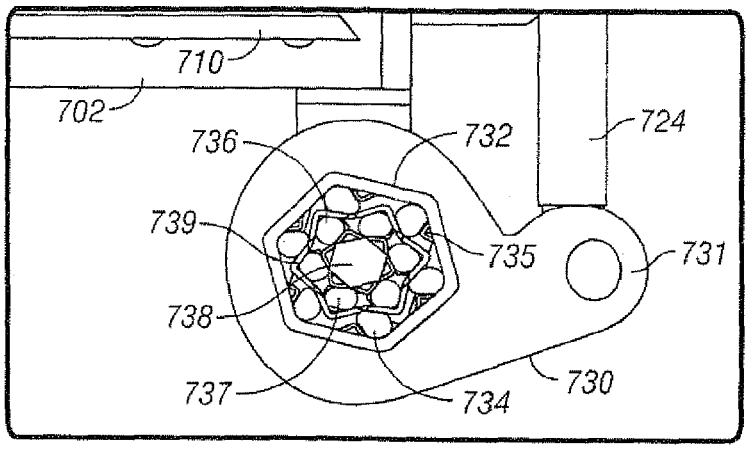
FIG. 16B is an enlargement of part of the dampener as shown in FIG. 16A.
Figure 16C:
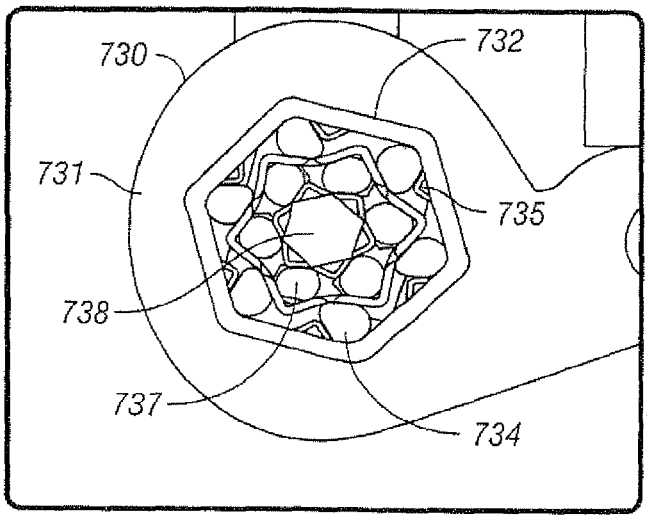
FIG. 16C is an enlargement of part of the dampener as shown in FIG. 16A.
Figure 16D:
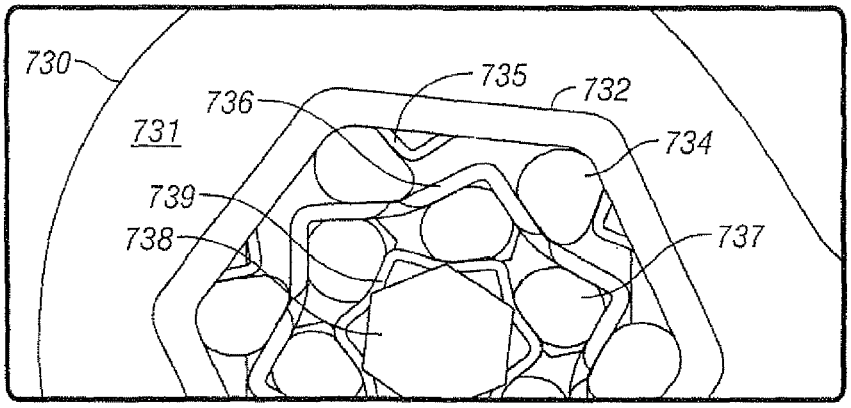
FIG. 16D is an enlargement of part of the dampener as shown in FIG. 16C.
Figure 16E:
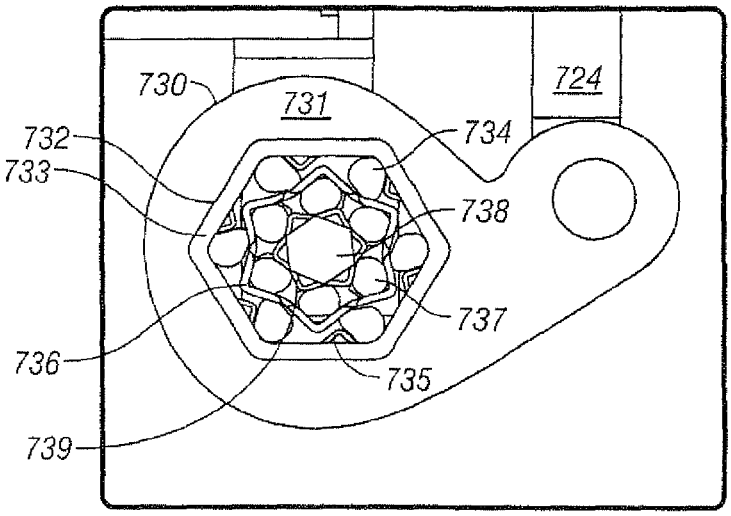
FIG. 16E is an enlargement of part of the dampener as shown in FIG. 16A.
Figure 16F:
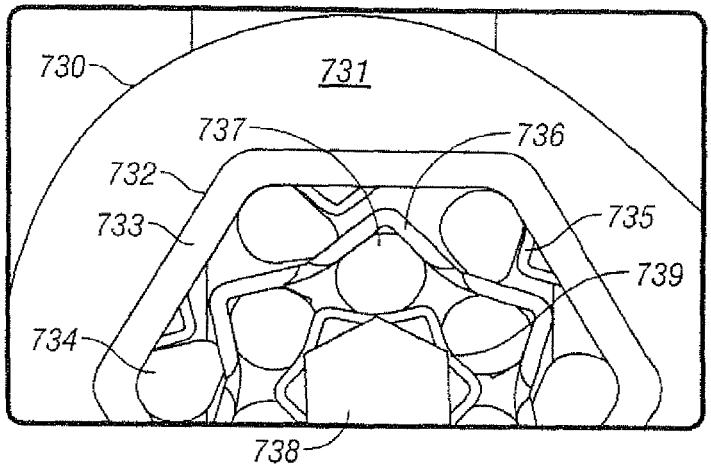
FIG. 16F is an enlargement of part of the dampener as shown in FIG. 16E.

FIGS. 16E and 16F show the dampener system 700 under no pressure, with the rubber elements of the torsion apparatus 730 in a non-deformed shape.

Figure 17A:
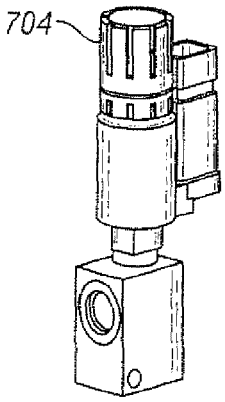
FIG. 17A is a perspective view of a valve assembly of the dampener of FIG. 13C.
Figure 17B:
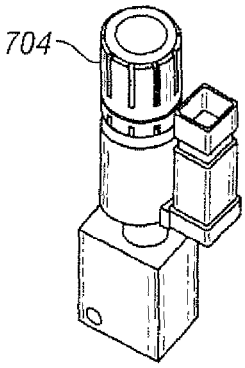
FIG. 17B is a perspective view of a valve assembly of the dampener of FIG. 13C.

FIGS. 17A and 17B illustrate one embodiment of the valve assembly 704 which is a commercially-available controllable proportional valve assembly, e.g., but not limited to, a commercially-available models from Sun Company.

Figure 18A:
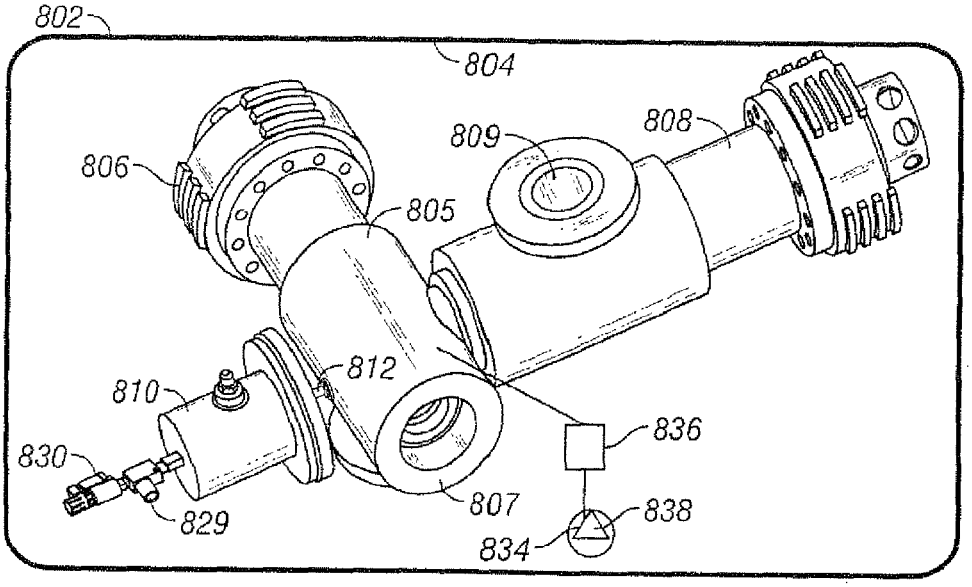
FIG. 18A is a perspective view of a mud pump module with a dampener according to the present invention.
Figure 18B:
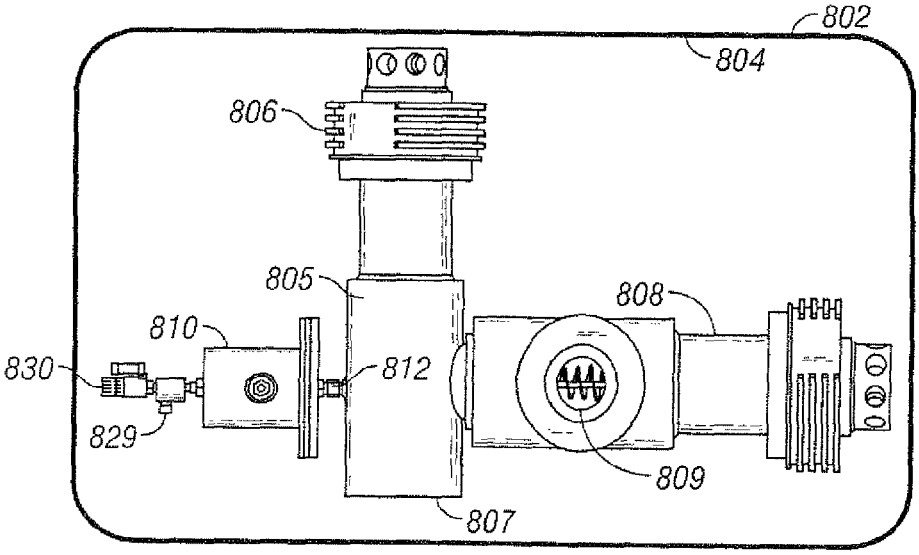
FIG. 18B is a top view of the module of FIG. 18A.
Figure 18C:
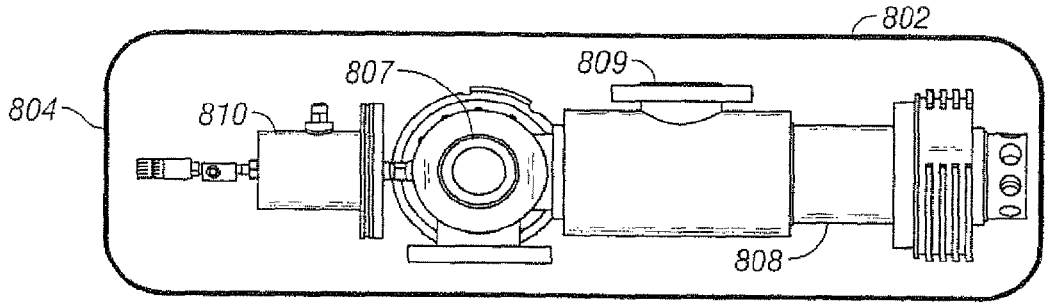
FIG. 18C is a side view of the module of FIG. 18A.
Figure 18D:
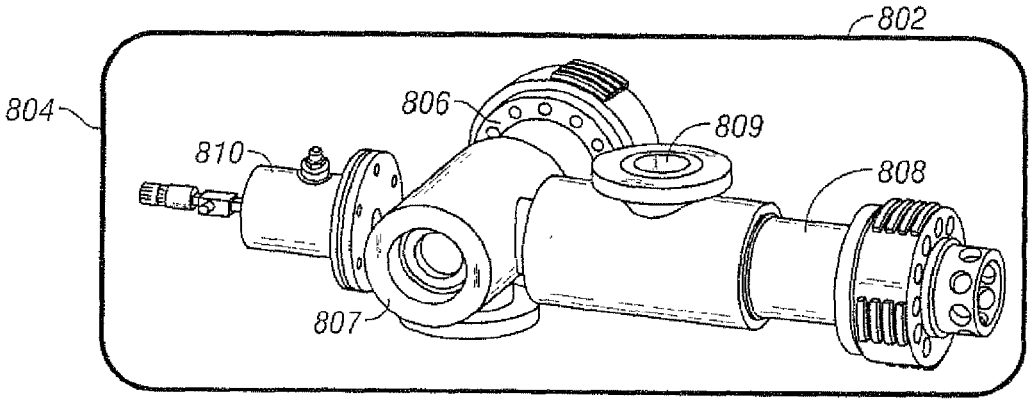
FIG. 18D is a perspective view of the module of FIG. 18A.
Figure 19A:
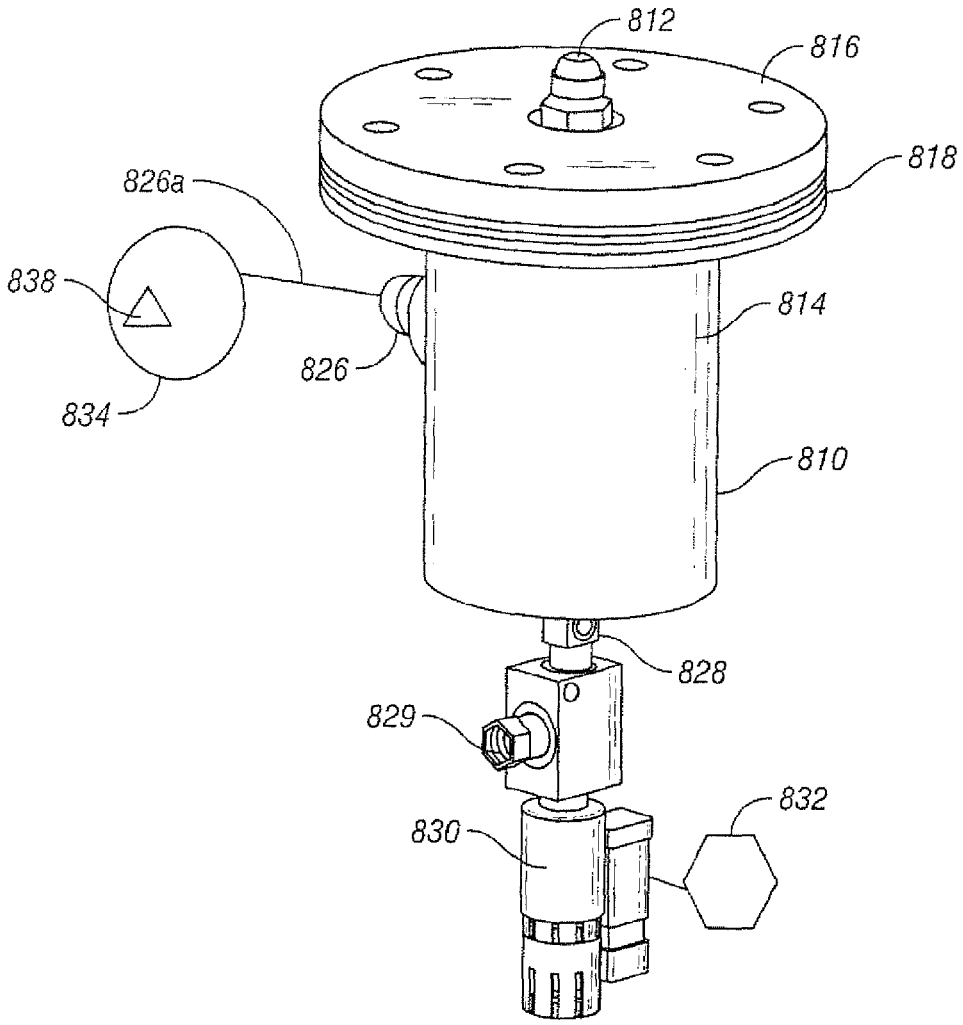
FIG. 19A is a perspective view of a dampener of the module of FIG. 18A.
Figure 19B:
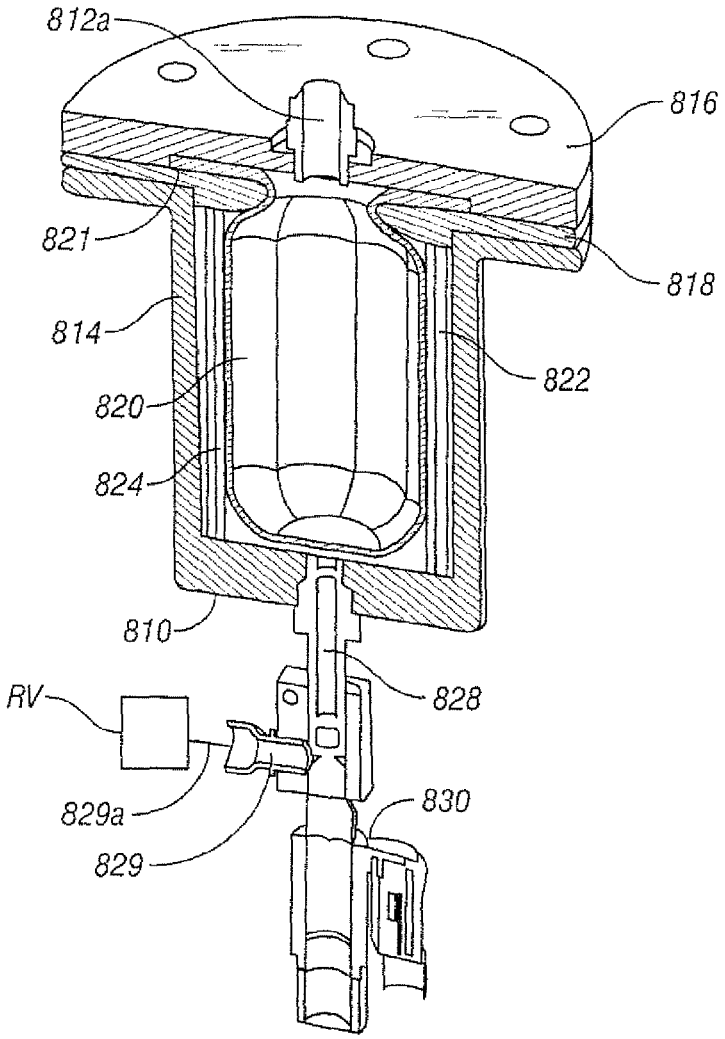
FIG. 19B is a cross-section view of the dampener of FIG. 19A.
Figure 19C:
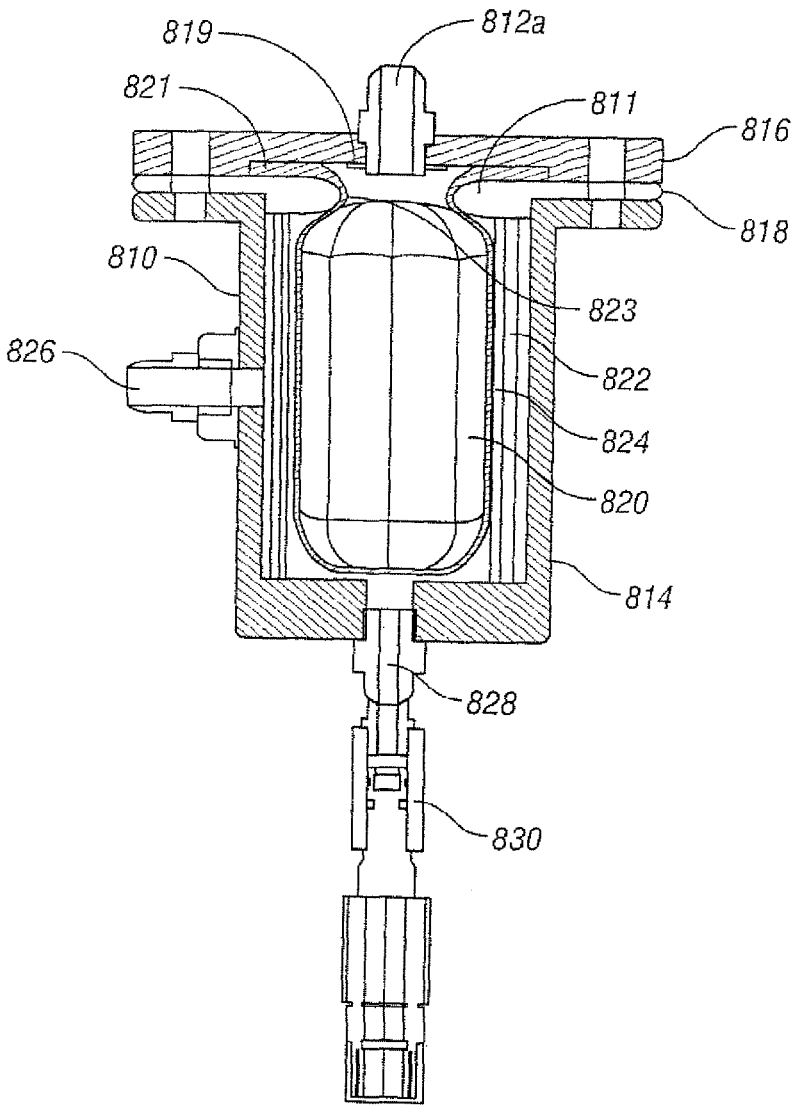
FIG. 19C is a cross-section view of the dampener of FIG. 19A.
Figure 19D:
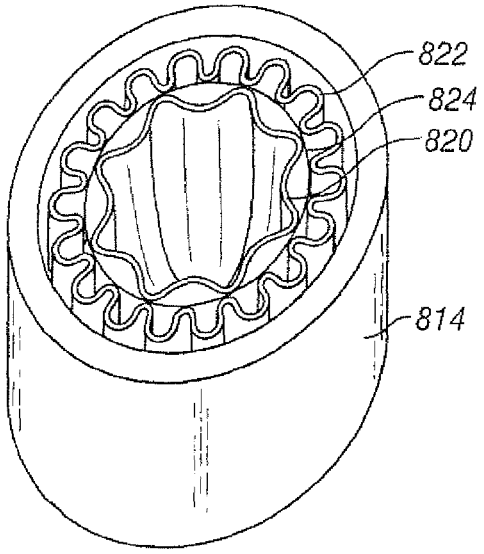
FIG. 19D is a cross-section view of the dampener of FIG. 19A.
Figure 19E:
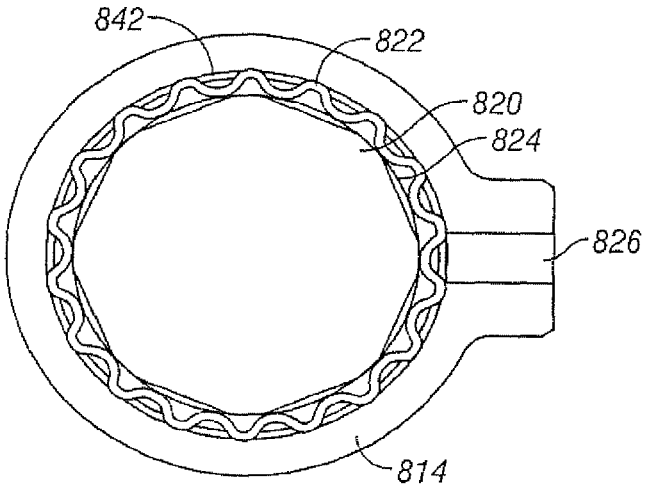
FIG. 19E is a cross-section view of the dampener of FIG. 19A.

FIGS. 18A-18B show a mud pump module 802 according to the present invention in a block 804 (shown schematically to include valve assemblies 806, 808; a pumping chamber 805; a suction inlet 807; a discharge outlet 809; and a dampener system 810 according to the present invention).

The dampener system 810 is shown in FIGS. 19A-19E. Via a line 812 a bladder 820 of the dampener system 810 is in fluid (drilling mud) communication with the pumping chamber 805. The system 810 has a housing 814 with a top cover 816; an intermediate cover 818; the bladder 820 a spring 822; a valve assembly 830; and a ring 824.

Via a line 826*a* and a check valve 826 the interior of the housing 814 is in fluid communication with an hydraulic fluid source 834 (see FIG. 19A) (shown schematically). Via a line 828, the interior of the housing 814 is in fluid communication with the valve assembly 830. Via a line 829*a* and a check valve 829, the valve assembly 830 is in fluid communication with a reservoir RV of hydraulic fluid under atmospheric pressure and the hydraulic power source draws fluid from the reservoir. The valve assembly 830 is, in certain aspects, like any embodiment of the valve assembly 704 (FIG. 13A) and can be controlled by a control system 832 (shown in FIG. 19A; like the control system 708, FIG. 13C).

The pressure of the mud in the bladder is the pressure of mud in the pumping chamber 805. This pressure is continuously measured using a pressure transducer 836 in the block 804. The pressure transducer 836 is in communication with a control module 838 (e.g. the control system 832, FIG. 19A). The drilling's mud pressure is continuously monitored through the pressure transducer 836 and this pressure [value expressed in e.g., in a scaled voltage (V volts) or milliamperes (ma) per psi or other appropriate unit of pressure measurement] is entered into the control module 838. The control module's output is a PWM (Pulse Width Modulated) signal that, in turn, controls the valve assembly 830. This PWM signal is inversely proportional to the mud's pressure. Thus, as the pressure increases, the control module 838 sends a lower signal. Conversely, as the pressure decreases, the control module 838 sends a higher signal. Additionally, the valve assembly 830 is normally closed, meaning that no fluid flows through it when it is not powered. In other words, the proportional valve partially opens when a lower signal (or current) is applied and it fully opens when a higher current (or signal) (PWM signal) is applied. Consequently, when a very high pressure is sensed inside the valve block 804, the control module 838 sends a low level PWM signal to the valve assembly 830 and the valve will not open at all or it opens only a minute amount. The amount that the valve will open at this stage depends on a pre-established threshold. By slightly releasing the pressure on the oil side, the rubber bladder 820 will be able to deform and, thus, accommodate an instantaneous pressure variation on the mud side. As the pressure on the mud side decreases, the control module 830 sends a high signal that opens the valve even further. However, when the pressure wave is on the reverse side and increases inside the valve block 804, the control module 838 sends a lower signal and the process continues. By controlling the threshold at which the valve opens/reacts, the operator can filter out certain frequencies (frequency of pulsation of fluid) providing, in effect, the equivalent of a continuously adjustable high band filter. As the threshold is increased, or the valve reacts at a higher and higher signal, the low end of the filtering band increases too. The frequencies that are below the pressure threshold (pressure that generates the minimum signal at which the valve reacts) will pass unobstructed through the valve block 804 and further down along the discharge line. The filtered frequency band is narrow in this case. However, as the pressure threshold is lowered, even lower pressures will force the control module 838 to send a signal at which the valve assembly 830 reacts. Consequently, lower and lower frequencies are attenuated and less damaging energy is propagated along the discharge line past the discharge outlet 809, and to the discharge valve assembly 808.

Figure 20A:
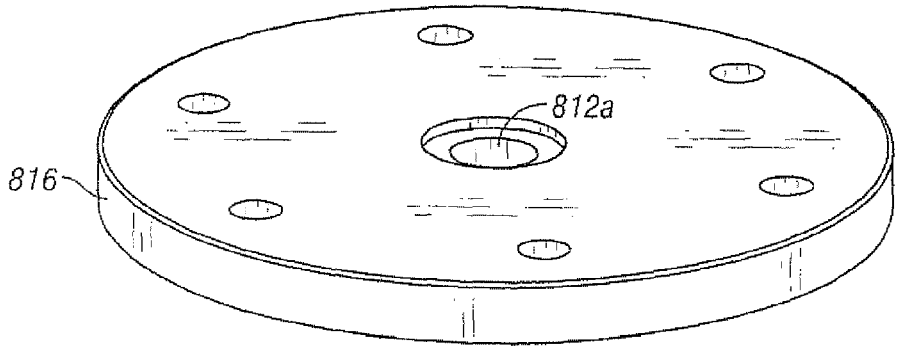
FIG. 20A is a perspective view of a top cover of the dampener of FIG. 19A.
Figure 20B:
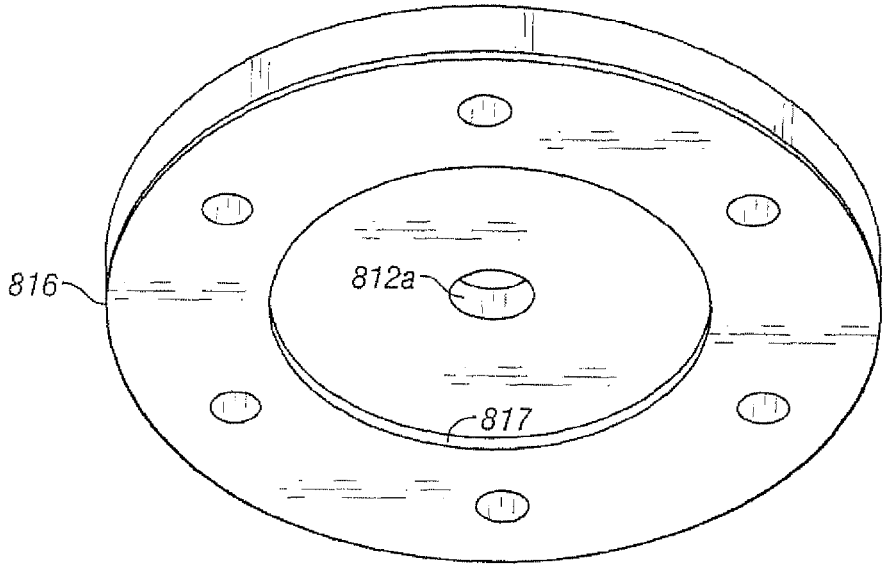
FIG. 20B is a bottom perspective view of the top cover of FIG. 20A.
Figure 20C:
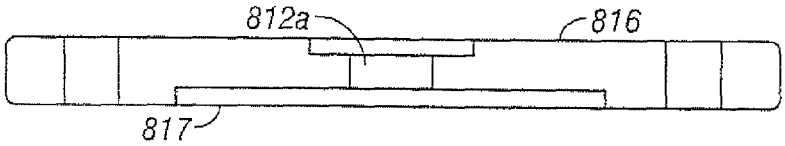
FIG. 20C is a side cross-section view of the top cover of FIG. 20A.

As shown in FIGS. 20A-20C the top cover 816 has a channel 812*a* for fluid communication with the line 812. The top cover 816 has a recess 817 for accommodating a top flange 821 of the bladder 820 as described below.

Figure 21A:
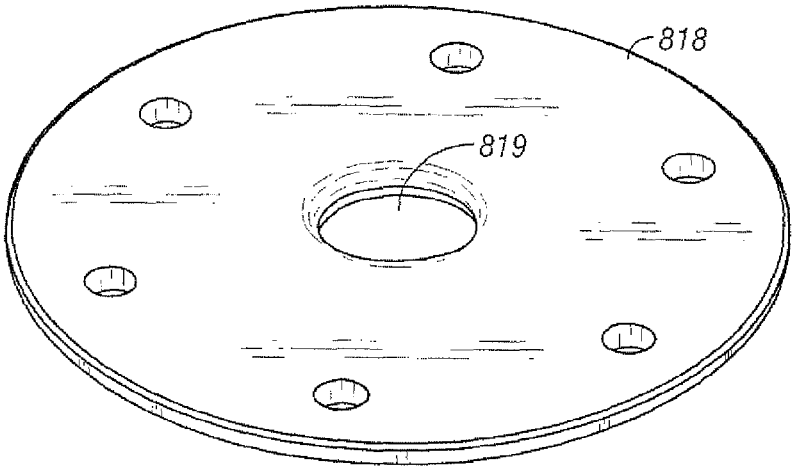
FIG. 21A is top perspective view of an intermediate cover of the dampener of FIG. 19A.
Figure 21B:
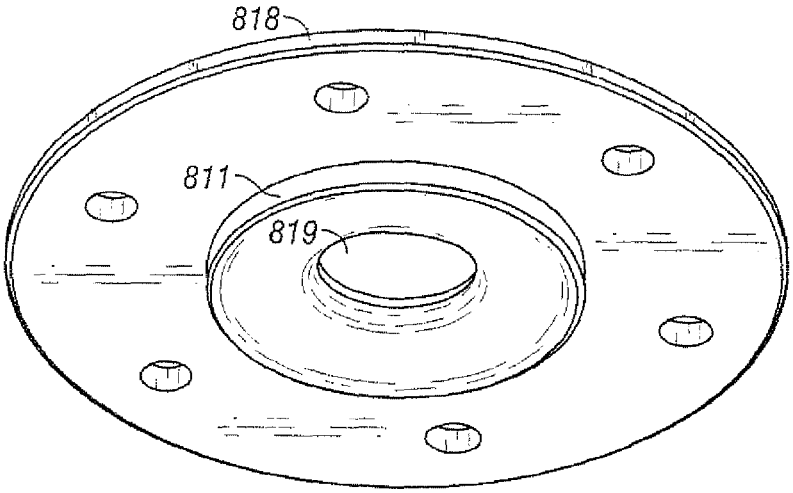
FIG. 21B is a bottom perspective view of the cover of FIG. 21A.
Figure 21C:
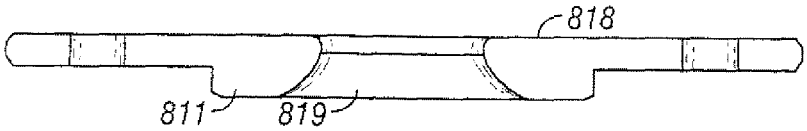
FIG. 21C is a side cross-section view of the cover of FIG. 21A.
Figure 22A:
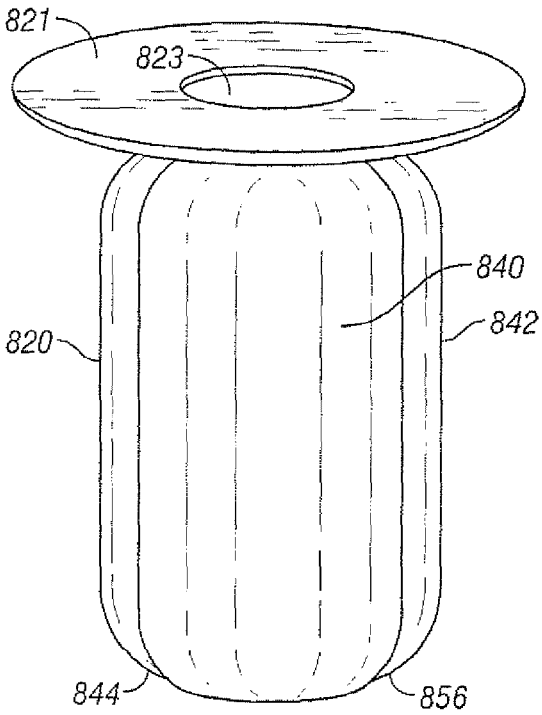
FIG. 22A is perspective view of a bladder of the dampener of FIG. 19A.
Figure 22B:
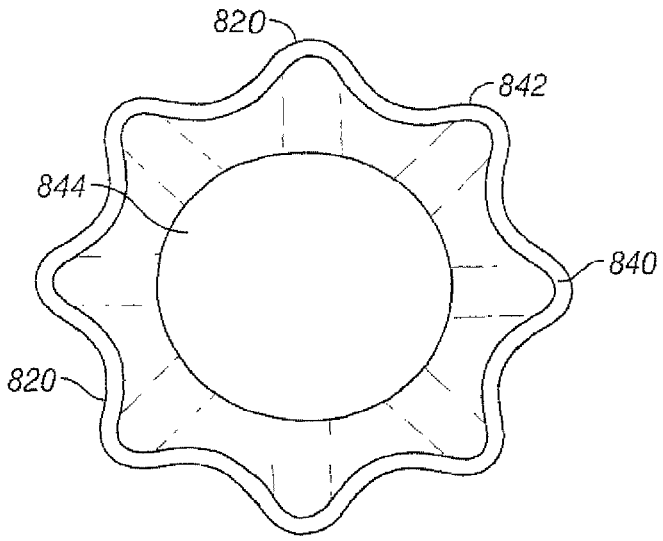
FIG. 22B is a cross-section of the bladder of FIG. 22A.
Figure 22C:
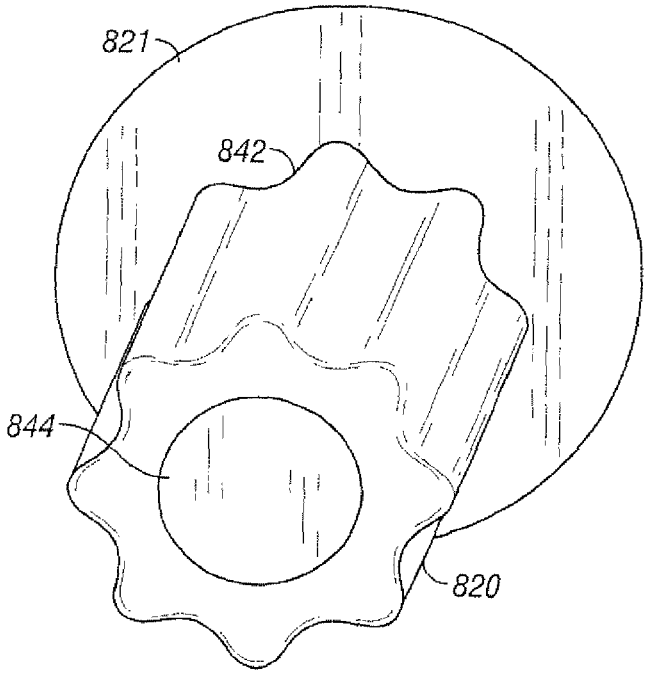
FIG. 22C is a bottom perspective view of the bladder of FIG. 22A.
Figure 22D:
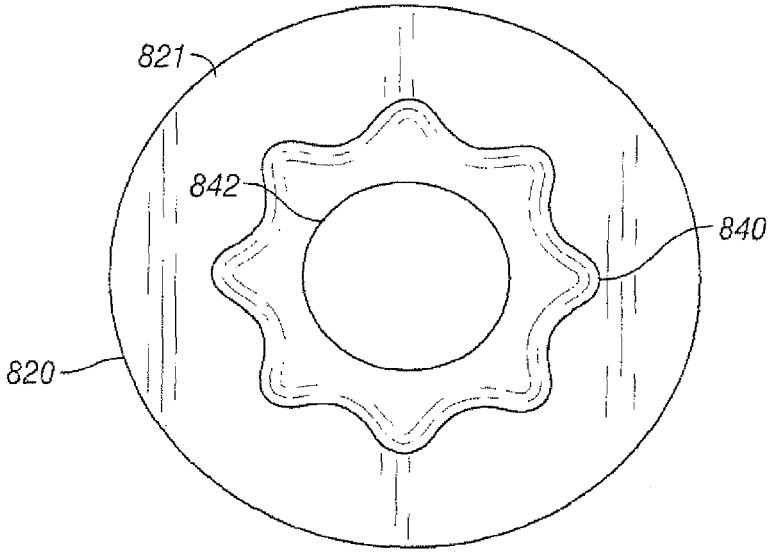
FIG. 22D is bottom view of the bladder of FIG. 22A.

As shown in FIGS. 21A-21C, the intermediate cover 818 has a projection 811 with an opening 819 through which passes a neck 823 of the bladder 820. Optionally, the two covers are made as a single integral piece. The bladder 820 has a bottom 844 and a lobed body 840 with a plurality of spaced-apart lobes 842. This construction yields a structure which is under no stress at any time, even under the slightest or largest excitation. Stress in a material occurs only when the material is stretched. In other words, there is no more material to move along in the direction of deflection. For example, consider a piece of rubber band placed atop a table and one end of this piece is fixed through any method, i.e. in between the fingers of one hand. At the other end a force is applied in, e.g., a longitudinal direction. The rubber band will start stretching and this will be evident because there is no extra material to compensate for the displacement of the taught end. Now assume that the rubber band is placed between a person's hands. The distance between the hands is so that the rubber droops. Moving one hand straightens the rubber. No stress is applied so far because there is enough material to compensate for the displacement. The rubber will start stretching only after it becomes perfectly straight and there is no more material to compensate for the displacement. The lobes 842 play the role of the "droops" as discussed above. Thus, the lobes 842 secure enough material allowing the bladder to balloon or increase its form without stretching or stressing the rubber material Additionally, the lobes 842 are sized so that their circumference and, thus, the bladder's total circumferential length in relaxed condition, is greater than the total circumferential length in expanded condition. Moreover, when the bladder is expanded, it can reach only a maximum size/diameter. This size is determined/limited by the inside diameter of the housing. Under fully expanded condition, the bladder is in full contact with the housing. Consequently, even with the interior pressure increasing, the bladder can not expand any more because it is fully and rigidly supported by the housing's walls.

The envelope or size of the bladder increases in form only, and not due to stress, since there is sufficient bladder material to compensate for an increase in pressure and consequently, an increase in size until the bladder comes in full contact with surrounding walls. The rubber or flexible material of the bladder is not stretched and the bladder is supported at the top by the intermediate cover 818 and the flange 821 resting thereon and at the bottom by a curved base 846 of the housing 814. A non-stressed bladder, all things being equal, outlasts a stressed bladder.

FIGS. 23A-23E illustrate the housing 814 which includes a flange 848 and a lower channel 852 which is in fluid communication with the line 828.

Figure 23A:
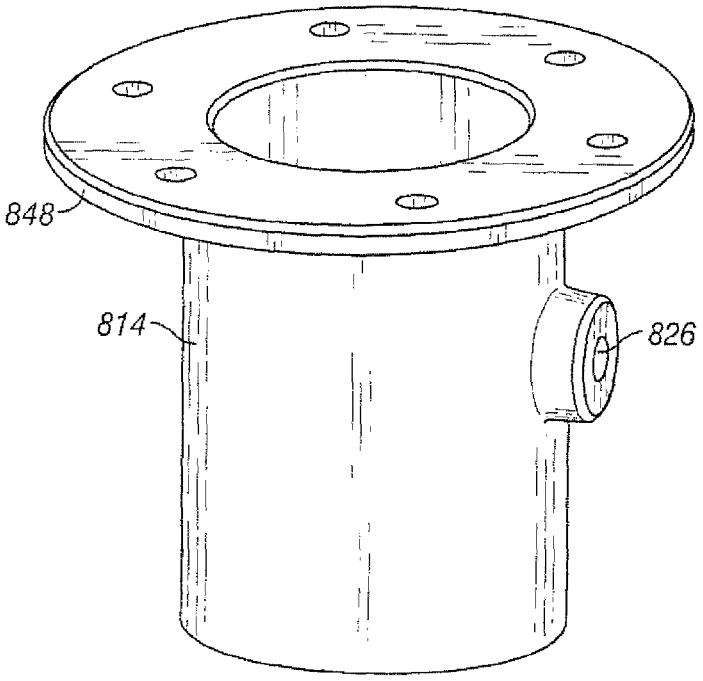
FIG. 23A is a perspective view of a housing of the dampener of FIG. 19A.
Figure 23B:
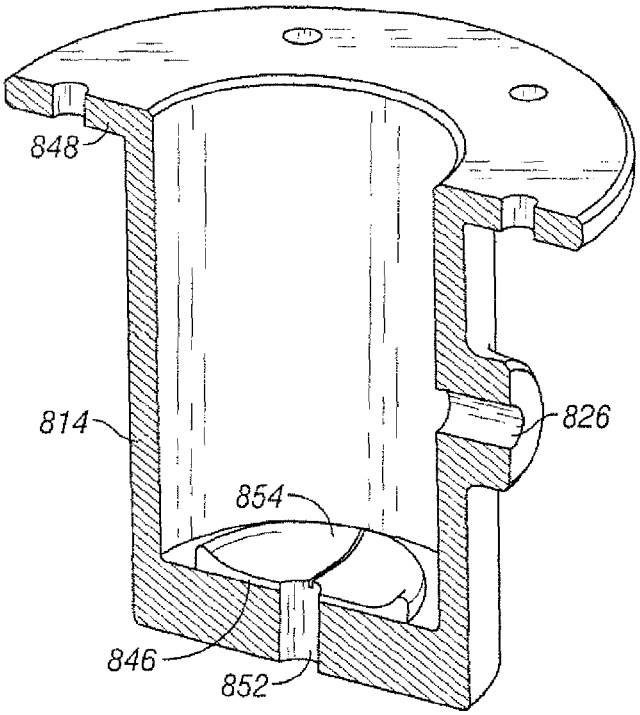
FIG. 23B is a cross-section view of the housing of FIG. 23A.
Figure 23C:
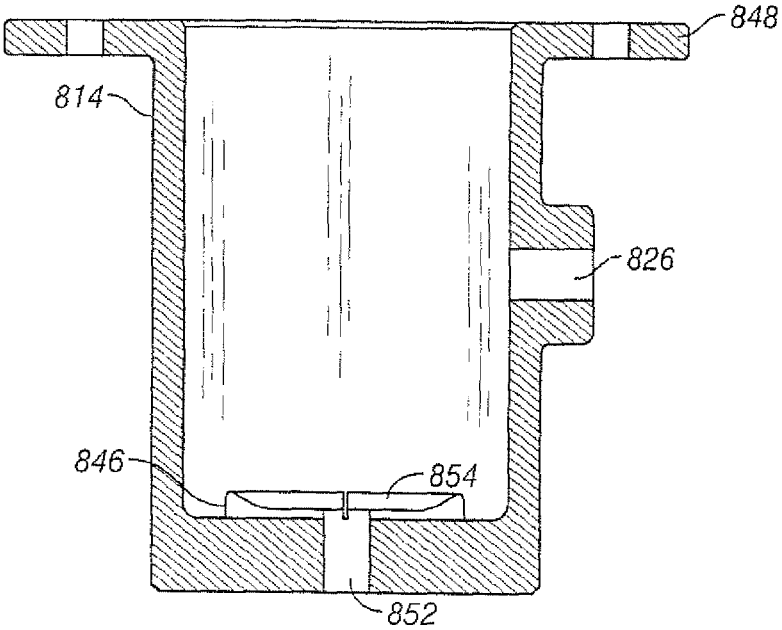
FIG. 23C is a cross-section view of the housing of FIG. 23A.
Figure 23D:
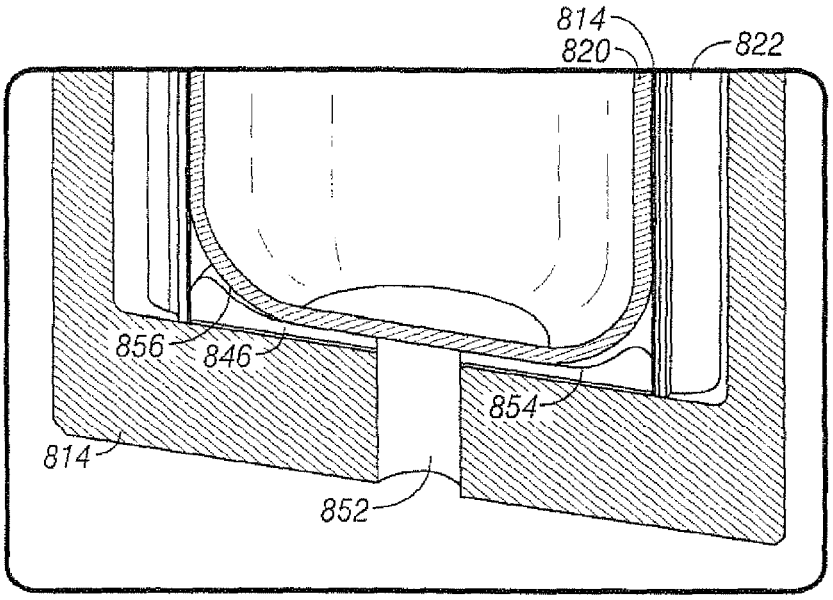
FIG. 23D is a partial cross-section view of the housing of FIG. 23A.
Figure 23E:
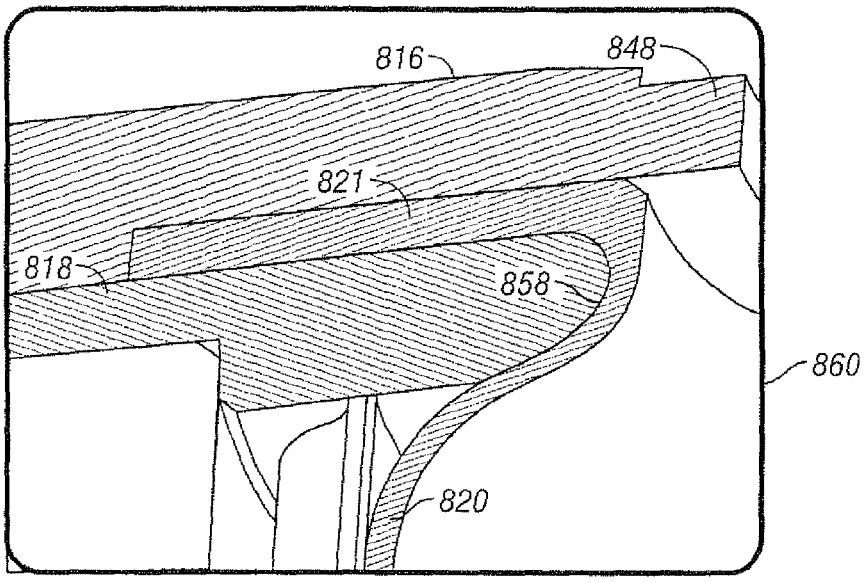
FIG. 23E is a partial cross-section view of the housing of FIG. 23A.

As shown, e.g., in FIG. 23D, a curved surface 854 of the curved base 846 corresponds to a lower curved part 856 of the bladder 820. As shown in FIG. 23E a curved edge 858 of the intermediate cover 818 corresponds in shape to a surface 860 of the bladder 820.

Figure 24A:
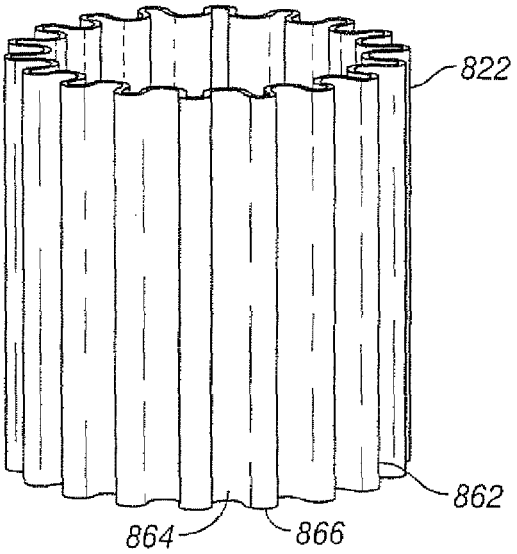
FIG. 24A is a perspective view of a spring of the dampener of FIG. 19A.
Figure 24B:
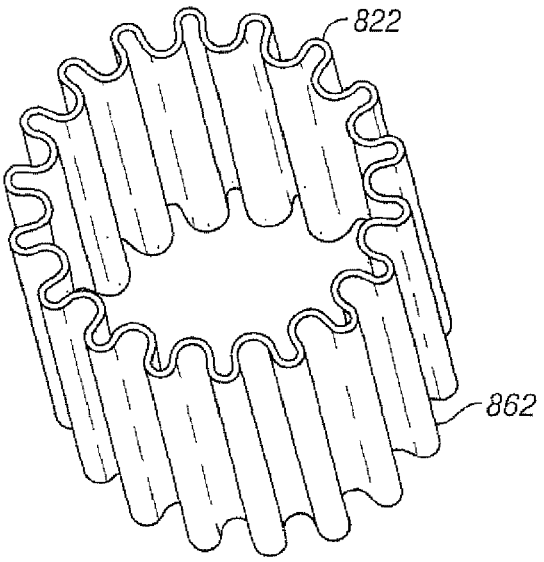
FIG. 24B is a perspective view of the spring of FIG. 24A.
Figure 24C:
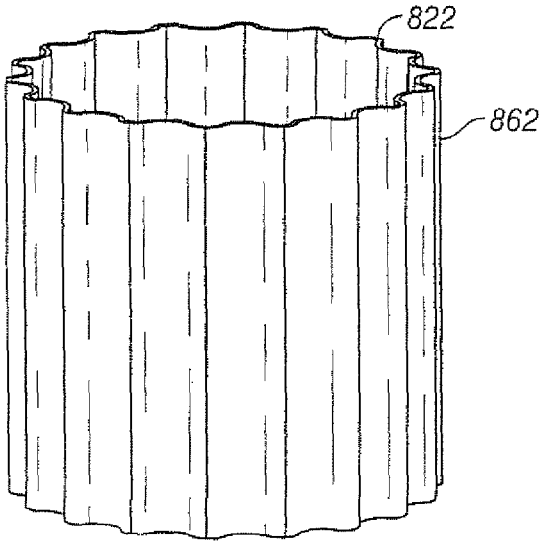
FIG. 24C is a perspective view of the spring of FIG. 24A.
Figure 24D:
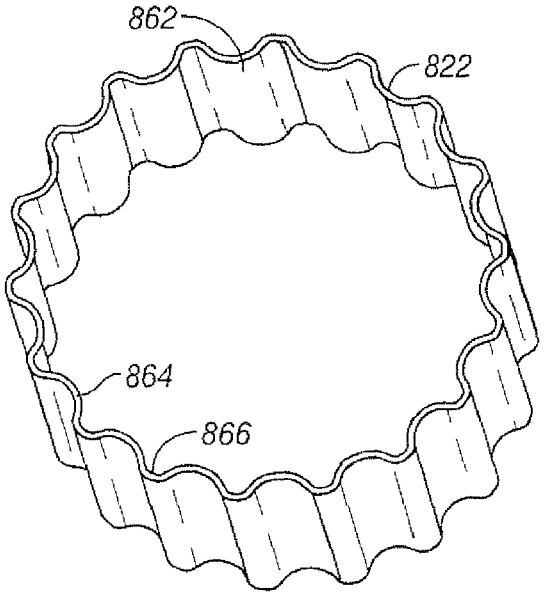
FIG. 24D is a perspective view of the spring of FIG. 24A.

FIGS. 24A-24D show the spring 822 in the form of a wave-shaped spring with a body 862 with multiple spaced-apart ridges 864 and valleys 866. FIGS. 24A and 24B show the spring 822 in an unpressurized mode and FIGS. 24C and 24D show the system under pressure. In one aspect, the number of the ridges 864 and of the valleys 866 is higher than the bladder's number of lobes. Thus a bladder's lobe is supported by two or more ridges on the spring 822. This insures the lobes and, therefore, the bladder, are supported and the two do not simply "mesh" one into the other.

Figure 25A:
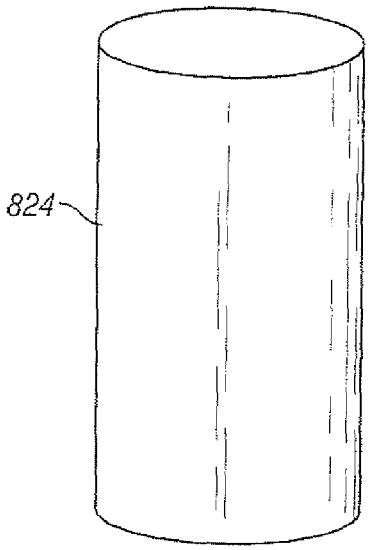
FIG. 25A is a perspective view of a ring of the dampener of FIG. 19A.
Figure 25B:
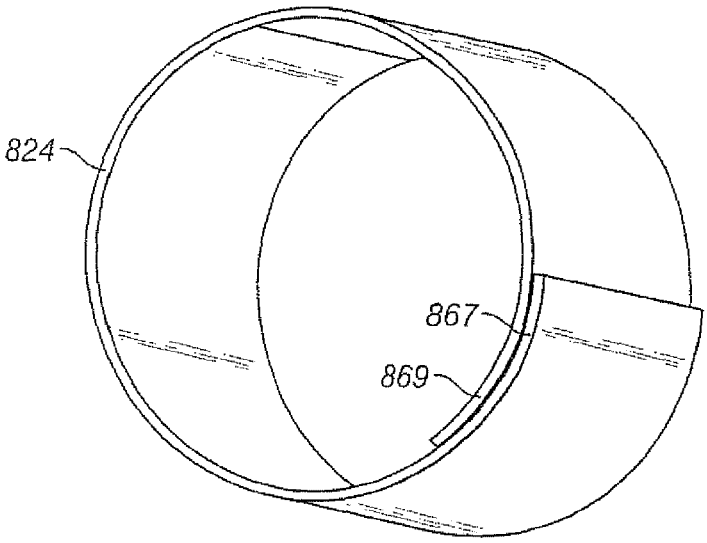
FIG. 25B is a perspective view of the ring of FIG. 25A.
Figure 25C:
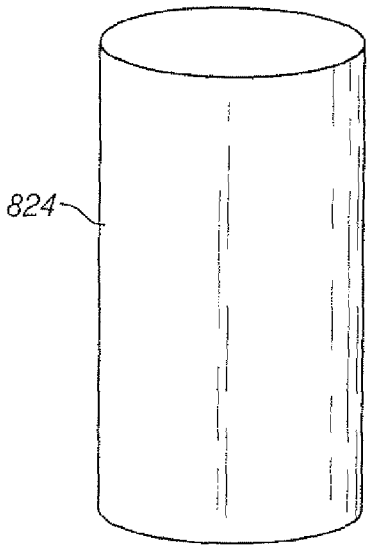
FIG. 25C is a perspective view of the ring of FIG. 25A.
Figure 25D:
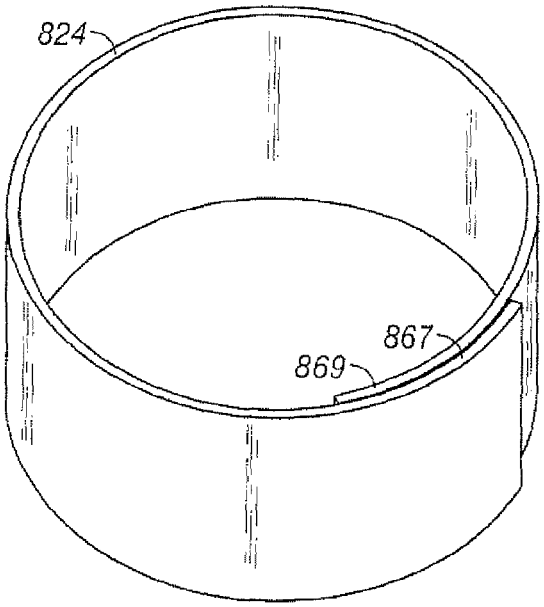
FIG. 25D is a perspective view of the ring of FIG. 25A.

FIGS. 25A-25B show the ring 824 which has a body 868 with ends 867, 869. The ring 824 provides a protective barrier between the bladder 820 and the spring 822 and it expands and contracts in response to pressure. This structure reduces friction between the rubber/bladder 820 and wave-shaped spring 822. Thus, the bladder 820, during its expansion under pressure, slides relative to the spring 822. Consequently, no material is stretched even in a very thin outside layer. This also contributes to the life span of the lobed bladder. Uncontrolled stretching and movement are reduced. FIGS. 25A and 25B show the ring 824 in a non-pressurized state. FIGS. 25C and 25D show the ring 824 under pressure folded on itself with the ends 867, 869 unconnected and can expand and contract without restriction.

Figure 26A:
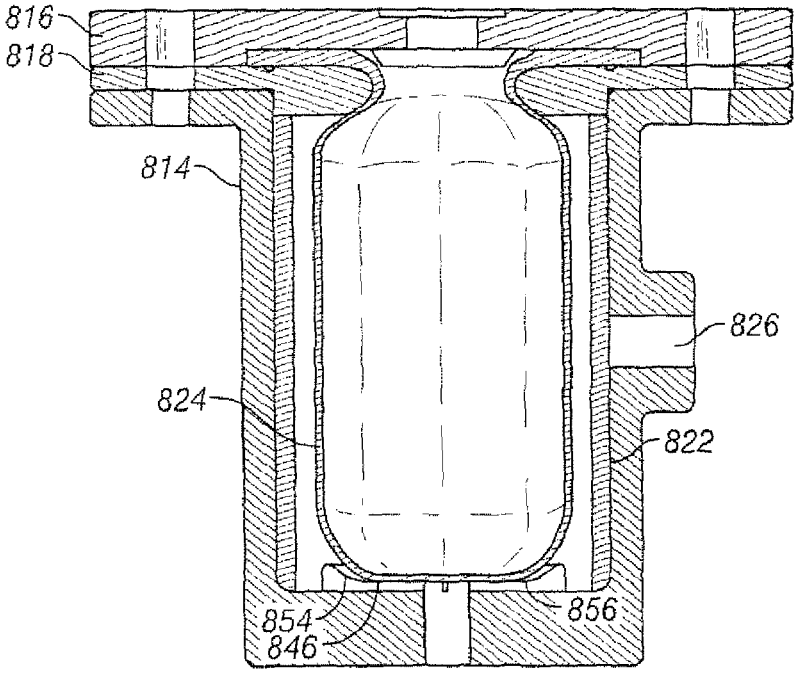
FIG. 26A is a cross-section view of the housing of the dampener of FIG. 19A.
Figure 26B:
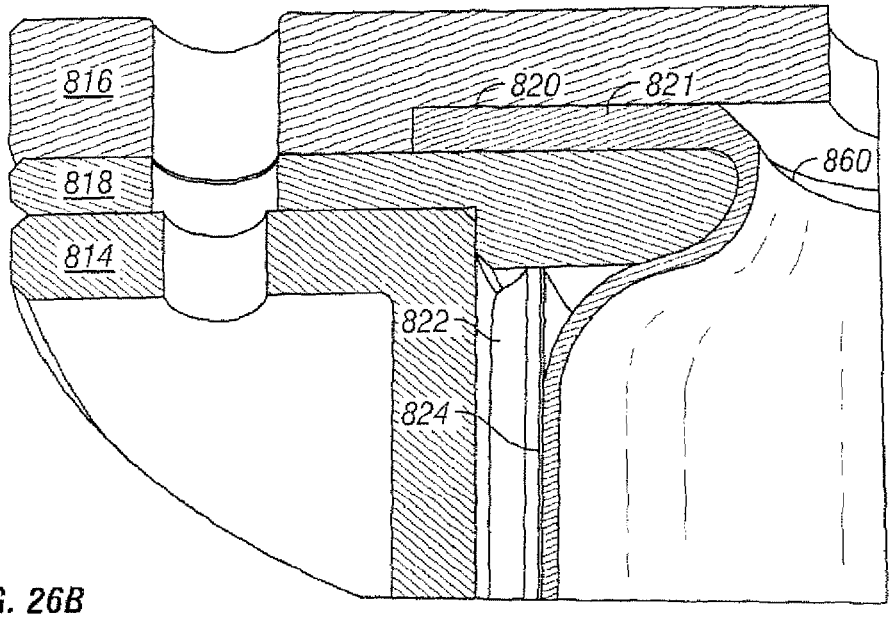
FIG. 26B is a partial view of the housing as shown in FIG. 26A.
Figure 26C:
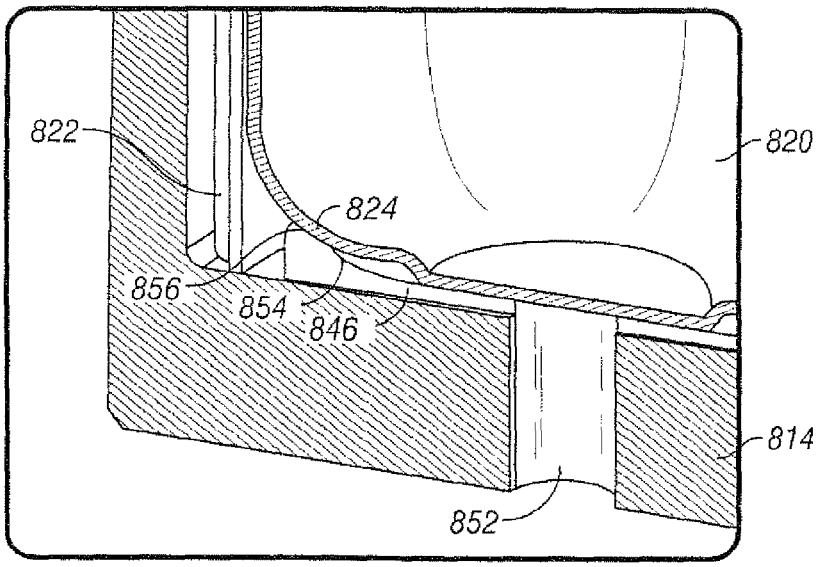
FIG. 26C is a partial view of the housing as shown in FIG. 26A.

FIGS. 26A-26C illustrate the bladder 820 under pressure, i.e., with drilling mud therein under pressure from a block's pumping chamber. As shown in FIGS. 26A and 26C, the bladder 820 has expanded and the lower part 856 of bladder 820 has moved and is supported by the curved surface 854 of the curved base 846.

In FIGS. 23D and 23E, the device is under no pressure, the spring 822 is contracted forcing the bladder to its smallest dimension. Thus, there is space between the housing and the spring. The spring is away from and spaced-apart from the housing's surrounding wall. As shown in FIG. 26B, the bladder is fully expanded and forces the spring to come in contact with the housing's wall. Since the spring is pushed against the wall, the spring's waves are compressed and reduced until the spring can not be compressed any more. There is no space between the spring and the wall in this picture. Additionally, the spring's width is relatively reduced.

Figure 26D:
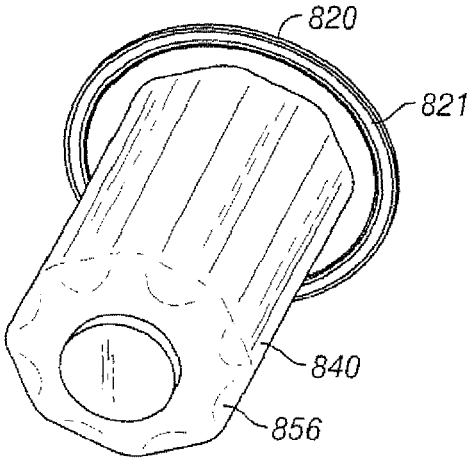
FIG. 26D is a bottom perspective view of the bladder as shown in FIG. 26A.
Figure 26E:
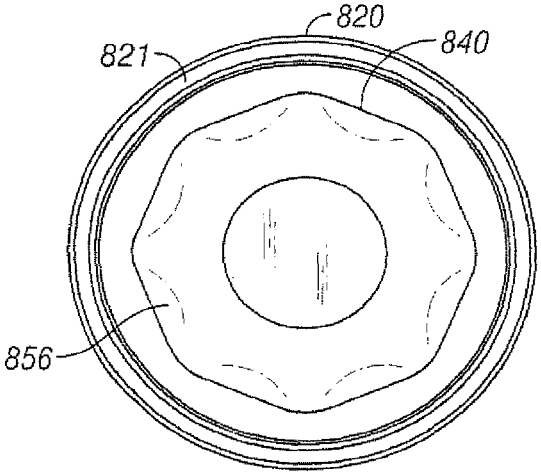
FIG. 26E is a bottom view of the bladder as shown in FIG. 26A

As shown in FIGS. 26D and 26E, the pressure of the mud in the bladder 820 has pushed out the ridges 864.

The bladder 820 provides a separating membrane between two media (the mud being pumped and the hydraulic fluid or oil supplied from the source 834). A pulsation/pressure variation in the mud column translates into the bladder's ballooning or shrinkage. The bladder balloons if the pressure inside it increases past the resistive force offered by the sum of the "returning mechanism" plus the resistive force generated by the oil flowing through a controlled valve orifice (e.g. of the valve assembly 830; or of the valve assembly 704 described above). The "returning mechanism" includes the surrounding spring 822 (or, optionally, a piston powered by a spring or a constant pressure hydraulic power source and a check valve). If the valve orifice is fully blocked, and because generally speaking a fluid is incompressible, the oil can not escape from in between the bladder and the surrounding housing. In the case of a hydraulic source 834 and check valve 829 this is possible because a higher pressure inside the dampener housing will shut close the check valve 829. This results in a relatively rigid bladder that will not be able to accommodate any pressure increase on the mud's side. Consequently, a pressure wave in the mud's column will pass undisturbed down further into the discharge pipe line. Conversely, the bladder shrinks when the pressure inside it, pressure that equals the mud column pressure, becomes smaller than the sum of the surrounding spring's force (spring 822) and of the fluid's/oil's flow back into the reservoir RV. In the instance of a constant pressure hydraulic source 834 used as return mechanism, the check valve 826 stays open because the pressure inside the bladder is smaller than that of the hydraulic source 834. The fluid from the hydraulic source 834 flows into and through the space in between the bladder and housing as long as the proportional valve 830 allows it. If the proportional valve 830 is fully closed than the check valve 826 stays open until the entrapped fluid assumes the pressure of the hydraulic source 834. As soon as this moment is reached, any minute pressure increase on the mud side forces an increase in pressure on the hydraulic or oil side and the check valve 826 shuts off. In turn, this results in no back flow condition from the dampener system back to the hydraulic source 834. On the other hand, this translates into an increase in pressure that is recorded by the pressure transducer 836 and it forces a signal from the control unit. This signal opens the valve orifice of the proportional valve 830 even a minute amount but enough to release oil back to the reservoir RV. Consequently, the pressure drops at a prescribed rate. As a result, the mud's pressure might become slightly larger and mud will enter into the bladder. This rush of mud into the bladder is converted into a pressure drop inside the pumping chamber 805 and, thus, into a controlled pressure at the outlet 809 and along the discharge line. The hydraulic source 834 plays the role of a "returning mechanism" and not of a controlling one. In one aspect, in this design, the hydraulic source's pressure can be sufficiently low to just push back the bladder to its relaxed shape. The bladder as a separating membrane stays in full contact with the pressure varying mud. The "returning mechanism" (a spring, gas, or oil under some pressure) acts as an elastic element that pushes back the bladder in its full contact with the pulsating mud. The controlling mechanism includes intentionally and controllably bleeding fluid through a controlled valve e.g. the valve 830 from the dampener's oil side into the reservoir RV in order to accommodate and compensate for pressure pulsations/variations on the mud side, resulting in a close to constant pressure at the outlet 809 in the pump's discharge line.

Each of the systems described above can provide control of a valve assembly (e.g., but not limited to, a proportional valve assembly) which permits the valve assembly to be adjusted in response to pressure changes so that the dampener system adjusts to pulsations of varying frequency. In one aspect, the control system does this in real time, on-the-fly. In one aspect, the control system controls the valve assembly (to control the piston-cylinder apparatus) so that the dampener system adjusts for pulsation frequencies from 2 to 6000 Hertz; and, in other aspects, for pulsations with frequencies between 1 to 4000 Hertz or between 1 to 1000 Hertz.

Instead of the particular dampeners and dampener elements described above, it is within the scope of the present invention to use a known dampener, e.g., but not limited to, a coiled spring or a fluid reservoir dampener apparatus, which can return a piston to a relaxed position or past such a position when there is vacuum inside a valve block. Under a condition of vacuum/depression, the piston pumps fluid inside the valve chamber and, thus, maintain as close as possible a constant preset pressure.

The present invention, therefore, provides in some, but not in necessarily all embodiments a system for pumping a drilling fluid mixture, the drilling fluid mixture containing drilling fluid and solids, the system including: a pump apparatus; the pumping apparatus having a body with a pumping chamber, an inlet and an outlet; a suction valve in the body for selectively controlling flow of the drilling fluid mixture in through the inlet; a discharge valve in the body for selectively controlling flow of the drilling fluid mixture out through the outlet; each of the suction valve and the discharge valve having a seat with a curved valve seat surface and a valve member with a curved member surface, part of the valve member movable to seat the curved member surface against the curved valve seat surface to prevent the flow of the drilling fluid mixture past the valve seat; and a dampener system (any disclosed herein according to the present invention) in fluid communication with the pumping chamber.

The present invention, therefore, provides in some, but not in necessarily all embodiments a system for pumping fluid, the system including: a pump apparatus; the pumping apparatus having a body with a pumping chamber, an inlet and an outlet; a suction valve in the body for selectively controlling flow of the fluid in through the inlet; a discharge valve in the body for selectively controlling flow of the fluid out through the outlet; a dampener system in fluid communication with the pumping chamber; the dampener system having a base, a housing connected to the base, the housing having an interior, a liner within the housing, the liner expandable in response to fluid pressure, a piston/cylinder apparatus in fluid communication with the housing, the piston/cylinder apparatus having a movable piston movable in response to fluid flowing from the housing to the piston/cylinder apparatus, a torsion apparatus movably connected to the base, the piston movable to contact and to move the torsion apparatus in response to fluid flowing from the housing to the piston/cylinder apparatus, and the torsion apparatus movable by the piston from a first static position to a second position to dampen pulsations of fluid into the pumping chamber.

The present invention, therefore, provides in some, but not in necessarily all embodiments a system for pumping a fluid, the system including: a pump apparatus, the pumping apparatus having a body with a pumping chamber, an inlet and an outlet, a suction valve in the body for selectively controlling flow of the fluid in through the inlet, a discharge valve in the body for selectively controlling flow of the fluid out through the outlet, a dampener system in fluid communication with the pumping chamber, a housing, the housing having an interior, a deformable bladder within the housing, the deformable bladder in fluid communication with the pumping chamber, and the deformable bladder deformable in response to pressure variation in the pumping chamber.

The present invention, therefore, provides in some, but not in necessarily all embodiments a dampener system including: a base, a housing connected to the base, the housing having an interior, a liner within the housing, the liner expandable in response to fluid pressure, a piston/cylinder apparatus in fluid communication with the housing, the piston/cylinder apparatus having a movable piston movable in response to fluid flowing from the housing to the piston/cylinder apparatus, a torsion apparatus movably connected to the base, the piston movable to contact and to move the torsion apparatus in response to fluid flowing from the housing to the piston/cylinder apparatus, and the torsion apparatus movable by the piston from a first static position to a second position to dampen pulsations of fluid in the housing.

The present invention, therefore, provides in some, but not in necessarily all embodiments a dampener system including: a housing, the housing having an interior, a deformable bladder within the housing, the deformable bladder in fluid communication with the pumping chamber, the deformable bladder deformable in response to pressure variation in the pumping chamber, a valve assembly in fluid communication with a fluid reservoir and in fluid communication with the interior of the housing, a control system for controlling the valve assembly, the valve assembly controllable to control deformation of the deformable bladder, the deformable bladder having a bladder body with a top, a bottom, and a side wall, and the side wall comprising a lobed wall with a plurality of spaced-apart lobes therearound to inhibit stress on the bladder body.

The present invention, therefore, provides in some, but not in necessarily all embodiments methods for dampening a pumped fluid (e.g. a pumped drilling fluid mixture), the fluid pumped by a system having a pump apparatus; the pumping apparatus having a body with a pumping chamber, an inlet and an outlet; a suction valve in the body for selectively controlling flow of the fluid in through the inlet; a discharge valve in the body for selectively controlling flow of the fluid out through the outlet; and a dampener system (any according to the present invention) in fluid communication with the pumping chamber; the method including pumping the drilling fluid mixture with the pump apparatus, and dampening the pumped drilling fluid with the dampener system.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with the requirements of 35§112. The inventors may rely on the Doctrine of Equivalents to determine and assess the scope of their invention and of the claims that follow as they may pertain to apparatus and/or methods not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

Whereas the present invention has been described in particular relation to the drawings attached hereto, it should be understood that other and further modifications apart from those shown or suggested herein, may be made within the scope and spirit of the present invention.

What is claimed is:

1. A dampener system, comprising:

a housing comprising a cylindrical axis;

a deformable bladder positioned within said housing, said deformable bladder comprising a body comprised of a plurality of spaced-apart lobes, wherein said deformable bladder is adapted to be expandable in response to a fluid pressure within said deformable bladder, wherein said spaced-apart lobes, when said bladder is fully pressurized within said housing, extend along a direction that is substantially parallel to said cylindrical axis of said housing and wherein said deformable bladder comprises an axial length in a direction that is substantially parallel to said cylindrical axis of said housing; and a split-ring member with unconnected ends positioned around substantially the entire axial length of said deformable bladder, wherein said unconnected ends overlap one another.

2. The system of claim 1, wherein said split-ring member has a generally cylindrical configuration that is split along its axial length.

3. The system of claim 1, further comprising a spring positioned around said deformable bladder.

4. The system of claim 3, wherein said spring is a wave-shaped spring comprised of a plurality of ridges and a plurality of valleys.

5. The system of claim 1, wherein said split-ring member has a generally cylindrical configuration that is split along its axial length and a spring positioned around said split-ring member with said generally cylindrical configuration.

6. The system of claim 5, wherein said spring is a wave-shaped spring comprised of a plurality of ridges and a plurality of valleys.

7. A dampener system, comprising:

a housing having an interior surface;

a deformable bladder positioned within said housing, said deformable bladder comprising a body comprised of a plurality of spaced-apart lobes, wherein said deformable bladder is adapted to be expandable in response to a fluid pressure within said deformable bladder;

a split-ring member with unconnected ends positioned around said deformable bladder, wherein said split-ring member has a generally cylindrical configuration; and a spring positioned around said split-ring member, wherein said spring is adapted to engage said interior surface of said housing.

8. The system of claim 7, wherein said spring is a wave-shaped spring comprised of a plurality of ridges and a plurality of valleys.

9. A dampener system, comprising:

a cylindrical housing having an interior surface and a cylindrical axis;

an expandable liner positioned within said housing, wherein said expandable liner is adapted to radially expand in response to fluid pressure within said liner, wherein said liner has a fully expanded circumferential length within said housing when said liner is fully pressurized and a fully relaxed circumferential length within said housing when said liner is not pressurized, said fully relaxed circumferential length being greater than said fully expanded circumferential length, wherein said expandable liner comprises:

a lobed outer surface comprised of a plurality of spaced-apart lobes; and a plurality of spaced-apart ridges, each of which is adapted to engage a portion of said interior surface of said housing, each of said ridges being positioned between a pair of said plurality of spaced-apart lobes, wherein said ridges, when said liner is fully pressurized within said housing, extend along a direction that is substantially parallel to said cylindrical axis of said housing.

10. The system of claim 9, wherein said interior surface of said housing comprises a plurality of spaced-apart recesses for channeling fluid flow around an exterior of said expandable liner.

11. A dampener system, comprising:

a base;

a housing connected to said base, said housing having an interior surface;

an expandable liner positioned within said housing, said liner adapted to be expandable in response to fluid pressure within said liner;

a piston/cylinder apparatus in fluid communication with said housing, said piston/cylinder apparatus having a movable piston that is adapted to move in response to fluid flowing from said housing to said piston/cylinder apparatus; and a torsion apparatus operatively coupled to said movable piston, said movable piston adapted to cause movement of said torsion apparatus in response to fluid flowing from the housing to the piston/cylinder apparatus, wherein said torsion apparatus is adapted to be moved from a first static position to a second position to dampen pulsations in said fluid, wherein said torsion apparatus comprises:

a central shaft connected to said housing;

an arm comprising a ring, said arm adapted to be moved by movement of said movable piston;

a plurality of flexible elements disposed around said central shaft between said central shaft and said ring; and at least one mechanical stop between said flexible elements, said at least one mechanical stop being operatively coupled to said housing, wherein movement of said arm with respect to said central shaft causes deformation of said flexible elements.

12. The system of claim 11, wherein said interior surface of said housing comprises a plurality of spaced-apart recesses for channeling fluid flow around an exterior of said expandable liner.

13. The system of claim 11, wherein said expandable liner comprises a plurality of spaced-apart ridges, each of which is adapted to engage a portion of said interior surface of said housing.

14. The system of claim 11, wherein said expandable liner comprises an expandable body having a lobed outer surface.

15. The system of claim 14, wherein said expandable liner comprises a plurality of spaced-apart ridges, each of which is adapted to engage a portion of said interior surface of said housing.

16. The system of claim 12, wherein said expandable liner comprises a plurality of spaced-apart ridges, each of which is adapted to engage a portion of said interior surface of said housing.

17. The system of claim 16, wherein said expandable liner comprises an expandable body having a lobed outer surface.

18. The system of claim 17, wherein said expandable liner comprises a plurality of spaced-apart ridges, each of which is adapted to engage a portion of said interior surface of said housing.

19. A dampener system, comprising:

a base, a housing connected to said base, said housing having an interior surface;

an expandable liner positioned within said housing, the liner adapted to be expandable in response to fluid pressure within said liner; and a torsion apparatus that is adapted to be moved from a first static position to a second position in response to fluid flowing from said housing, wherein, in moving from said first static position to said second position, said torsion apparatus is adapted to dampen pulsations in said fluid, wherein said torsion apparatus comprises:

a central shaft connected to said housing;

an arm comprising a ring, said arm adapted to be moved by movement of said movable piston;

a plurality of flexible elements disposed around said central shaft between said central shaft and said ring; and at least one mechanical stop between said flexible elements, said at least one mechanical stop being operatively coupled to said housing, wherein movement of said arm with respect to said central shaft causes deformation of said flexible elements.

20. The system of claim 19, wherein said interior surface of said housing comprises a plurality of spaced-apart recesses for channeling fluid flow around an exterior of said expandable liner.

21. The system of claim 19, wherein said expandable liner comprises a plurality of spaced-apart ridges, each of which is adapted to engage a portion of said interior surface of said housing.

22. The system of claim 19, wherein said expandable liner comprises an expandable body having a lobed outer surface.

23. The system of claim 22, wherein said expandable liner comprises a plurality of spaced-apart ridges, each of which is adapted to engage a portion of said interior surface of said housing.

* * * * *